US010852689B2

(12) United States Patent
Takami et al.

(10) Patent No.: US 10,852,689 B2
(45) Date of Patent: Dec. 1, 2020

(54) POWDER CONTAINER AND IMAGE FORMING APPARATUS

(71) Applicant: Ricoh Company, Ltd., Tokyo (JP)

(72) Inventors: Nobuo Takami, Kanagawa (JP); Kiyonori Tsuda, Kanagawa (JP); Ryoichi Teranishi, Shizuoka (JP); Junichi Matsumoto, Kanagawa (JP); Toshio Koike, Tokyo (JP); Yutaka Takahashi, Kanagawa (JP); Junji Yamabe, Shizuoka (JP); Akihiro Kawakami, Tokyo (JP); Keinosuke Kondoh, Kanagawa (JP); Atsushi Inoue, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/841,705

(22) Filed: Apr. 7, 2020

(65) Prior Publication Data

US 2020/0233371 A1 Jul. 23, 2020

Related U.S. Application Data

(63) Continuation of application No. 16/514,668, filed on Jul. 17, 2019, now Pat. No. 10,635,043, which is a (Continued)

(30) Foreign Application Priority Data

| | | |
|---|---|---|
| Aug. 8, 2014 | (JP) | 2014-162972 |
| Sep. 30, 2014 | (JP) | 2014-201902 |
| Nov. 19, 2014 | (JP) | 2014-234843 |

(51) Int. Cl.
*G03G 21/16* (2006.01)
*G03G 15/08* (2006.01)

(52) U.S. Cl.
CPC ..... *G03G 21/1647* (2013.01); *G03G 15/0872* (2013.01); *G03G 15/0891* (2013.01)

(58) Field of Classification Search
CPC ..... G03G 15/0891; G03G 21/1647
See application file for complete search history.

(56) References Cited

U.S. PATENT DOCUMENTS

| | | | | |
|---|---|---|---|---|
| 5,142,335 | A | 8/1992 | Sakata | |
| 6,185,401 | B1 * | 2/2001 | Kanamori | G03G 15/0872 399/119 |

(Continued)

FOREIGN PATENT DOCUMENTS

| | | |
|---|---|---|
| CN | 102213934 A | 10/2011 |
| JP | 06-035320 | 2/1994 |

(Continued)

OTHER PUBLICATIONS

International Search Report issued in PCT/JP2015/003950 dated Oct. 27, 2015.

(Continued)

*Primary Examiner* — Francis C Gray
(74) *Attorney, Agent, or Firm* — Xsensus LLP

(57) ABSTRACT

A powder container is for use with an image forming apparatus, and the image forming apparatus includes a driving protrusion that is rotatable and that protrudes toward an upstream side in an insertion direction in which the powder container is inserted. The powder container includes a container body to store powder, a cap attached to the container body, and a transmitted structure provided on the cap to contact the driving protrusion. The transmitted structure extends outward from an outer circumference of the powder container. The cap is rotatable relative to the container body in a predetermined angular range. The rotation of the cap relative to the container body is restricted so that the container body rotates along with the rotation of the cap (Continued)

when the rotation of the cap exceeds the predetermined angular range.

9 Claims, 53 Drawing Sheets

Related U.S. Application Data continuation of application No. 16/235,730, filed on Dec. 28, 2018, now Pat. No. 10,394,186, which is a continuation of application No. 16/033,004, filed on Jul. 11, 2018, now Pat. No. 10,203,650, which is a continuation of application No. 15/502,348, filed as application No. PCT/JP2015/003950 on Aug. 5, 2015, now Pat. No. 10,048,644.

(56) References Cited

U.S. PATENT DOCUMENTS

| | | | | |
|---|---|---|---|---|
| 6,259,877 | B1 * | 7/2001 | Taniyama | G03G 15/0872 222/DIG. 1 |
| 6,907,214 | B2 | 6/2005 | Kusano et al. | |
| 7,428,399 | B2 | 9/2008 | Takuwa | |
| 7,702,262 | B2 | 4/2010 | Taguchi et al. | |
| 7,706,699 | B2 | 4/2010 | Taguchi et al. | |
| 7,822,371 | B2 | 10/2010 | Taguchi et al. | |
| 7,853,184 | B2 | 12/2010 | Taguchi et al. | |
| 7,991,334 | B2 | 8/2011 | Taguchi et al. | |
| 8,126,375 | B2 | 2/2012 | Taguchi et al. | |
| 10,048,615 | B2 * | 8/2018 | Yamabe | G03G 21/16 |
| 2002/0102113 | A1 | 8/2002 | Kusano et al. | |
| 2005/0111858 | A1 | 5/2005 | Nakazato | |
| 2007/0048029 | A1 | 3/2007 | Takuwa | |
| 2009/0103955 | A1 | 4/2009 | Takuwa | |
| 2010/0322677 | A1 | 12/2010 | Takuwa | |
| 2012/0014721 | A1 | 1/2012 | Takuwa | |
| 2012/0195645 | A1 | 8/2012 | Takami et al. | |
| 2012/0321341 | A1 * | 12/2012 | Hori | G03G 15/0877 399/110 |
| 2013/0216269 | A1 | 8/2013 | Yamabe et al. | |
| 2013/0322927 | A1 | 12/2013 | Matsumoto et al. | |
| 2013/0330105 | A1 * | 12/2013 | Komatsu | G03G 15/0868 399/262 |
| 2014/0119780 | A1 | 5/2014 | Hori et al. | |
| 2014/0241757 | A1 | 8/2014 | Kikuchi et al. | |
| 2014/0270859 | A1 | 9/2014 | Hosokawa et al. | |
| 2014/0348551 | A1 | 11/2014 | Yamabe et al. | |
| 2015/0043946 | A1 | 2/2015 | Takami et al. | |
| 2015/0055966 | A1 | 2/2015 | Matsumoto et al. | |
| 2015/0063875 | A1 * | 3/2015 | Ohshima | G03G 15/0867 399/258 |
| 2015/0078788 | A1 | 3/2015 | Koike et al. | |
| 2015/0139671 | A1 | 5/2015 | Matsumoto et al. | |
| 2015/0147096 | A1 | 5/2015 | Hori et al. | |
| 2015/0227086 | A1 | 8/2015 | Kondoh et al. | |
| 2015/0331363 | A1 | 11/2015 | Takami et al. | |
| 2015/0338775 | A1 * | 11/2015 | Hosokawa | G03G 15/0867 399/258 |
| 2016/0202633 | A1 | 7/2016 | Takami et al. | |
| 2017/0097586 | A1 * | 4/2017 | Takami | G03G 15/0879 |
| 2017/0227885 | A1 * | 8/2017 | Yamabe | G03G 15/0872 |
| 2018/0024466 | A1 * | 1/2018 | Takami | G03G 21/1647 399/262 |
| 2018/0335719 | A1 * | 11/2018 | Takami | G03G 21/1647 |

FOREIGN PATENT DOCUMENTS

| | | |
|---|---|---|
| JP | 07-168430 | 7/1995 |
| JP | 10-319696 | 12/1998 |
| JP | 2001-235935 | 8/2001 |
| JP | 2002-221858 | 8/2002 |
| JP | 2005-128414 | 5/2005 |
| JP | 2005-292676 | 10/2005 |
| JP | 2006-154318 | 6/2006 |
| TW | 201426211 A | 7/2014 |
| WO | WO 2011/111863 A1 | 9/2011 |

OTHER PUBLICATIONS

Extended European Search Report issued in Patent Application No. 15829142.7 dated Jul. 24, 2017.

Combined Taiwanese Office Action and Search Report issued in Taiwanese Patent Application No. 105141914 dated Jun. 28, 2017 (w/ English translation and English translation of category of cited documents).

Combined Office Action and Search Report issued in Chinese Patent Application No. 201580042474.5 dated Feb. 18, 2019 (w/ English translation).

* cited by examiner (a)

(b)

POWDER CONTAINER AND IMAGE FORMING APPARATUS

CROSS-REFERENCE TO RELATED APPLICATIONS

The present application is a continuation of U.S. application Ser. No. 16/514,668, filed Jul. 17, 2019, which is a continuation of U.S. application Ser. No. 16/235,730, filed Dec. 28, 2018 (now U.S. Pat. No. 10,394,186), which is a continuation of U.S. application Ser. No. 16/033,004, filed Jul. 11, 2018 (now U.S. Pat. No. 10,203,650), which is a continuation of U.S. application Ser. No. 15/502,348, filed on Feb. 7, 2017 (now U.S. Pat. No. 10,048,644), which is a National Stage Application of Application No. PCT/JP2015/003950, filed on Aug. 5, 2015, which claims priority to Japanese Patent Application No. 2014-162972, filed Aug. 8, 2014, Japanese Patent Application No. 2014-201902, filed Sep. 30, 2014, and Japanese Patent Application No. 2014-234843, filed Nov. 19, 2014. The entire contents of each of the above applications are hereby incorporated by reference in entirety.

TECHNICAL FIELD

The present invention relates to a powder container for storing powder, such as toner, and an image forming apparatus that conveys the powder from the powder container to a conveying destination.

BACKGROUND ART

In an image forming apparatus, such as a copier, a printer, or a facsimile machine, using an electrophotographic process, a latent image formed on a photoconductor is developed into a visible image with toner in a developing device. The toner is consumed through development of latent images, and it is necessary to replenish the developing device with toner. Therefore, a toner replenishing device, as a powder supply device, provided in the apparatus main-body conveys toner from a toner container, as a powder container, to the developing device in order to replenish the developing device with toner. With the developing device replenished with toner as described above, it is possible to continuously perform development. The toner container is detachably attached to the toner replenishing device. When the stored toner is used up, the toner container is replaced with a toner container containing new toner.

The toner replenishing device and the toner container of the image forming apparatus are shared among various models in order to reduce cost. PTL 1 describes a technology for providing a model-specific or color-specific identifier shape portion, which is a portion of a toner container formed in a different shape for a different type of the toner container.

The toner container described in PTL 1 has a cylindrical shape. When the toner container is set in the main body of the image forming apparatus, the toner container receives rotation drive from a main body of an image forming apparatus, and rotates about a center line, as a rotation axis, of the cylindrical shape to discharge toner from a discharge port. A unique identifier shape portion is provided on one of two bottom surfaces of the cylindrical shape, in particular, on an end surface on the downstream side in an insertion direction for insertion to the main body of the image forming apparatus (hereinafter, this end surface is referred to as a "front end surface").

SUMMARY OF INVENTION

Technical Problem

The cylindrical toner container is in an arbitrary posture in the rotation direction when an operator inserts the toner container in the main body of the image forming apparatus.

The toner container described in PTL 1 includes a protrusion serving as an identifier shape portion on the front end surface. The protrusion is arranged such that a distance from the center of the front end surface in the radial direction varies depending on the type of the toner container. On a rotary member serving as a drive output unit of the image forming apparatus, a number of recesses serving as main-body identifier shape portions of the apparatus are provided on the same circumference centered at a point that faces the center of the front end surface when the toner container is set.

In the configuration described in PTL 1, if the distance of the protrusion of the toner container from the center and the distances of the recesses of the main body of the image forming apparatus from the center in the radial direction match each other, the protrusion can interlock with any of the recesses regardless of the posture of the toner container in the rotation direction. In contrast, if the distance of the protrusion of the toner container from the center and the distances of the recesses of the main body of the image forming apparatus from the center in the radial direction do not match each other, the protrusion cannot interlock with any of the recesses. Therefore, the toner container cannot be inserted to the rear end of the main body of the image forming apparatus, and an operator can determine erroneous setting at the time of setting.

In the toner container described in PTL 1, identifier shape portions with protrusions at different positions on a straight line in the radial direction function as identifiers for different types of toner containers. In the toner container, it is possible to provide a certain number of the identifier shape portions in accordance with the number of the protrusions that can be arranged at different distances from the center of the front end surface in the radial direction.

However, in the toner container described in PTL 1, it is only possible to provide the same number of types of the identifier shape portions as the number of the protrusions that can be arranged at different distances from the center of the front end surface of the toner container in the radial direction. Therefore, the types of the identifier shape portion are limited, and the types of the toner containers that can be shared except for the identifier shape portions are limited. Consequently, it is difficult to adequately reduce cost for the toner replenishing device and the toner container.

The present invention has been conceived in view of the above circumstances, and there is a need for a powder container capable of using differences in positions in a direction different from the radial direction as differences in identifier shape portions, and an image forming apparatus including the powder container.

Solution to Problem

A powder container according to the invention is insertable in an image forming apparatus and includes a main-body interlocking portion that is rotatable and protrudes toward an upstream side in an insertion direction in which the powder container is inserted. The image forming apparatus includes an identifier protrusion that protrudes toward the upstream side in the insertion direction to identify a type of the powder container. The powder container includes a container interlocking portion configured to interlock with the main-body interlocking portion; and an interlocked portion configured to interlock with the identifier protrusion. The interlocked portion is provided in a front end of the powder container in the insertion direction. The container interlocking portion stands outward from an outer circumference of the powder container. The container interlocking portion and the interlocked portion are rotated integrally.

Advantageous Effects of Invention

According to an embodiment of the present invention, it is possible to use differences in positions in a direction different from the radial direction as differences in identifier shape portions.

DESCRIPTION OF EMBODIMENTS

Exemplary embodiments of the present invention will be described below with reference to the accompanying drawings.

Figure 2:
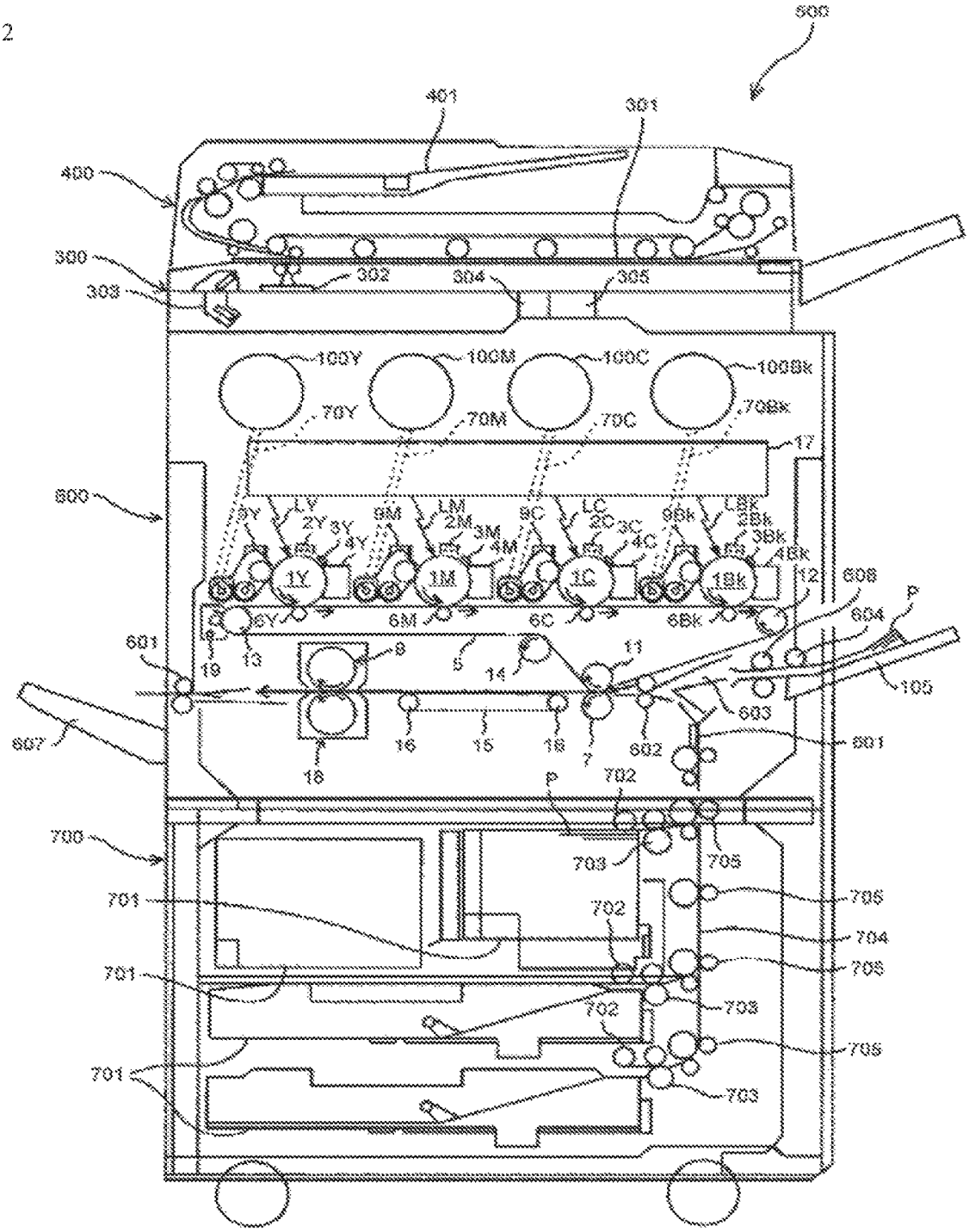
FIG. 2 is a schematic configuration diagram of a copier according to an embodiment.

FIG. 2 is a schematic configuration diagram of a copier 500 as an image forming apparatus to which the present invention is applied. The copier 500 includes a printer 600, a sheet feed table 700 for mounting the printer 600, a scanner 300 fixed on the printer 600, and an automatic document feeder 400 fixed on the scanner 300.

The copier 500 of an embodiment is a so-called tandem-type image forming apparatus, and employs a two-component developing system using two-component developer formed of toner and carrier as a developing system. The copier 500 receives image data that is image information read from the scanner 300 or print data from an external apparatus such as a personal computer, and forms an image on a sheet P that is a recording medium. In the printer 600, as illustrated in FIG. 2, four photoconductor drums 1 (Y, M, C, Bk) as latent image bearers for a plurality of colors of yellow (Y), magenta (M), cyan (C), and black (Bk) are arranged side by side. The photoconductor drums 1 (Y, M, C, Bk) are arranged side by side along a moving direction of an intermediate transfer belt 5 so as to come in contact with the intermediate transfer belt 5. The intermediate transfer belt 5 is in the form of an endless belt and supported by a plurality of rotatable rollers including a driving roller.

Charging devices 2 (Y, M, C, Bk), developing devices 9 (Y, M, C, Bk), photoconductor cleaning devices 4 (Y, M, C, Bk), and neutralizing lamps 3 (Y, M, C, Bk) corresponding to the four colors are arranged around the respective photoconductor drums 1 in the order of processes. An optical writing device 17 is provided above the photoconductor drums 1. Primary-transfer rollers 6 (Y, M, C, Bk) serving as primary-transfer means are provided at positions facing the respective photoconductor drums 1 across the intermediate transfer belt 5.

The intermediate transfer belt 5 is wound around three supporting rollers (11, 12, 13) and a tension roller 14, and is driven to rotate along with rotation of a driving roller 12 that is one of the supporting rollers rotated by a drive source. A belt cleaning device 19 is provided at a position facing the cleaning opposing roller 13 as one of the supporting rollers across the intermediate transfer belt 5, and removes residual toner remaining on the intermediate transfer belt 5 after secondary transfer. The secondary-transfer opposing roller 11 as one of the supporting rollers is arranged opposite to a secondary-transfer roller 7 serving as a secondary-transfer means, and forms a secondary-transfer nip portion between itself and the secondary-transfer roller 7 across the intermediate transfer belt 5.

On the downstream side of the secondary-transfer nip portion in a sheet conveying direction, a sheet conveying belt 15 extending around a supporting roller pair 16 is provided, and conveys the sheet P with a secondarily-transferred toner image to a fixing device 18. The fixing device 18 includes a fixing roller pair 8 configured with a heating roller and a pressurizing roller, and applies heat and pressure at a fixing nip portion to fix an unfixed toner image on the sheet P.

Copy operation by the copier 500 in the embodiment will be described below.

When the copier 500 according to the embodiment forms a full-color image, a document is first set on a document table 401 of the automatic document feeder 400. Alternatively, the automatic document feeder 400 is opened, a document is set on a contact glass 301 of the scanner 300, and the automatic document feeder 400 is closed to press the document.

Subsequently, when a user presses a start switch while the document is set in the automatic document feeder 400, the document is conveyed onto the contact glass 301. Then, the scanner 300 is activated and a first scanning body 302 and a second scanning body 303 starts to run. Accordingly, light emitted from the first scanning body 302 is reflected from the document on the contact glass 301, and the reflected light is further reflected from a mirror of the second scanning body 303 and guided to a read sensor 305 through an imaging forming lens 304. In this way, image information on the document is read.

When the user presses the start switch, a motor is activated to rotate the driving roller 12, so that the intermediate transfer belt 5 rotates. At the same time, a photoconductor driving device rotates the photoconductor drum 1Y for yellow in the direction of an arrow in the figure, and uniformly charges the photoconductor drum 1Y by the charging device 2Y for yellow. Subsequently, the optical writing device 17 emits a light beam Ly for yellow to form a yellow electrostatic latent image on the photoconductor drum 1Y for yellow. The developing device 9Y for yellow develops the yellow electrostatic latent image by using yellow toner in the developer. During the development, a predetermined developing bias is applied to a developing roller, and yellow toner on the developing roller is electrostatically adsorbed onto a portion corresponding to the yellow electrostatic latent image on the photoconductor drum 1Y for yellow.

A yellow toner image formed through the development as described above is conveyed to a primary-transfer position at which the photoconductor drum 1Y for yellow and the intermediate transfer belt 5 come in contact with each other, along with the rotation of the photoconductor drum 1Y for yellow. At the primary-transfer position, the primary-transfer roller 6Y for yellow applies a predetermined bias voltage to the back side of the intermediate transfer belt 5. By a primary-transfer electric field generated through the bias application, the yellow toner image on the photoconductor drum 1Y for yellow is attracted toward the intermediate transfer belt 5 and primarily transferred onto the intermediate transfer belt 5. Similarly, a magenta toner image, a cyan toner image, and a black toner image are primarily transferred so as to be sequentially superimposed on the yellow toner image on the intermediate transfer belt 5.

When the user presses the start switch, a feed roller 702 corresponding to a sheet selected by the user rotates in the sheet feed table 700, and sheets P are fed from one of sheet cassettes 701. The fed sheets P are separated one by one by a separation roller 703, and each sheet P enters a sheet feed path 704 and is conveyed by a conveying roller pair 705 to a sheet feed path 601 provided in the printer 600. The conveyed sheet P is temporarily stopped upon contact with a registration roller pair 602. If a sheet that is not set in any of the sheet cassettes 701 in the sheet feed table 700 is to be used, sheets P are set on a manual feed tray 605, fed by a manual feed roller 604, separated one by one by a manual separation roller 608, and conveyed through a manual feed path 603. Similarly to the above, the sheet P is stopped upon contact with the registration roller pair 602.

A composite toner image that is formed by superimposing a plurality of colors on the intermediate transfer belt 5 is conveyed to a secondary-transfer position facing the secondary-transfer roller 7 along with the rotation of the intermediate transfer belt 5. The registration roller pair 602 starts to rotate to convey the sheet P to the secondary-transfer position in synchronization with a timing at which the composite toner image formed on the intermediate transfer belt 5 as described above is conveyed to the secondary-transfer position. At the secondary-transfer position, the secondary-transfer roller 7 applies a predetermined bias to the back side of the sheet P, and the whole composite toner image on the intermediate transfer belt 5 is secondarily transferred onto the sheet P by a secondary-transfer electric field generated through the bias application and by a contact pressure at the secondary-transfer position. The sheet P with the secondarily-transferred composite toner image is conveyed by the sheet conveying belt 15 to the fixing device 18, and subjected to a fixing process by the fixing roller pair 8 provided in the fixing device 18. The sheet P subjected to the fixing process is discharged and stacked by a discharge roller pair 606 onto a discharge tray 607 provided outside the apparatus.

The belt cleaning device 19 removes non-transferred toner remaining on the intermediate transfer belt 5 after secondary transfer.

A toner replenishing device 70 that is a powder conveying device using a powder conveying pump for conveying toner in a toner container 100 to the developing device 9 will be described below. The toner replenishing devices 70 with the same configurations replenish the developing devices 9 (Y, M, C, Bk) with toner of the respective colors; therefore, in the following descriptions, the reference signs Y, M, C, and Bk representing the colors will be omitted.

Figure 3:
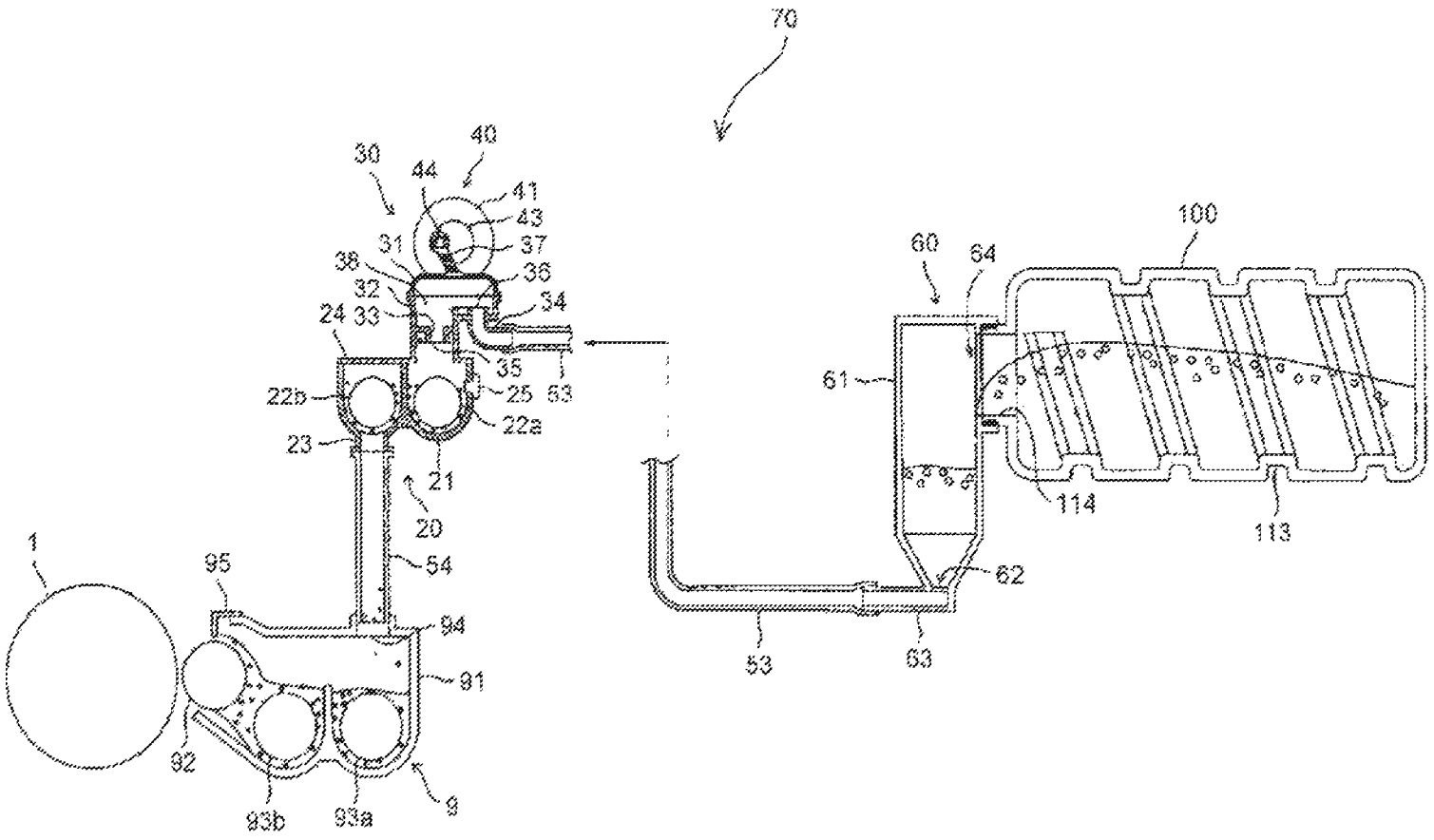
FIG. 3 is a schematic configuration diagram of a developing device and a toner replenishing device according to the embodiment.

FIG. 3 is a schematic diagram illustrating the developing device 9 and the toner replenishing device 70.

As illustrated in FIG. 3, the toner replenishing device 70 includes a sub hopper 20 for temporarily storing supplement that is powder for supplying toner to the developing device 9, and includes a toner duct 54 as a supply path for connecting the sub hopper 20 and the developing device 9 to convey the supplement. The supplement supplied by the toner replenishing device 70 of the embodiment is a mixture of toner and carrier.

A diaphragm pump 30 that is a positive displacement powder conveying pump is provided in the upper part of the sub hopper 20. A tube 53, which connects the diaphragm pump 30 and a toner storage 60 and through which the supplement sucked with air by the diaphragm pump 30 passes, is also provided. It is preferable to use a flexible rubber material with excellent toner resistance, such as polyurethane, nitrile, silicone rubber, or EPDM, as a material of the tube 53.

The toner storage 60 mainly includes a container 61 for temporarily storing and accommodating the supplement, and includes the toner container 100 as a supplement container detachably attached to the printer 600 to supply the supplement to the container 61.

In the lower part of the container 61, a tube connector 63 for connecting the tube 53 in a fitted manner is provided, and a communicating opening 62 for connecting the tube connector 63 and the container 61 is also provided. On one side surface of the container 61, a feed port 64 is provided to receive the supplement from the toner container 100.

The toner container 100 has a cylindrical cross-section to store supplement, and is driven to rotate by a drive source about the center line of the cylindrical cross-section as a rotation axis. A side wall of one end of the toner container 100 perpendicular to the rotation axis of the rotation is sealed, and a discharge port 114 is provided in a protruding manner on a side wall of the other end. In a cylindrical portion having the cylindrical cross-section, a spiral-shaped conveying groove 113 is provided so as to protrude inward and conveys the stored supplement from the sealed side wall to the side wall with the discharge port 114 along with the rotation of the toner container 100. The supplement conveyed to the side wall with the discharge port 114 is supplied to the container 61 from the feed port 64 provided in the container 61.

The supplement supplied to the container 61 is sucked and introduced with air by the diaphragm pump 30 into an operation chamber 38 that is an internal space from the toner storage 60 (the container 61) that is a conveying source of the supplement through the tube 53. Subsequently, the supplement is discharged to the sub hopper 20 that is a conveying destination connected to the lower part, so that the supplement is conveyed from the toner storage 60 to the sub hopper 20. The supplement conveyed to the sub hopper 20 is supplied to the developing device 9 by a conveying means provided in the sub hopper 20.

The diaphragm pump 30 includes a diaphragm 31 as a variable member, a case 32, an inlet valve 36, an outlet valve 35, and the like. The diaphragm is operated by rotational motion of an eccentric shaft 44 held by a holder 43 directly connected to a motor 41 of a driving unit 40.

The developing device 9, which is a replenishment destination to be replenished with supplement by the toner replenishing device 70 and which employs the two-component developing system, includes a toner developing roller 92 that bears and conveys developer formed of toner and carrier to a development area facing the photoconductor drum 1. A developer case 91 of the developing device 9 stores therein the developer, includes a stirring/conveying unit provided with a first stirring/conveying screw 93*a*, and includes a supply/collection unit provided with a second stirring/conveying screw 93*b* to supply and collect the developer to and from the developing roller 92. On a partition member that partitions the stirring/conveying unit and the supply/collection unit, communicating portions are provided at both end portions of the two stirring/conveying screws 93*a* and 93*b* in the axial direction, and the stored developer circulates between the stirring/conveying unit and the supply/collection unit by being conveyed by the stirring/conveying screws 93*a* and 93*b*. The supply/collection unit supplies the stored developer to the developing roller 92 and collects developer that is not used for development.

The developing roller 92 is a roller that holds the developer stirred in the supply/collection unit on the roller surface by a magnetic force, bears and conveys the developer to the development area facing the photoconductor drum 1, and develops the electrostatic latent image on the photoconductor drum 1 to form a toner image. A doctor blade 95 that regulates the thickness of a layer of the developer borne and conveyed by the developing roller 92 from the supply/collection unit to the development area is provided on the upper end portion of an opening that is provided in the developer case 91 to expose the developing roller 92 (on the downstream side in the rotation direction of the developing roller 92).

The sub hopper 20 for temporarily storing the supplement is provided above the stirring/conveying unit provided with the first stirring/conveying screw 93*a* of the developing device 9. The supplement discharged from the sub hopper 20 freely falls inside the toner duct 54 and is supplied to the stirring/conveying unit of the developing device 9. A toner density sensor is installed in the developing device 9. When the toner in the developing device 9 is consumed, the toner density sensor detects a reduction in the toner density, and supplement containing the same amount of toner as the amount of consumed toner is supplied from the sub hopper 20 to maintain the toner density constant in the developing device 9.

The supplement stored in the toner container 100 is a mixture of toner and carrier as described above. When the supplement is supplied to the developing device 9, additive particle added to the toner and the carrier are also introduced in the developing device 9 with the toner. The carrier is not consumed in the developing unit, and the amount of the carrier continuously increases. However, if the amount of the carrier reaches a certain level, the carrier overflows and is discharged from a discharge port.

The developer represents toner, carrier, or other types of powder (additive particle or the like) used for development. The developer may be a mixture of the above described powder.

Toner replenishing operation will be described below.

The sub hopper 20 includes, in a hopper case 21, an upstream conveying tank for receiving supplement discharged with air from the diaphragm pump 30, and a downstream conveying tank connected to the toner duct 54. An upstream conveying screw 22*a* as a conveying means is provided in the upstream conveying tank. A downstream conveying screw 22*b* as a conveying means is provided in the downstream conveying tank. A certain amount of supplement is supplied from the downstream conveying tank to the developing device 9 through the toner duct 54 connected to an opening provided in a toner discharge port 23, along with the rotation of each of the conveying screws 22*a* and 22*b* based on the toner density detected by the toner density sensor of the developing device 9.

On a side wall of the hopper case 21 where the upstream conveying tank is provided in the sub hopper 20, a toner end sensor 25 is provided to detect the amount of supplement in the upstream conveying tank. The toner end sensor 25 is a piezoelectric level sensor, and detects absence of the supplement when the powder level of the supplement in the hopper is reduced due to consumption of toner. As the supplement in the sub hopper 20 is consumed, the toner end sensor 25 detects the consumption, and the diaphragm pump 30 connected to the upper part of the upstream conveying tank is operated to convey and supply the supplement from the container 61 of the toner storage 60 to the sub hopper 20. Then, the toner container 100 is rotated and the supplement is accommodated in the container 61 again.

First Embodiment

A first mode of the toner container 100 to which the present invention is applied (hereinafter, referred to as a "first embodiment") will be described below.

Figure 4:
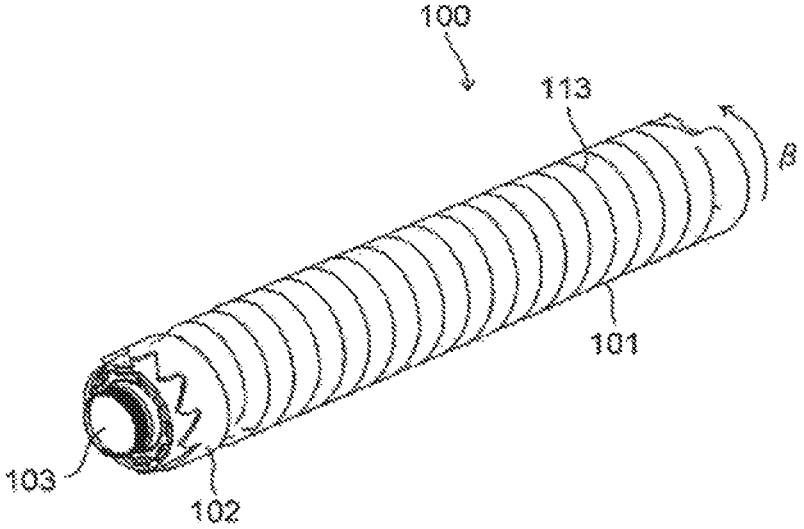
FIG. 4 is an explanatory perspective view of the toner container of the first embodiment when viewed from a front side in the insertion direction.
Figure 5:
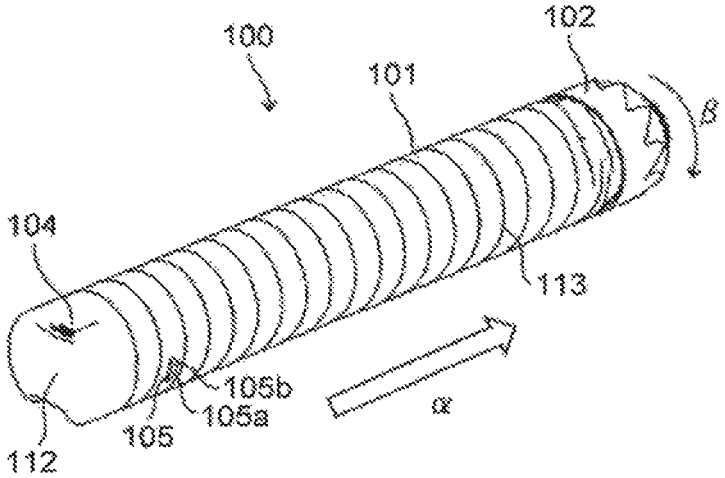
FIG. 5 is an explanatory perspective view of the toner container of the first embodiment when viewed from a rear side in the insertion direction.

FIG. 4 is an explanatory perspective view of the toner container 100 of the first embodiment when viewed from a front side in the insertion direction (downstream side in the insertion direction). FIG. 5 is an explanatory perspective view of the toner container 100 of the first embodiment when viewed from a rear side in the insertion direction (upstream side in the insertion direction). The direction of an arrow α in FIG. 5 is the insertion direction of the toner container 100.

The toner container 100 includes a container body 101 and a cap (cover) 102. The container body 101 stores therein toner. The container body 101 has a cylindrical shape. One end of the cylindrical shape serves as a bottom portion 112 and is sealed. On the other end of the cylindrical shape of the container body 101, an opening serving as the discharge port 114 for discharging the stored toner is provided, which will be described later.

The cap 102 covers the outer circumference of a front end of the other end side of the container body 101. An outer cap 103 is attached to the toner container 100 when the toner container 100 is not used, such as when the toner container 100 is transported or stored, and covers the discharge port 114 from which the toner in the container body 101 is discharged. The container body 101 is provided with the conveying groove 113 serving as a conveying means for conveying the stored toner. The container body 101 is rotated in a direction β in the figure by the configuration to be described later, and the toner is conveyed from the bottom portion 112 side to the discharge port 114 side by the conveying groove 113. At this time, the cap 102 rotates with the container body 101.

As indicated by the arrow α in FIG. 5, the toner container 100 is inserted in the main body of the image forming apparatus, with the cap 102 side at the leading end.

Hereinafter, the cap 102 side (other end side) of the toner container 100 is referred to as a downstream side in the insertion direction, and the bottom portion 112 side (one end side) opposite to the cap 102 side in the longitudinal direction is referred to as an upstream side in the insertion direction. With the rotation of the toner container 100, the toner in the container body 101 is conveyed from the upstream side to the downstream side in the insertion direction.

An upstream side in a toner conveying direction is the upstream side in the insertion direction, and a downstream side in the toner conveying direction is the downstream side in the insertion direction. A direction perpendicular to the center line of the cylindrical container body 101 is referred to as a radial direction. A direction toward the center line in the radial direction is referred to as a central direction, and a direction toward the outer periphery of the container body 101 is referred to as an outer peripheral direction.

The container body 101 is provided with a grip portion 104 on an upstream end in the insertion direction in which the toner container 100 is inserted in the main body of the image forming apparatus. The grip portion 104 is a recess provided on an end portion of the container body 101. The grip portion 104 is recessed from the outer circumference of the container body 101 in the central direction. The grip portion 104 has two recesses that are disposed at opposite positions in the radial direction of the cylindrical container body 101.

A container-body protrusion 105 protruding in the outer peripheral direction is provided on an outer peripheral portion of the container body 101. The container-body protrusion 105 is a cone-shaped protrusion, where a part of the periphery of the one end side of the container body 101 protrudes in the outer peripheral direction. The container-body protrusion 105 includes a first inclined surface 105*a*, which is inclined such that the protrusion amount increases from the downstream side to the upstream side in the rotation direction of the container body 101, and a second inclined surface 105*b*, which is inclined such that the protrusion amount decreases from the downstream side to the upstream side in the rotation direction. Of the two inclined surfaces of the container-body protrusion 105, the first inclined surface 105*a* located on the downstream side in the rotation direction has a smaller inclined angle than the inclined angle of the second inclined surface 105*b*.

Functions of the container-body protrusion 105 will be described below.

When the container body 101 rotates in the main body of the image forming apparatus, the container body 101 rotates while the outer periphery thereof slides against a setting surface in the main body of the image forming apparatus. In this case, when the container-body protrusion 105 reaches the setting surface, the container body 101 is lifted up from the setting surface by the container-body protrusion 105. In this state, when the container-body protrusion 105 is separated from the setting surface, the container body 101 rapidly moves downward. With this motion, the toner in the container body 101 is shaken, so that aggregation of the toner can be prevented. As described above, the inclined angle of the second inclined surface 105*b*, which is inclined such that the protrusion amount of the container-body protrusion 105 decreases from the downstream side to the upstream side in the rotation direction of the container body 101, is steeper than that of the first inclined surface 105*a*.

In the relationship between the inclined angles as described above, the container body 101 is gradually lifted up by the contact of the first inclined surface 105*a* with the setting surface, and when the second inclined surface 105*b* reaches the setting surface, the container body 101 rapidly moves downward. Therefore, it is possible to cause the container body 101 to rapidly move downward along with the rotation.

Figure 6:
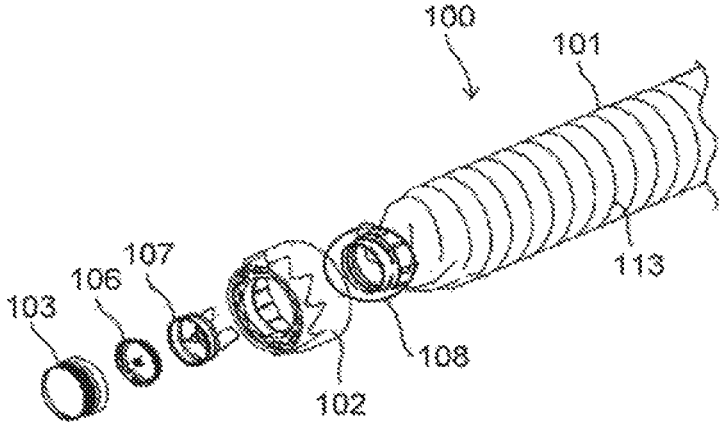
FIG. 6 is an exploded perspective view of the toner container of the first embodiment.

FIG. 6 is an exploded perspective view of the toner container 100 of the first embodiment. As illustrated in FIG. 6, a discharging member 107, an inner cap (plug) 106, and the outer cap 103 are attached to the container body 101, in addition to the cap 102.

Figure 7:
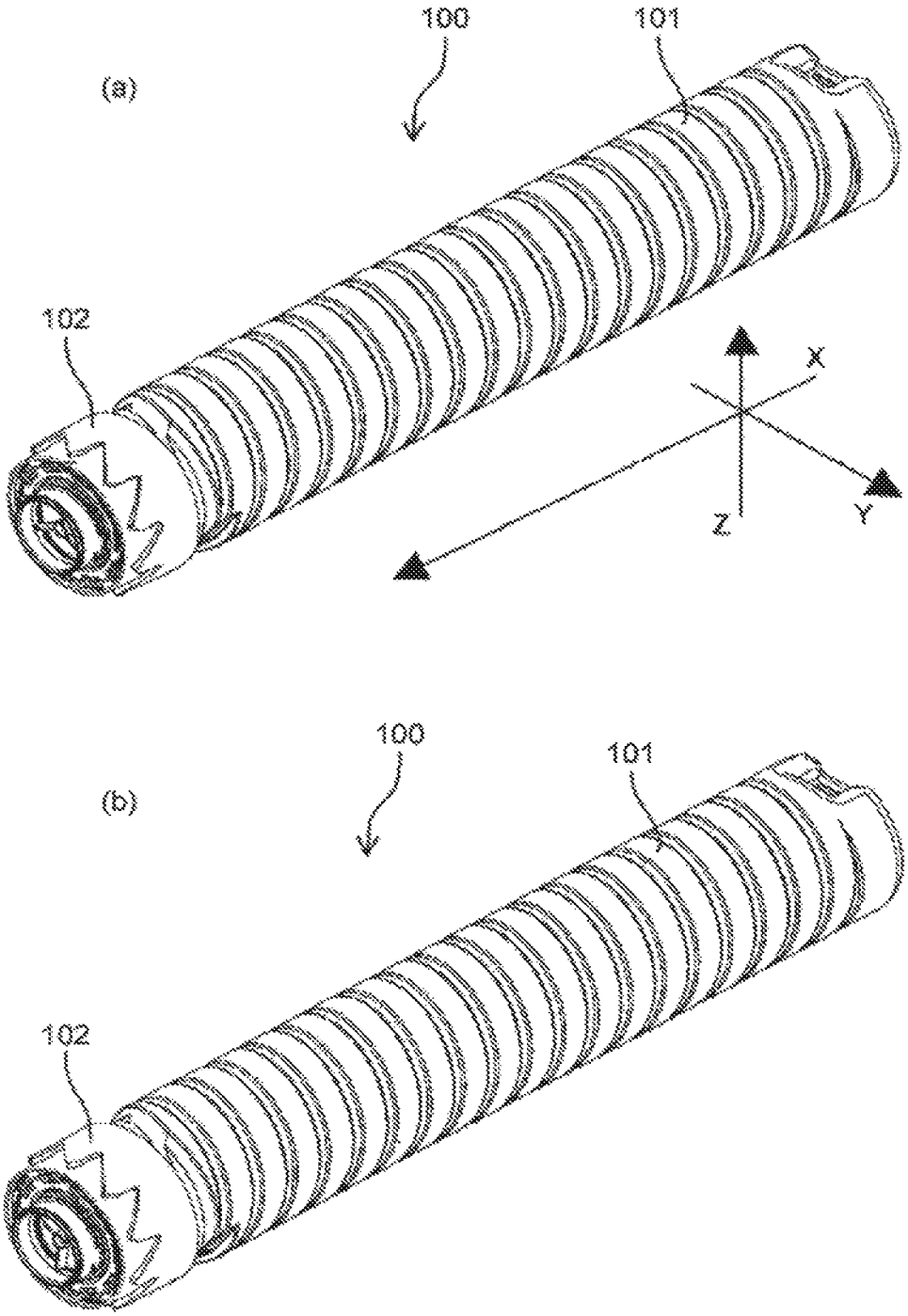
FIG. 7 illustrates the toner container of the first embodiment: (a) is an explanatory perspective view of the toner container, when viewed from the positive X side; and (b) is an explanatory perspective view of the toner container, when rotated by 180 degrees about a rotation axis from the state illustrated in (a).

FIG. 7 illustrates the toner container 100 of the first embodiment when the outer cap 103 is detached in the state illustrated in FIG. 4. In FIG. 7, orientations of the toner container 100 are represented by XYZ axes such that the downstream side of the toner container 100 in the insertion direction is the positive X side, the front side of the toner container 100 in a direction perpendicular to the X axis in the sheet of the figure is the positive Y side, and the upper side in the sheet of the figure is the positive Z side.

In FIG. 7, (a) is a perspective view of the toner container 100 of the first embodiment, when viewed from the positive X side; and (b) is a perspective view of the toner container 100 of the first embodiment, when rotated by 180 degrees about a rotation axis from the state illustrated in (a).

Figure 8:
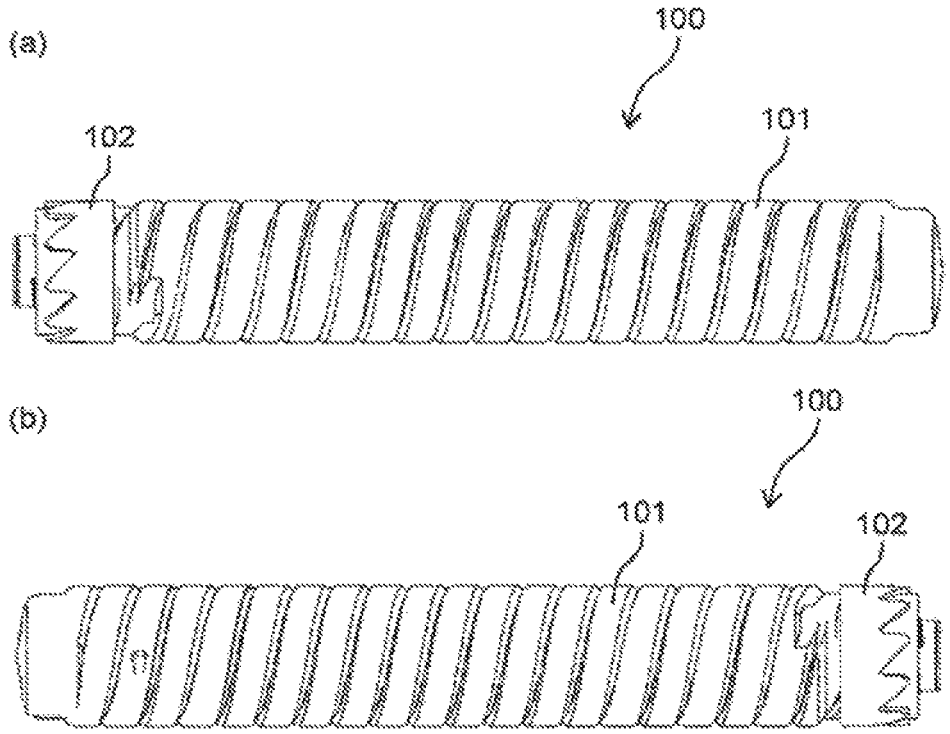
FIG. 8 illustrates the toner container of the first embodiment: (a) is a side view of the toner container, when viewed from the positive Y side; and (b) is a side view of the toner container, when viewed from the negative Y side.

FIG. 8 illustrates the toner container 100 of the first embodiment. In FIG. 8, (a) is a side view of the toner container 100 of the first embodiment, when viewed from the positive Y side; and (b) is a side view of the toner container 100 of the first embodiment, when viewed from the negative Y side.

Figure 9:
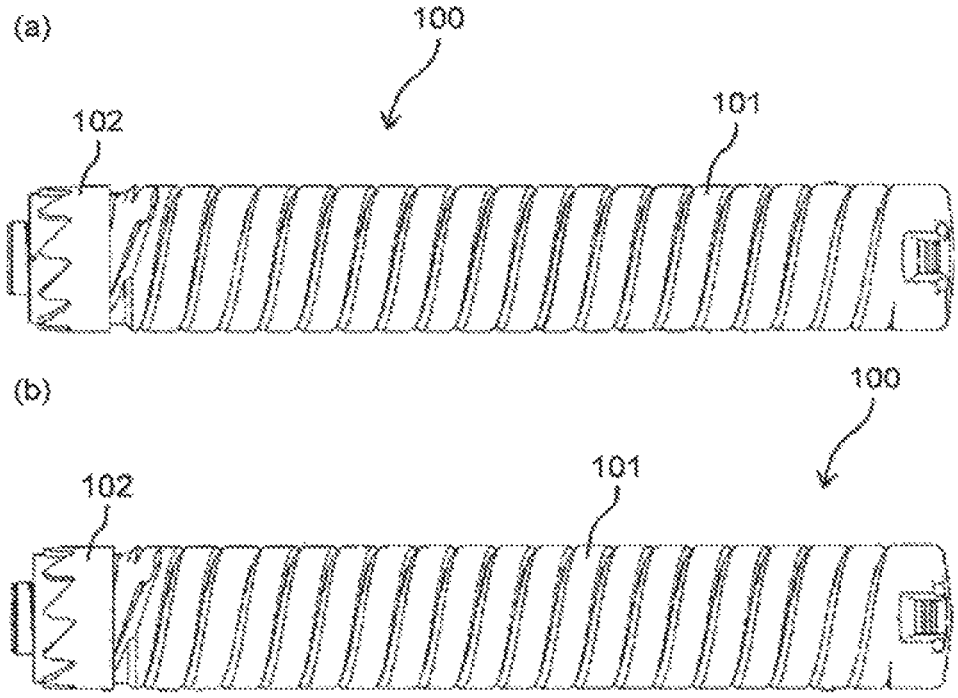
FIG. 9 illustrates the toner container of the first embodiment: (a) is a plan view of the toner container, when viewed from the positive Z side; and (b) is a bottom view of the toner container, when viewed from the negative Z side.

FIG. 9 illustrates the toner container 100 of the first embodiment. In FIG. 9, (a) is a plan view of the toner container 100 of the first embodiment, when viewed from the positive Z side; and (b) is a bottom view of the toner container 100 of the first embodiment, when viewed from the negative Z side.

Figure 10:
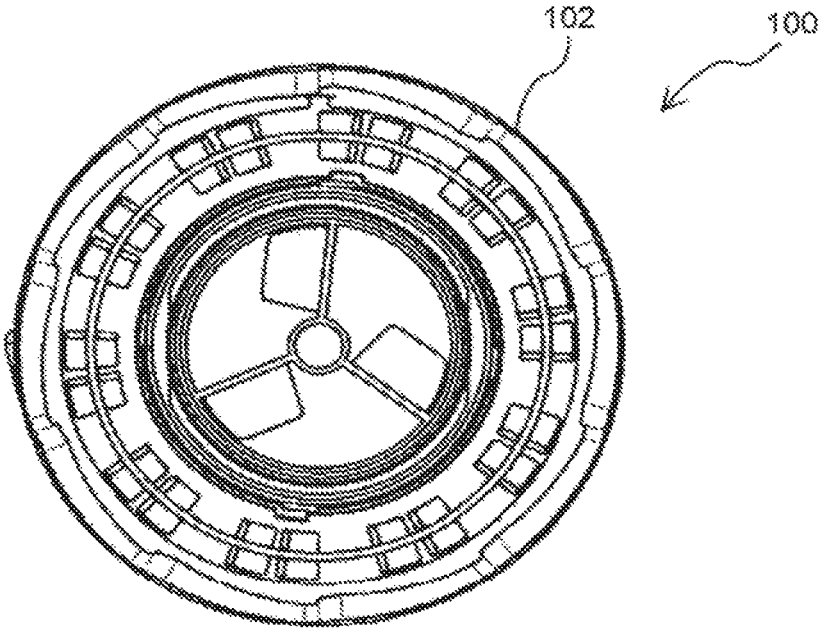
FIG. 10 illustrates the toner container of the first embodiment: (a) is a front view of the toner container, when viewed from the positive X side; and (b) is a back view of the toner container, when viewed from the negative X side.
Figure 10:
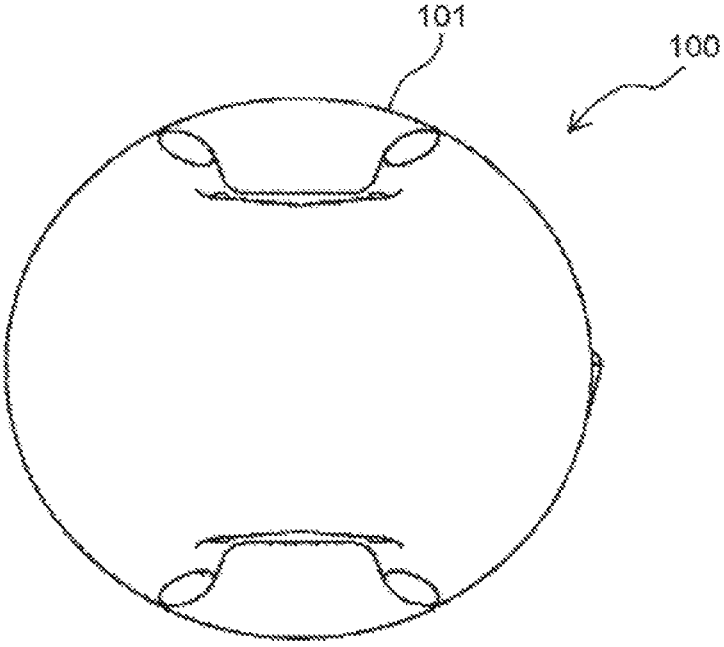

FIG. 10 illustrates the toner container 100 of the first embodiment. In FIG. 10, (a) is a front view of the toner container 100 of the first embodiment, when viewed from the positive X side; and (b) is a back view of the toner container 100 of the first embodiment, when viewed from the negative X side.

Figure 1:
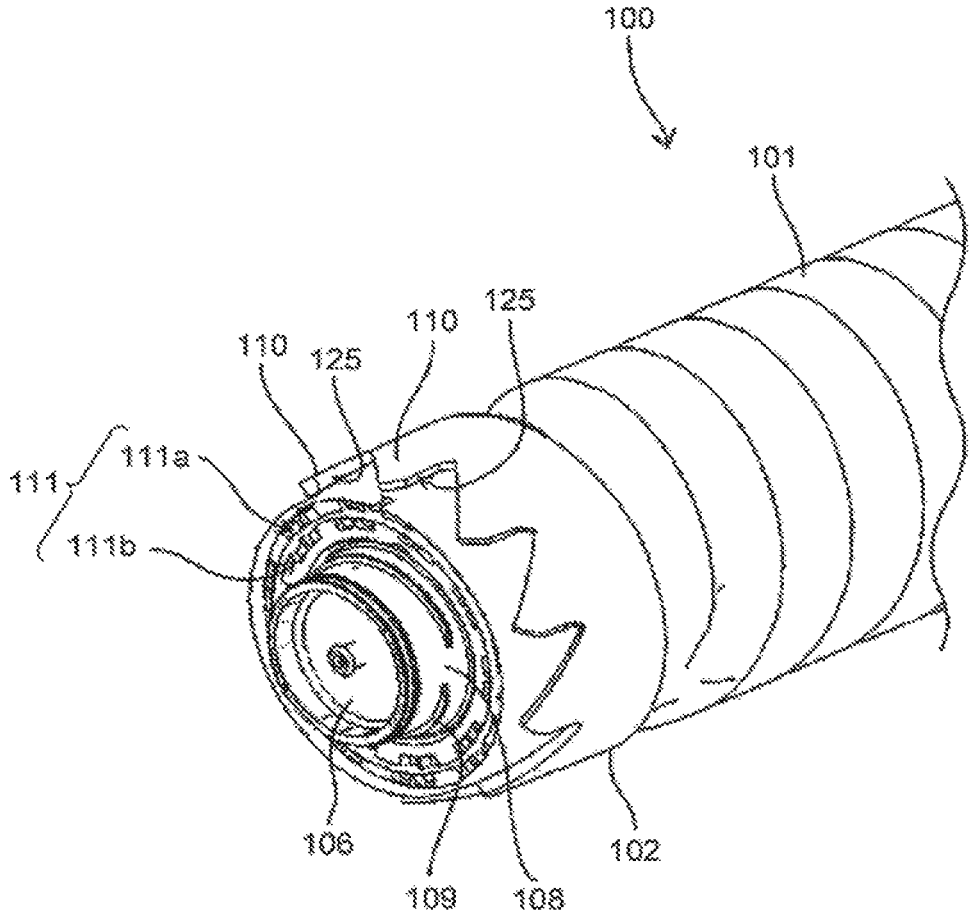
FIG. 1 is an enlarged perspective view of the vicinity of a downstream end of a toner container in an insertion direction according to a first embodiment, when an outer cap is detached in the state illustrated in FIG. 4.
Figure 11:
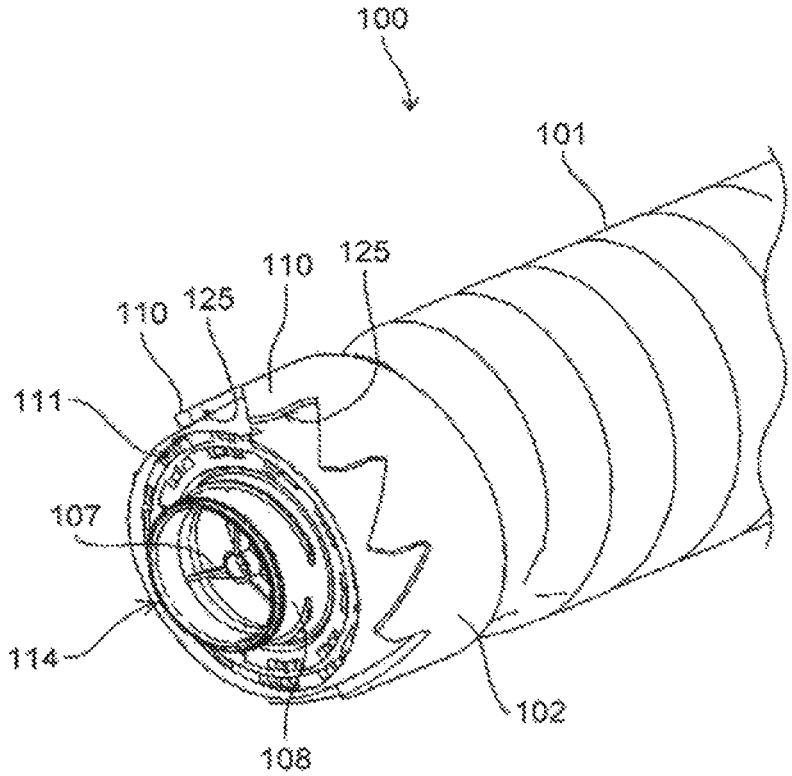
FIG. 11 is an enlarged perspective view of the vicinity of the downstream end of the toner container of the first embodiment in the insertion direction, when an inner cap is detached in the state illustrated in FIG. 1.
Figure 12:
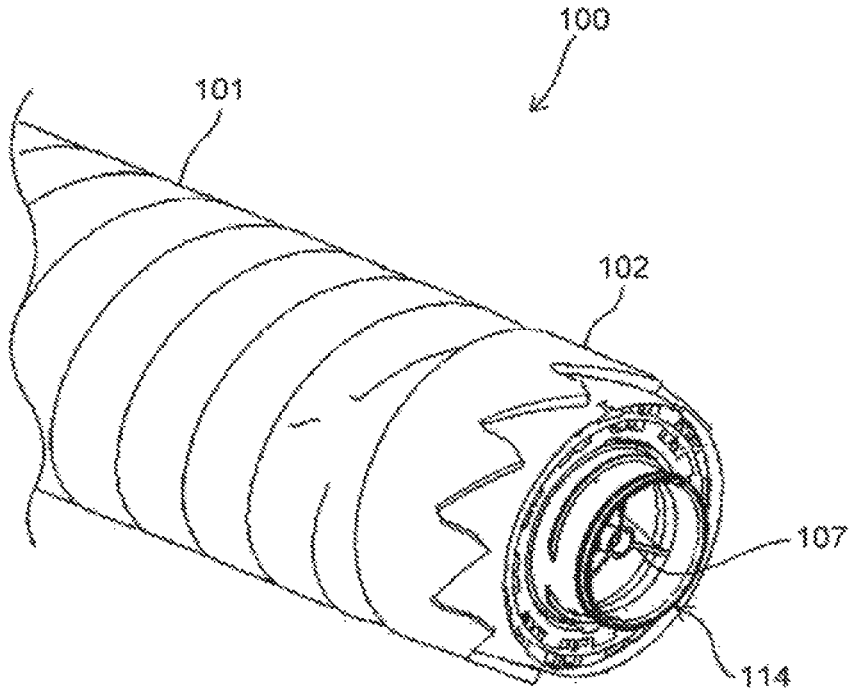
FIG. 12 is an enlarged perspective view of the vicinity of the downstream end of the toner container of the first embodiment in the insertion direction when viewed from the different angle from that in FIG. 11.

FIG. 1 is an enlarged perspective view of the vicinity of the downstream end of the toner container 100 of the first embodiment in the insertion direction when the outer cap 103 is detached in the state illustrated in FIG. 4. FIG. 11 is an enlarged perspective view of the vicinity of the downstream end of the toner container 100 of the first embodiment in the insertion direction when the inner cap 106 is detached from the state illustrated in FIG. 1. FIG. 12 is an enlarged perspective view of the vicinity of the downstream end of the toner container 100 of the first embodiment in the insertion direction when viewed from a different angle from that in FIG. 11.

The container body 101 is provided with an opening portion 108 that protrudes toward the downstream side in the insertion direction. A front end of the opening portion 108 serves as the discharge port 114 for discharging the internally-stored toner.

As illustrated in FIG. 11, the opening portion 108 has a cylindrical shape, and the discharging member 107 is fitted to the inner side (inner wall surface) of the opening portion 108. As illustrated in FIG. 1, the inner cap 106 that covers the discharge port 114 is fitted to the opening portion 108 before use.

As illustrated in FIG. 4, the outer cap 103 is a screw cap detachably attached so as to cover the discharge port 114. As illustrated in FIG. 1, an outer cap stopper 109 protruding in a spiral manner along the outer circumference of the opening portion 108 is provided along the outer circumference such that the outer cap 103 functions as the screw cap. A spiral groove cut in the inner circumference of the outer cap 103 and the outer cap stopper 109 are fitted, so that the outer cap 103 is attached to the opening portion 108.

As illustrated in FIG. 6, the cap 102 is provided with an opening in the center in the radial direction such that the opening portion 108 of the container body 101 protrudes from the opening as illustrated in FIGS. 1, 6, 11, and 12. Driven portions 110 are provided on the outer circumference of the cap 102. Identifier opening groups 111, which serves as identifier portions and configured as a combination of a plurality of identifier openings (openings or recesses), are provided on the end surface on the downstream side in the insertion direction. The identifier opening group 111 includes an outer identifier opening group 111*a* as an outer opening group and an inner identifier opening group 111*b* as an inner opening group. Identifier indicates a configuration for identification to prevent the toner container 100 from erroneously inserted depending on differences in colors of the stored toner, differences in characteristics of the stored toner, or differences in models of the main body of the image forming apparatus, for example.

Figure 13:
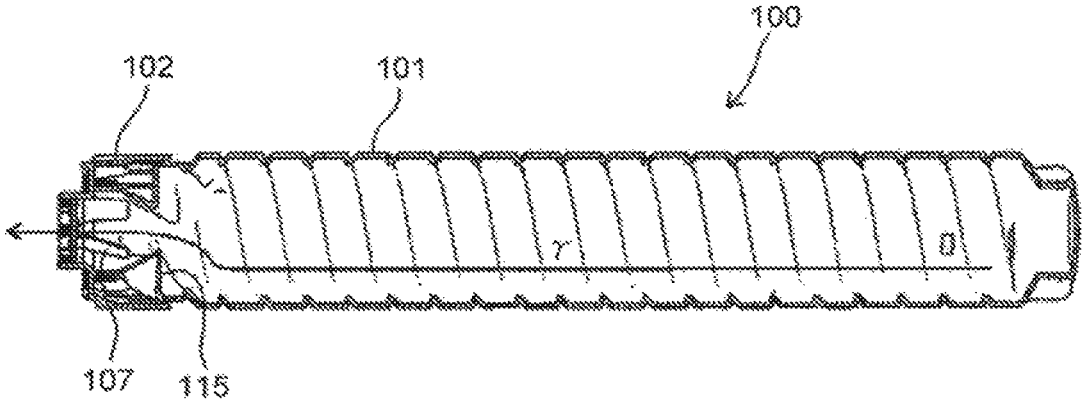
FIG. 13 illustrates a lateral cross-section passing through the center line of a cylindrical shape of the toner container of first embodiment.

FIG. 13 illustrates a lateral cross-section passing through the center line of the cylindrical shape of the toner container 100 of the first embodiment. An arrow γ in FIG. 13 schematically indicates the flow of the toner stored in the container body 101.

As illustrated in FIG. 13, container-side scooping portions 115 are provided in the vicinity of the opening portion 108 of the container body 101 such that the outer circumference extends inward in the radial direction. The container-side scooping portions 115 lift toner, which is conveyed to the container-side scooping portions 115 along with the rotation, from the lower side to the upper side, and send the lifted toner to the discharging member 107 to convey the toner to the discharge port 114.

Figure 14:
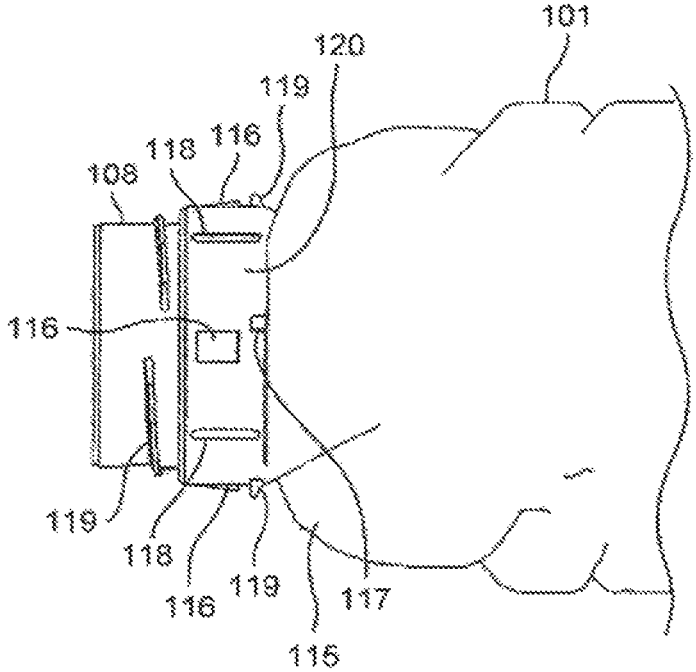
FIG. 14 is an enlarged side view of the vicinity of the downstream end of only a container body in the insertion direction when a cap is detached from the toner container of the first embodiment.
Figure 15:
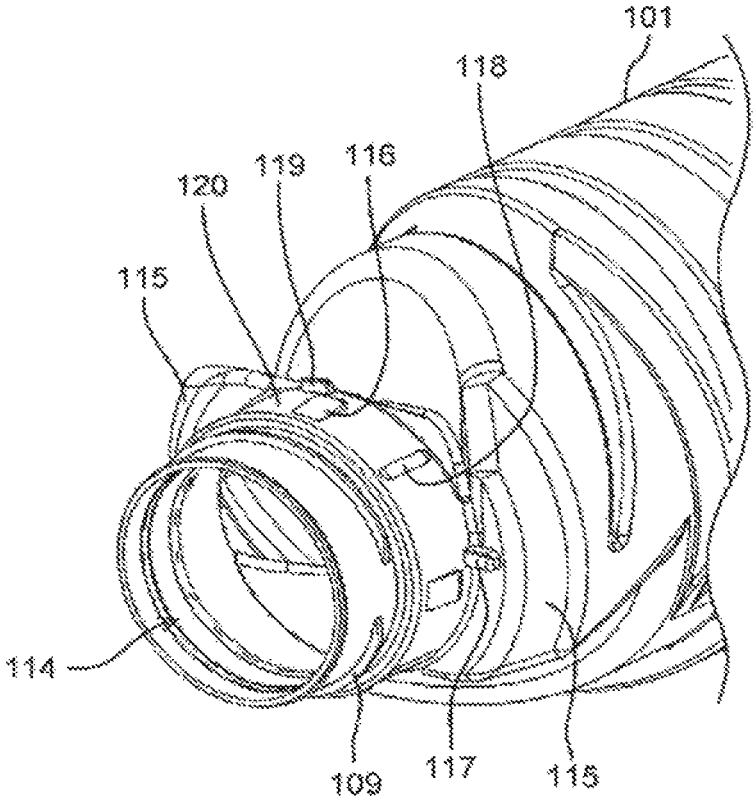
FIG. 15 is an enlarged perspective view of the vicinity of the downstream end of only the toner container of the first embodiment in the insertion direction.

FIG. 14 is an enlarged side view of the vicinity of the downstream end of only the container body 101 in the insertion direction when the cap 102 is detached from the toner container 100 of the first embodiment. FIG. 15 is an enlarged perspective view of the vicinity of the downstream end of only the container body 101 of the first embodiment in the insertion direction.

A cylindrical opening base portion 120 is provided between the opening portion 108 of the container body 101 and the container-side scooping portions 115. On the outer periphery of the opening base portion 120, stopper protrusions 116, circumference defining protrusions 118, axial restrictor protrusions 119, and circumferential restrictor protrusions 117 are provided.

The stopper protrusion 116 includes an inclined surface that is inclined upward from the downstream side to the upstream side in the insertion direction of the opening base portion 120, and a vertical surface extending inward in the radial direction on the upstream side in the insertion direction. The circumference defining protrusion 118 is a protrusion extending in the insertion direction, and has a constant height (protrusion amount). The axial restrictor protrusion 119 has a surface that vertically stands on the downstream side in the insertion direction with a gap interposed between itself and the upstream end of the stopper protrusion 116 in the insertion direction (the gap is a space where a stopper rib of the cap 102 is inserted), and has a slope extending from the surface such that the protrusion amount decreases toward the upstream side in the insertion direction. The circumferential restrictor protrusion 117 is a protrusion that has a surface on the same plane as the vertically-standing surface of the axial restrictor protrusion 119, and protrudes (extends) outward in the radial direction so as to be higher than the axial restrictor protrusion 119.

Figure 16:
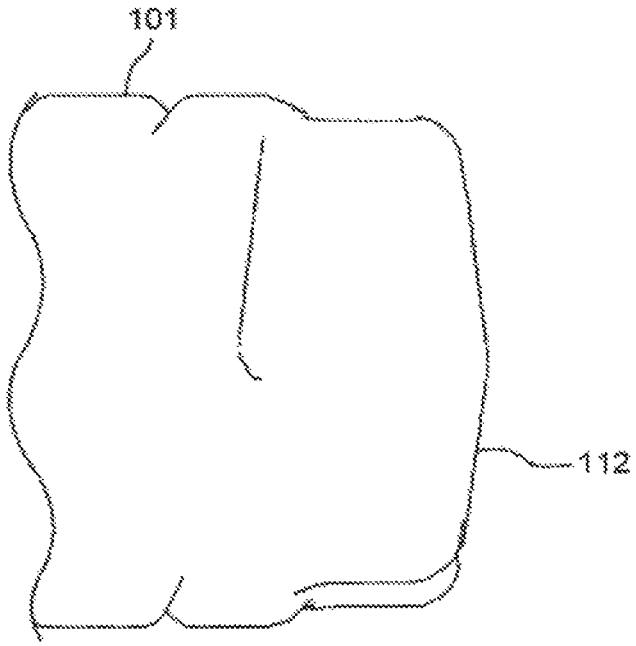
FIG. 16 is an enlarged side view of the vicinity of an upstream end of the toner container of the first embodiment in the insertion direction.

FIG. 16 is an enlarged side view of the vicinity of the upstream end of the container body 101 of the first embodiment in the insertion direction.

The grip portion 104 is provided on one end side (an upstream end surface in the insertion direction) of the container body 101. As illustrated in FIG. 12, the bottom portion 112 serving as the end surface has an anchor shape such that a portion serving as the center line of the cylindrical shape is increased in height (protrudes toward the upstream side in the insertion direction). Therefore, a toner aggregation preventing slope is provided on the bottom portion 112. In this configuration, even if the toner container 100 is placed in a standing manner with the one end side face down, the toner container 100 cannot stand still, but falls down. Therefore, it is possible to prevent the toner container 100 from being left standing with the one end side face down. Consequently, it is possible to prevent the toner in the container body 101 from being aggregated and adhered on the one end side due to the weight of the toner.

The cap 102 will be described below.

Figure 17:
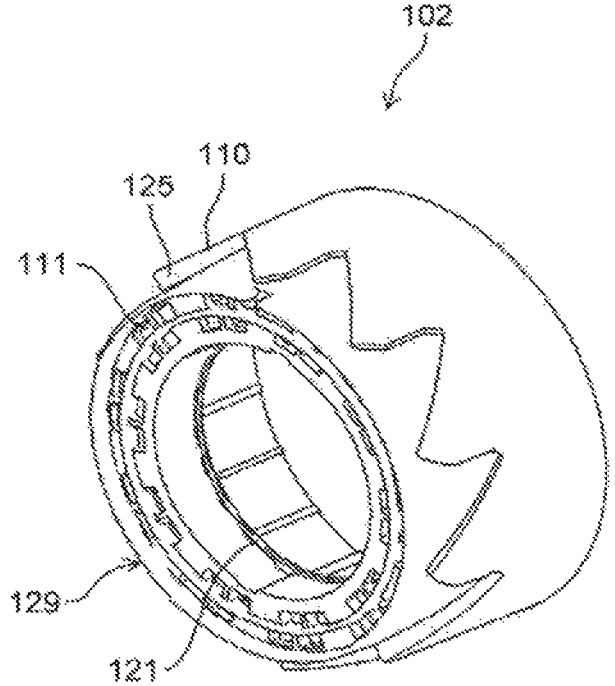
FIG. 17 is a perspective view of the cap of the first embodiment when viewed from other end side (downstream side in the insertion direction).
Figure 18:
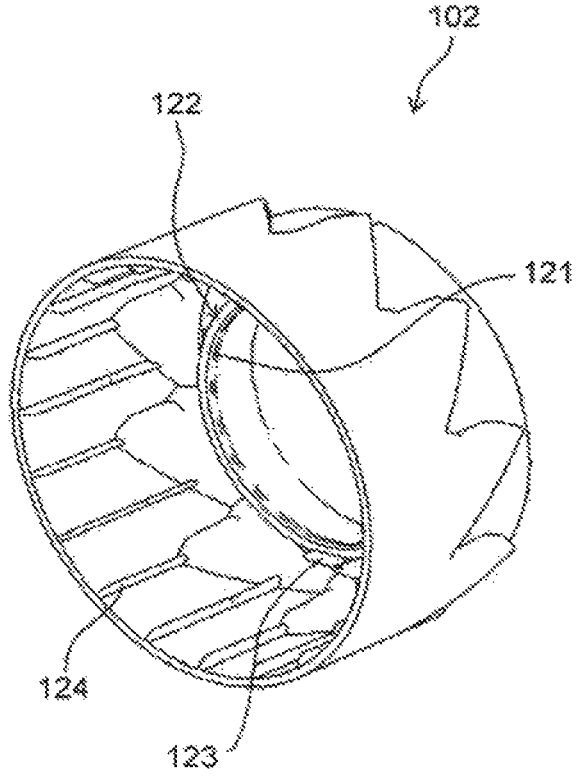
FIG. 18 is a perspective view of the cap of the first embodiment when viewed from one end side (upstream side in the insertion direction).
Figure 19:
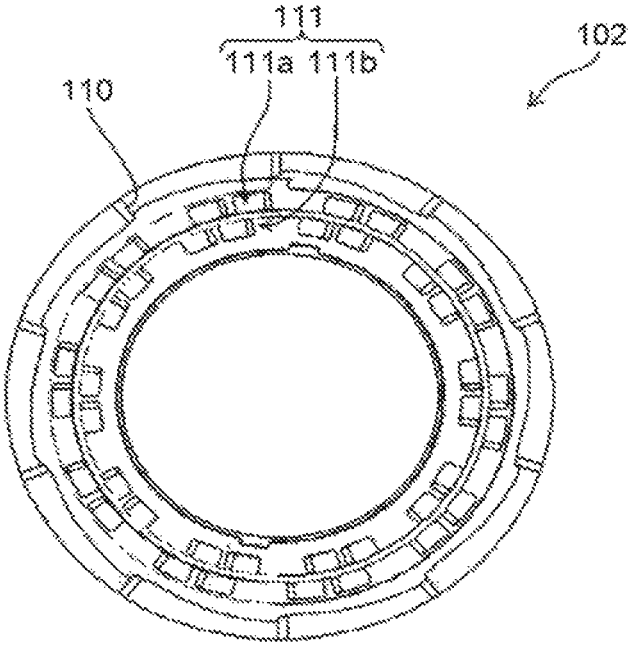
FIG. 19 is a front view of the cap of the first embodiment when viewed from the other end side (downstream side in the insertion direction).

FIG. 17 is a perspective view of the cap 102 of the first embodiment when viewed from the other end side (downstream side in the insertion direction). FIG. 18 is a perspective view of the cap 102 of the first embodiment when viewed from the one end side (upstream side in the insertion direction). FIG. 19 is a front view of the cap 102 of the first embodiment when viewed from the other end side (downstream side in the insertion direction).

The cap 102 has a cylindrical shape, and is provided with the opening in the center thereof through which the opening portion 108 of the container body protrudes. On the inner periphery of the opening of the cap 102, a stopper rib 121 is provided so as to protrude toward the center along the entire circumference. The upstream side of the stopper rib 121 in the insertion direction serves as an axial contact surface 122. Circumferential restrictor contact protrusions 123 protruding toward the upstream side in the insertion direction are provided on a part of the axial contact surface 122 of the stopper rib 121.

A plurality of stuffing protrusions 124 extending in the insertion direction are provided at predetermined intervals on the inner periphery of the cylindrical cap 102.

The driven portions 110 each having a drive transmitted surface (drive transmitted part) 125 are provided on the outer periphery of the cap 102.

Figure 20:
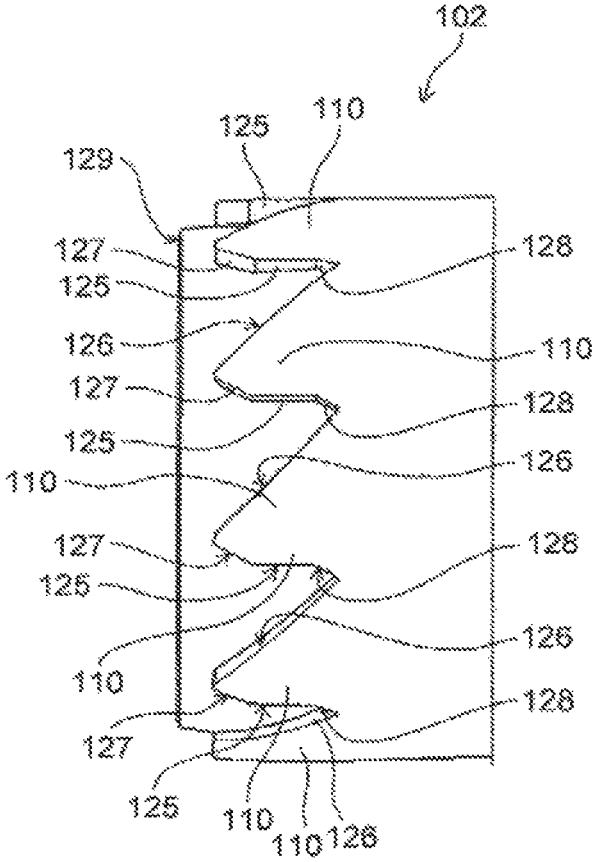
FIG. 20 is a side view of the cap of the first embodiment.

FIG. 20 is a side view of the cap 102 of the first embodiment.

The drive transmitted surface 125 is a wall surface standing outward from the outer circumference of the cap 102 in the radial direction.

On the outer circumference of the cap 102, wall surfaces including a first guiding inclined surface 126 serving as a first container inclined surface, a second guiding inclined surface 127 serving as a second container inclined surface, and a rear-side inclined surface 128 are provided in a standing manner, in addition to the drive transmitted surface 125. The driven portion 110 is configured as a set of the drive transmitted surface 125, the first guiding inclined surface 126, the second guiding inclined surface 127, and the rear-side inclined surface 128. A plurality of the driven portions 110 as a plurality of sets are continuously arranged side by side in the circumferential direction.

One of the driven portions 110 will be described below.

Figure 21:
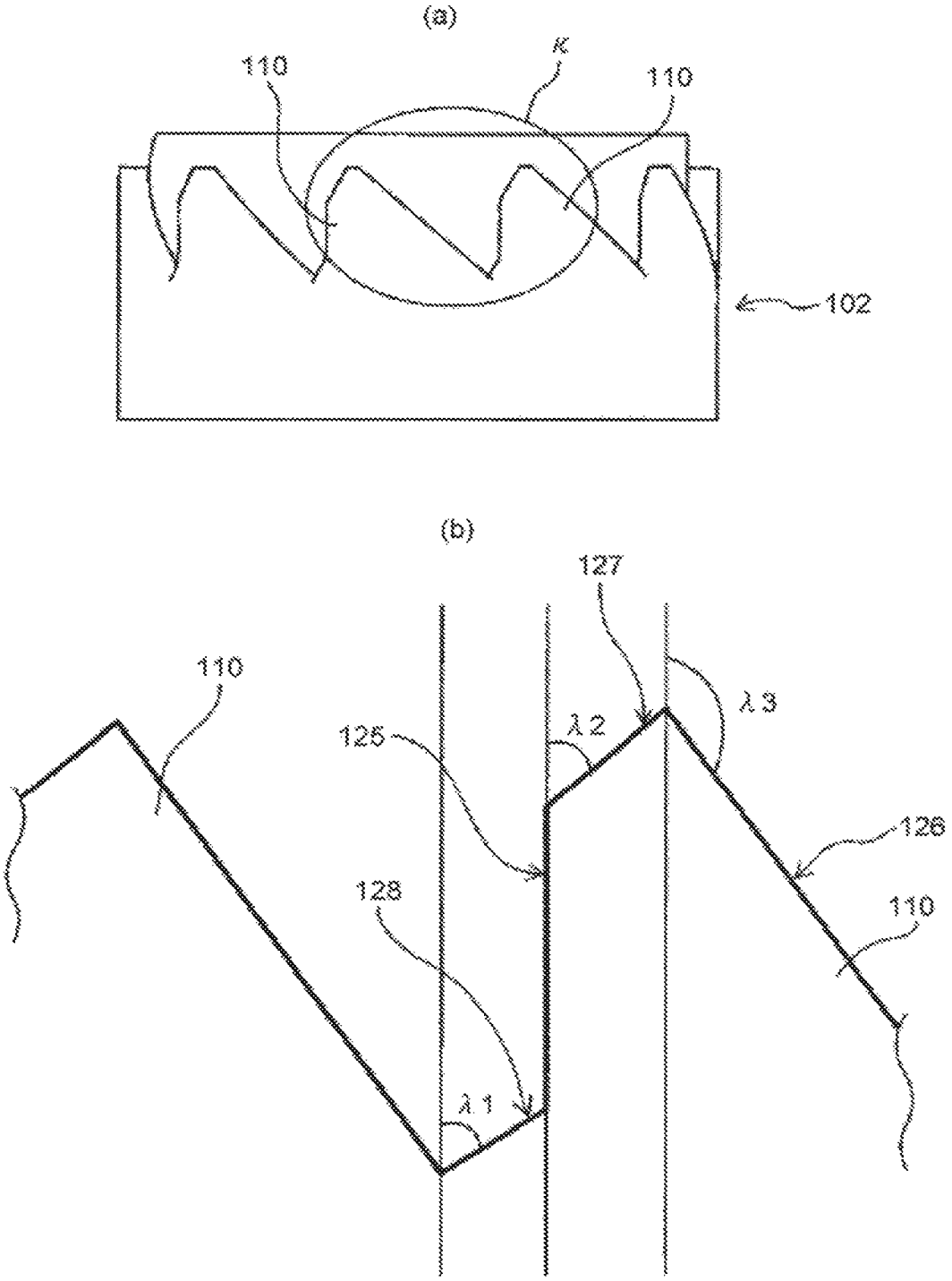
FIG. 21 illustrates wall surfaces of a driven portion: (a) is an explanatory side view of the wall surfaces; and (b) is an explanatory enlarged view of the wall surfaces.

FIG. 21 illustrates the wall surfaces of the driven portion 110. The downstream side of the toner container 100 in the insertion direction is oriented upward in FIG. 21. In FIG. 21, (a) is a schematic side view of the cap 102; and (b) is a schematic enlarged view of a region K in (a).

As illustrated in FIG. 21, the drive transmitted surface 125 is arranged parallel to the insertion direction. On the upstream side of the drive transmitted surface 125 in the insertion direction, the rear-side inclined surface 128 is continuously provided. The rear-side inclined surface 128 extends to the upstream side in the insertion direction so as to be inclined by a predetermined angle (λ1=30°) with respect to the insertion direction such that the surface faces the downstream side in the insertion direction.

On the upstream side of the rear-side inclined surface 128, the first guiding inclined surface 126 is continuously provided. An upstream end of the first guiding inclined surface 126 in the insertion direction is located at the boundary with the rear-side inclined surface 128. The first guiding inclined surface 126 extends from the upstream end in the insertion direction to a downstream side in the insertion direction such that the surface is inclined by a predetermined angle (λ3=130°) with respect to the insertion direction.

The second guiding inclined surface 127 is continuously provided from a downstream end of the drive transmitted surface 125 in the insertion direction. The second guiding inclined surface 127 is inclined by a predetermined angle (λ2=30°) with respect to the insertion direction so as to face the downstream side in the insertion direction, and extends to the downstream side in the insertion direction.

A downstream end of the second guiding inclined surface 127 in the insertion direction is continued to the downstream end of the first guiding inclined surface 126 in the insertion direction of the adjacent driven portion 110 (in the upper side in FIG. 20).

The slope λ2 of the second guiding inclined surface 127, which is an inclined surface in the opposite direction of the first guiding inclined surface 126 with respect to the insertion direction, has an acute angle, where a relationship of λ2<λ3 is satisfied. This is to rotate the entire toner container 100 even if the cap 102 cannot rotate relative to the container body 101 when driving protrusions 212 serving as main-body interlocking portions of the main body of the image forming apparatus (to be described later) come in contact with the second guiding inclined surfaces 127 and a force acts to the right in (b) in FIG. 21 (in the direction β in FIG. 4).

As illustrated in FIGS. 17 and 20 for example, the downstream end of the driven portion 110 in the insertion direction, which is a portion where the first guiding inclined surface 126 and the second guiding inclined surface 127 are connected (a boundary portion between the first guiding inclined surface 126 and the second guiding inclined surface 127), has a pointed shape.

As illustrated in FIG. 17, in the cap 102, the downstream end of the driven portion 110 in the insertion direction is located on the upstream side in the insertion direction relative to a cap front end 129 that is a downstream end of the cap 102 in the insertion direction. Therefore, it is possible to reduce the probability that the pointed-shaped downstream end of the driven portion 110 in the insertion direction breaks a toner container bag containing the toner container 100. Consequently, it is possible to prevent the toner container bag from being damaged.

The upstream end and the downstream end of the drive transmitted surface 125 in the insertion direction are connected to the inclined surfaces (in the first embodiment, the rear-side inclined surface 128 and the second guiding inclined surface 127). In the first embodiment, a part that receives drive (drive transmitted part) has a flat surface as in the drive transmitted surface 125. However, the drive transmitted part is not limited to a continuous surface in the insertion direction as described above. For example, the part may partly have a recess in the circumferential direction or may have irregularities.

In this case, the most protruding portion of the driven portion 110 in the circumferential direction on the upstream side in the rotation direction serves as the drive transmitted part (a portion that comes in contact with a drive transmission surface 214 of the driving protrusion 212 on the main body of the image forming apparatus to be described later).

Figure 22:
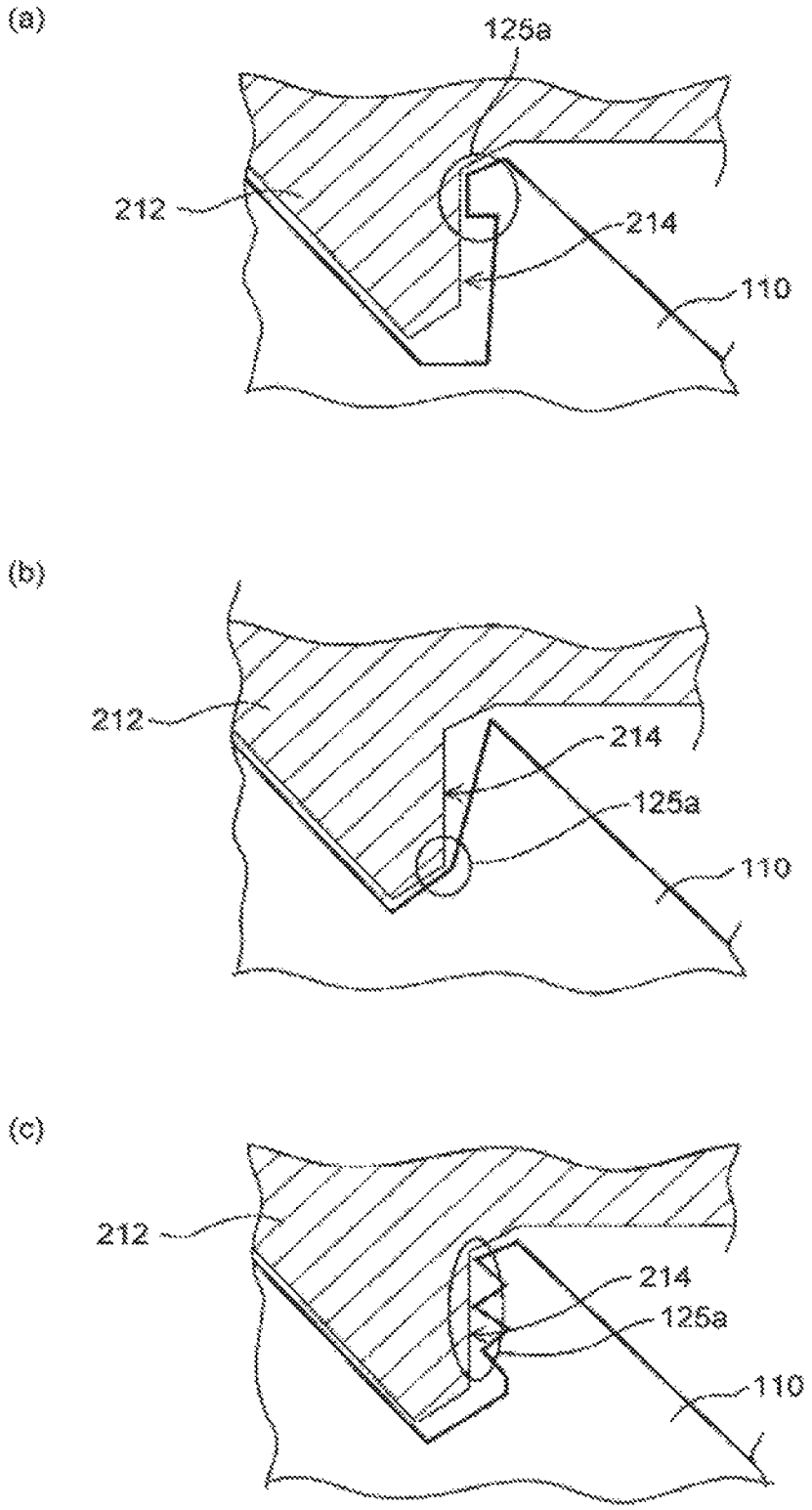
FIG. 22 illustrates a configuration examples where the drive transmitted part does not have a planer shape: (a) is an example in which a downstream side of the driven portion in the insertion direction serves as a drive transmitted part; (b) is an example in which an upstream side of the driven portion in the insertion direction serves as the drive transmitted part; and (c) is an example in which a plurality of portions of the driven portion in the insertion direction serve as the drive transmitted part.

FIG. 22 illustrates configuration examples of the driven portion 110, where the drive transmitted part does not have a planer shape. In FIG. 22, (a) illustrates a configuration example in which the downstream side of the driven portion 110 in the insertion direction serves as a drive transmitted part 125*a*; (b) illustrates a configuration example in which the upstream side of the driven portion 110 in the insertion direction serves as the drive transmitted part 125*a*; and (c) illustrates a configuration example in which a plurality of portions of the driven portion 110 in the insertion direction serve as the drive transmitted part 125*a*.

The inclined surfaces (128, 126, and 127) are provided from the upstream end of one of the drive transmitted surfaces 125 to the adjacent drive transmitted surface 125 among the drive transmitted surfaces 125 of the first embodiment. More specifically, the upstream end of one of the drive transmitted surfaces 125 in the insertion direction and the downstream end of the adjacent drive transmitted surface 125 in the insertion direction are connected by the inclined surfaces that are inclined with respect to the rotation direction.

In the configuration including the rear-side inclined surface 128, not only a guiding function of the rear-side inclined surface 128 but also functions as described below are provided.

Specifically, it is assumed that the rear-side inclined surface 128 is not provided, and the drive transmitted surface 125 extends to the upstream side in the insertion direction so as to be parallel to the insertion direction while the first guiding inclined surface 126 extends at the same inclined angle as that of the first embodiment. In this case, a position at which the drive transmitted surface 125 and the first guiding inclined surface 126 are connected (a rearmost portion of the driven portion 110 on the upstream side in the insertion direction) is shifted to the upstream side in the insertion direction on the cap 102, relative to the position in the first embodiment. In this configuration, the internally-extended portion of the cap 102 for providing the driven portion 110 is expanded to the upstream side in the insertion direction on the cap 102, and the capacity of the toner container 100 may be reduced. In contrast, if the rear-side inclined surface 128 is provided, a rearmost portion of the cap 102 on the upstream side in the insertion direction is located closer to the front end of the cap 102 as in the first embodiment, as compared to the configuration without the rear-side inclined surface 128. Therefore, it is possible to ensure the capacity of the toner container 100.

In the configuration including the rear-side inclined surface 128, not only a guiding function of the second guiding inclined surface 127 but also functions as described below are provided.

Specifically, it is assumed that the second guiding inclined surface 127 is not provided, and the drive transmitted surface 125 extends to the downstream side in the insertion direction so as to be parallel to the insertion direction while the first guiding inclined surface 126 extends at the same angle as that of the first embodiment. In this case, a position at which the first guiding inclined surface 126 and the drive transmitted surface 125 are connected (a front end or a top of the driven portion 110 on the downstream side in the insertion direction) is expanded to the downstream side in the insertion direction of the toner container 100, relative to the position in the first embodiment. In this configuration, a toner container bag may be broken as described above. In contrast, if the second guiding inclined surface 127 is provided as in the first embodiment, it is possible to shift the position of the downstream end in the insertion direction to the upstream side in the insertion direction while maintaining the inclined angle of the first guiding inclined surface 126. The driven portion 110 is made up of surfaces in parallel to or inclined with respect to the insertion direction. The driven portion 110 also does not have any surface that is perpendicular to the insertion direction and faces the downstream side in the insertion direction.

The discharging member 107 will be described below.

Figure 23:
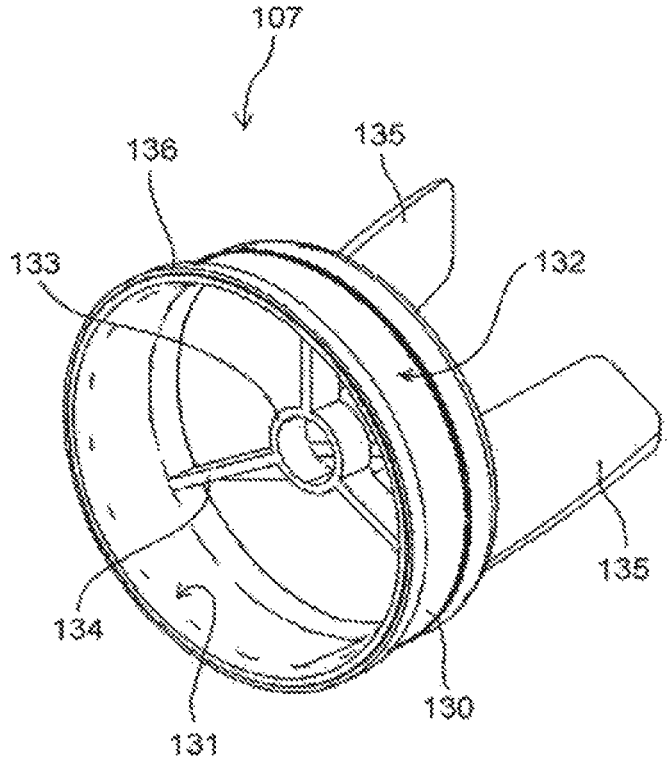
FIG. 23 is a perspective view of a discharging member of the first embodiment when viewed from the downstream side in the insertion direction.
Figure 24:
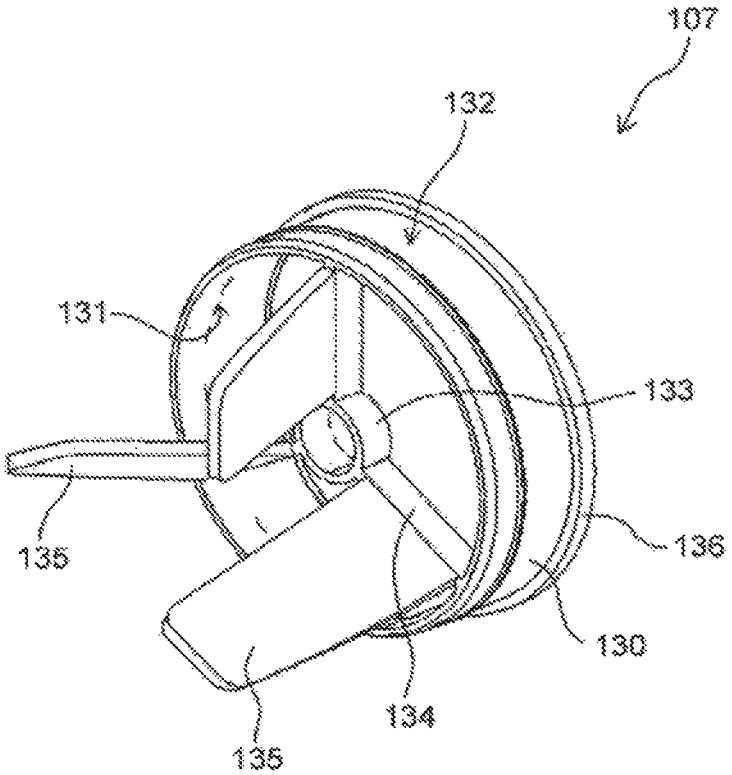
FIG. 24 is a perspective view of the discharging member of the first embodiment when viewed from the upstream side in the insertion direction.
Figure 25:
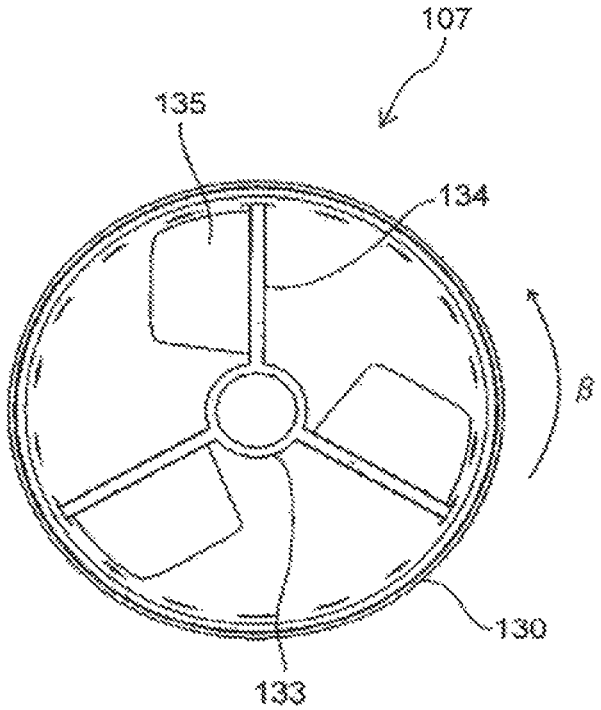
FIG. 25 is a front view of the discharging member of the first embodiment when viewed from the downstream side in the insertion direction.
Figure 26:
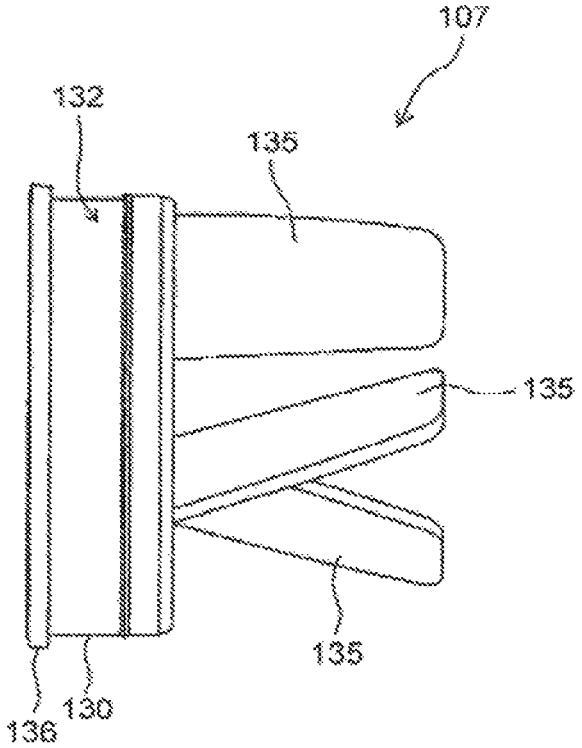
FIG. 26 is a side view of the discharging member of the first embodiment.

FIG. 23 is a perspective view of the discharging member 107 of the first embodiment when viewed from the downstream side in the insertion direction. FIG. 24 is a perspective view of the discharging member 107 of the first embodiment when viewed from the upstream side in the insertion direction. FIG. 25 is a front view of the discharging member 107 of the first embodiment when viewed from the downstream side in the insertion direction. FIG. 26 is a side view of the discharging member 107 of the first embodiment.

The discharging member 107 includes a cylindrical ring 130. A ring protrusion 136 as a ring-shaped protrusion protruding outward is provided on a downstream end of an outer wall 132 of the ring 130 in the insertion direction. Reinforcing plates 134 extend from an inner wall 131 of the ring 130 to the center in the radial direction. The reinforcing plates 134 are plate-shaped members. A plurality of the reinforcing plates 134 (in the embodiment, three) are provided at intervals of 120 degrees in the rotation direction, and each of the reinforcing plates 134 extends toward the center. A cylindrical reinforcing ring 133 is provided in the center of the cylindrical rings 130. The reinforcing plates 134 are connected to the outer circumference of the reinforcing ring 133. The reinforcing ring 133 is provided for reinforcement, and functions as a supporter when a force is applied to the reinforcing plates 134.

Scooping portions 135 extend from the respective reinforcing plates 134 to the upstream side in the insertion direction (to the right in FIG. 26). Each of the scooping portions 135 is a plate-shaped member, has a base portion connected to the reinforcing plate 134, has an end serving as a free end, and is inclined such that an upstream end (the free end) in the insertion direction is oriented toward the downstream side in the rotation direction of the container body 101 (in the direction of an arrow β in FIG. 25).

The inner cap 106 will be described below.

Figure 27:
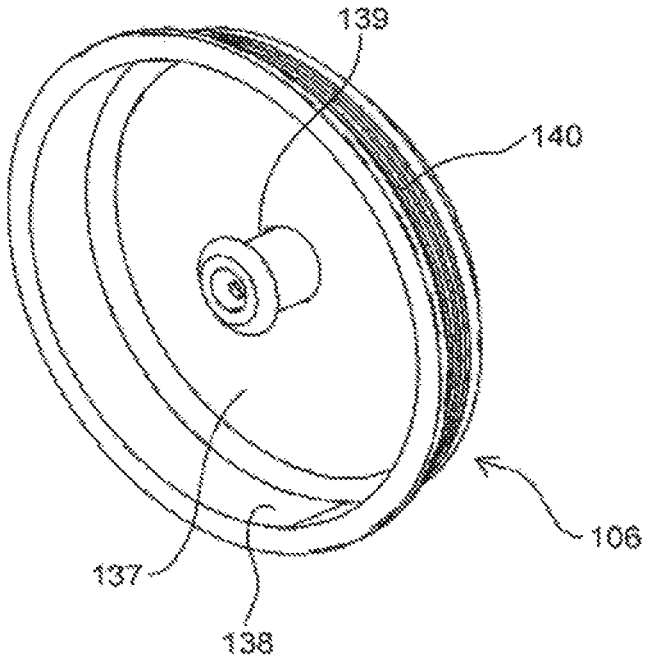
FIG. 27 is a perspective view of the inner cap of the first embodiment when viewed from the downstream side in the insertion direction.
Figure 28:
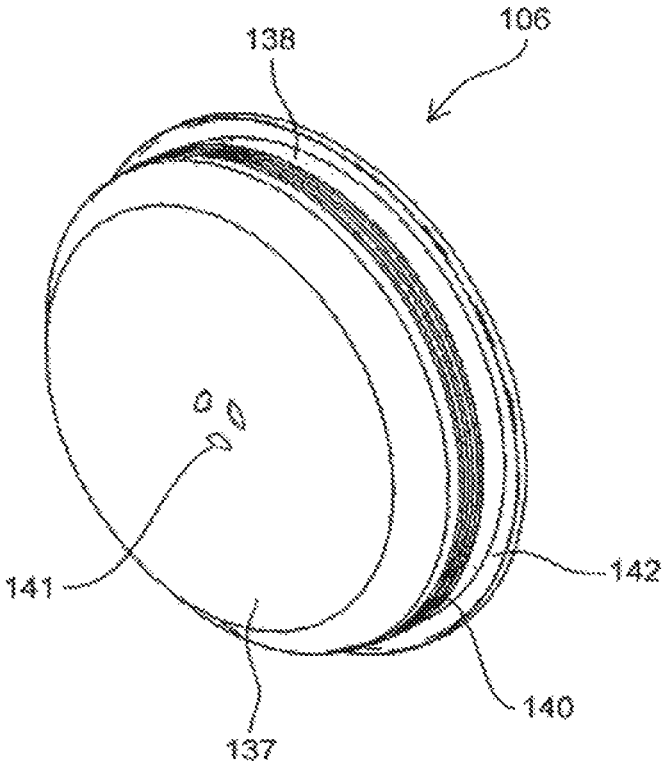
FIG. 28 is a perspective view of the inner cap of the first embodiment when viewed from the upstream side in the insertion direction.
Figure 29:
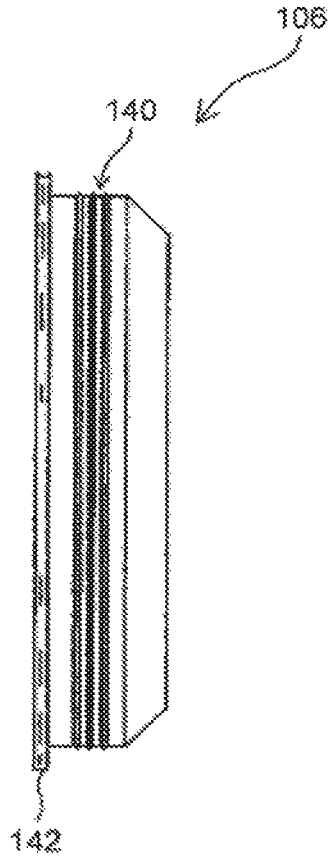
FIG. 29 is a side view of the inner cap of the first embodiment.

FIG. 27 is a perspective view of the inner cap 106 of the first embodiment when viewed from the downstream side in the insertion direction. FIG. 28 is a perspective view of the inner cap 106 of the first embodiment when viewed from the upstream side in the insertion direction. FIG. 29 is a side view of the inner cap 106 of the first embodiment. The inner cap 106 is a cap member that covers the discharge port 114.

The inner cap 106 includes a disk-shaped bottom plate 137, a circumferential wall 138 extending from the periphery of the bottom plate 137 to the downstream side in the insertion direction, and a tab 139 protruding from the center of the bottom plate 137 to the downstream side in the insertion direction. An opening serving as an inner cap vent 141 is provided inside the tab 139 in the center of the bottom plate 137.

On the outer periphery of the circumferential wall 138 of the inner cap, a plurality of ribs (in the embodiment, three ribs (ring-shaped protrusions)) serving as an inner cap seal 140 is provided in a standing manner around the outer periphery in the circumferential direction. An inner cap stopper 142 as a ring-shaped protrusion is provided in a standing manner so as to extend outward in the radial direction on the downstream side of the circumferential wall 138 in the insertion direction. When the inner cap 106 is fitted to the discharge port 114, the inner cap stopper 142 is caught at the end of the opening portion 108 to prevent further insertion. The inner cap seal 140 is provided to prevent toner leakage from a gap between the outer periphery of the circumferential wall 138 of the inner cap 106 and the inner periphery of the opening portion 108, and the inner cap seal 140 prevents toner leakage. When the inner cap 106 is pushed inward, the inner cap seal 140 is pressed between the inner wall of the opening portion 108 and the circumferential wall 138 of the inner cap, so that the inner cap 106 and the opening portion 108 are tightly fitted.

The tab 139 is held by a mechanism included in a container holder 200 of the replenishing device of the main body of the image forming apparatus to be described later, and is used to pull out the inner cap 106 in conjunction with operation of inserting and setting the toner container 100. As the mechanism that holds the tab 139 of the inner cap 106 and pulls out the inner cap 106, a mechanism using a collet chuck as described in Japanese Patent Application Laid-open No. 2011-112884 may be used; however, it is not limited thereto. In the embodiment, a container opening motor 209 to be described later is activated to cause a collet chuck to hold the tab 139 and pull out the inner cap 106.

The inner cap vent 141 is an opening communicating with the outside from the bottom plate 137 of the inner cap through the inside of the tab 139, serves as a communicating opening, and is provided to enable communication between the inside and the outside of the toner container 100 when the inner cap 106 as a cap is attached to the toner container 100. However, in this state, the stored toner may leak through the inner cap vent 141. Therefore, the inner cap vent 141 in the tab 139 is filled with a filter member (cotton, foamed resin, or the like) that transmits air without transmitting toner in order to capture the toner. By providing the inner cap vent 141, it is possible to prevent the inner cap 106 from falling out due to a pressure difference between the inside and the outside of the toner container 100.

The outer cap 103 will be described below.

Figure 30:
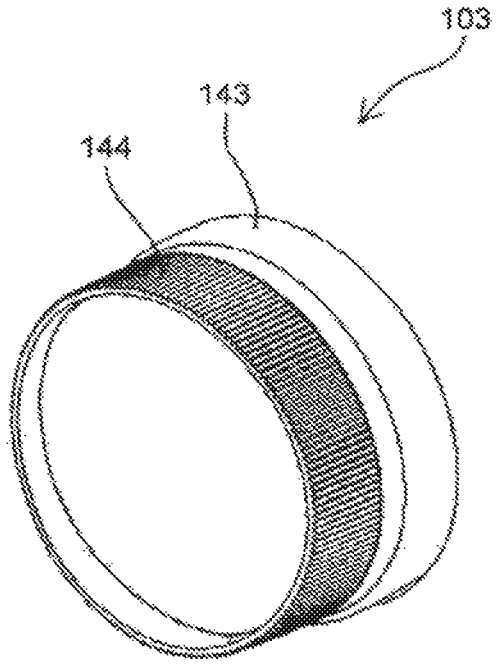
FIG. 30 is a perspective view of the outer cap of the first embodiment when viewed from the downstream side in the insertion direction.
Figure 31:
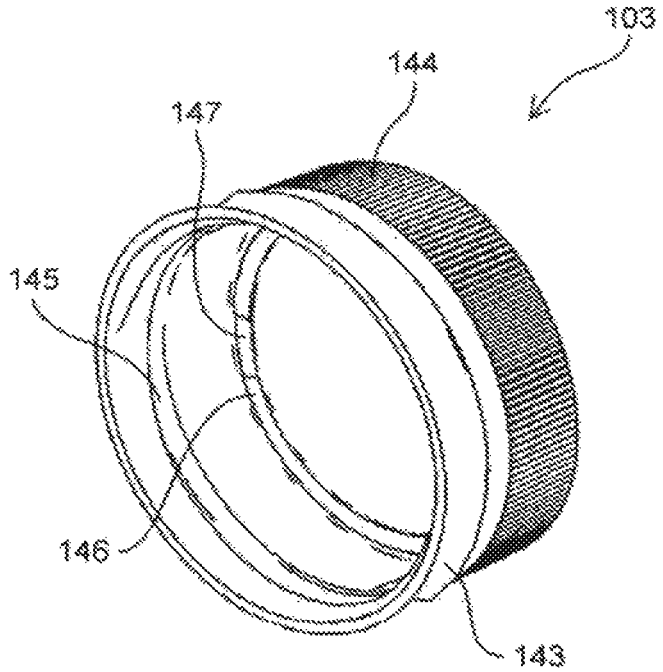
FIG. 31 is a perspective view of the outer cap of the first embodiment when viewed from the upstream side in the insertion direction.
Figure 32:
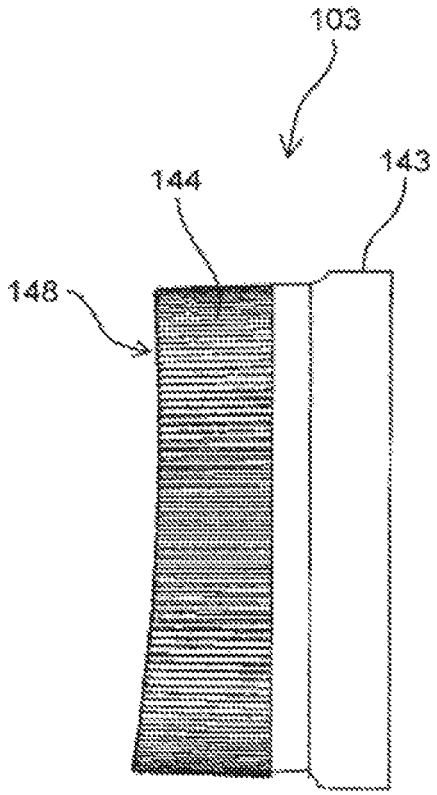
FIG. 32 is a side view of the outer cap of the first embodiment.

FIG. 30 is a perspective view of the outer cap 103 of the first embodiment when viewed from the downstream side in the insertion direction. FIG. 31 is a perspective view of the outer cap 103 of the first embodiment when viewed from the upstream side in the insertion direction. FIG. 32 is a side view of the outer cap 103 of the first embodiment.

The outer cap 103 is attached when the toner container 100 is transported or stored, and is detached by an operator before the toner container 100 is inserted in the main body of the image forming apparatus.

The outer cap 103 includes an outer cap gripper 144 and an outer periphery 143, and has a cylindrical shape. The outer cap 103 is provided to prevent the inner cap 106 from being detached unintentionally, and is attached as a screw cap to the toner container 100 when the outer cap stopper 109 of the opening portion 108 of the container body 101 and an outer cap screw 145 interlock with each other.

An inner protrusion 146 is provided on the inner side of a cap portion of the outer cap 103 so as to come in contact with a front end of the opening portion 108 on the downstream side in the insertion direction when the outer cap 103 is attached to the toner container 100. The inner protrusion 146 of the outer cap extends in the circumferential direction. A part of the inner protrusion 146 is notched and serves as an air hole 147 of the inner protrusion of the outer cap such that the entire inner circumference of the outer cap 103 does not completely come in contact with the front end of the opening portion 108.

When the outer cap 103 is attached to the toner container 100, the air hole 147 of the inner protrusion of the outer cap enables communication between the inside and the outside of the toner container 100 for ventilation.

An outer cap warpage 148 is provided on a downstream edge of the outer cap 103 in the insertion direction. The outer cap warpage 148 provides a slope for preventing aggregation. Therefore, the toner container 100 with the outer cap 103 can hardly stand still with the outer cap 103 face down. With this function, it is difficult to store the toner container 100 with the outer cap 103 in a standing manner with the outer cap 103 face down. Therefore, it is possible to prevent toner from being aggregated and adhered in the vicinity of the discharge port 114 due to the weight of the toner when the toner container 100 is placed in a standing manner with the outer cap 103 face down.

Discharge of toner in the toner container 100 will be described below.

Figure 33:
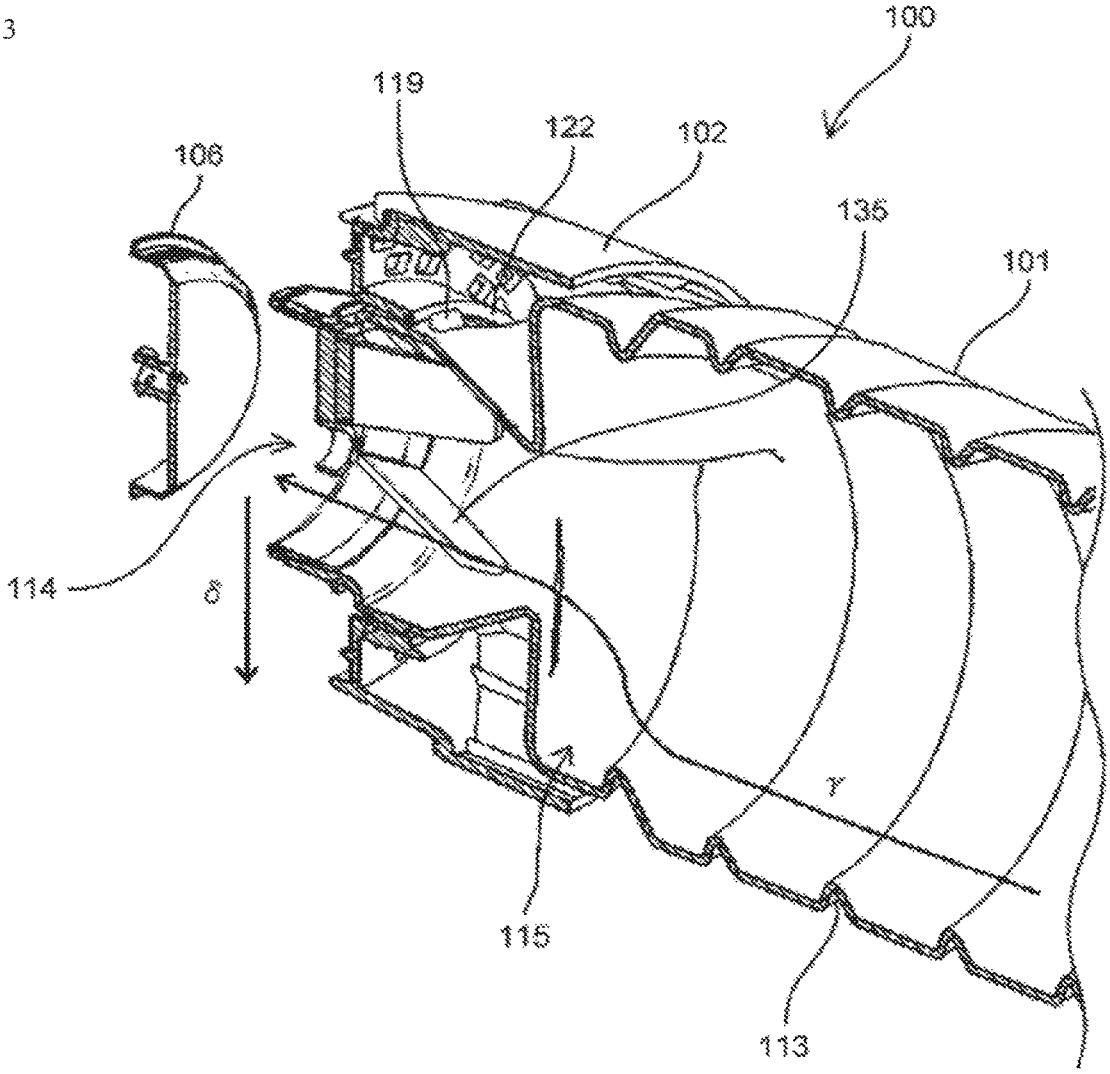
FIG. 33 is an enlarged perspective cross-sectional view of the vicinity of the downstream end of the toner container of the first embodiment in the insertion direction in the state of being attached to the main body of the image forming apparatus.

FIG. 33 is an enlarged perspective cross-sectional view of the vicinity of the downstream end of the toner container 100 of the first embodiment in the insertion direction in the state of being attached to the main body of the image forming apparatus. Arrows γ and δ in FIG. 33 indicate the flow of the toner.

When the toner container 100 rotates, the conveying groove 113 (conveying means) conveys toner inside the container body 101 to the downstream side in the insertion direction. The toner conveyed to the container-side scooping portions 115 is lifted from the lower side to the upper side by the container-side scooping portions 115. The toner lifted to a certain height flows down from the container-side scooping portions 115 with the further rotation, and received by the scooping portions 135 of the discharging member 107. The scooping portions 135 of the discharging member 107 are extended to positions where the container-side scooping portions 115 are provided in order to enable delivery of the toner as described above.

The toner sent to the scooping portions 135 of the discharging member 107 is lifted up again along with the rotation. At this time, each of the scooping portions 135 of the discharging member 107 is inclined such that the upstream end in the insertion direction is oriented toward the downstream side in the rotation direction of the container body 101. Therefore, the toner is conveyed toward the discharge port 114 along with the rotation. The toner is finally discharged from the discharge port 114 by the conveyance as described above. The two container-side scooping portions 115 are provided and the three scooping portions 135 of the discharging member 107 are provided, that is, the number of the scooping portions 135 of the discharging member 107 is greater than the number of the container-side scooping portions 115. Therefore, it is possible to efficiently discharge the toner scooped up by the container-side scooping portions 115.

Interlocking of the cap 102 and the container body 101 in the toner container 100 will be described below.

Figure 34:
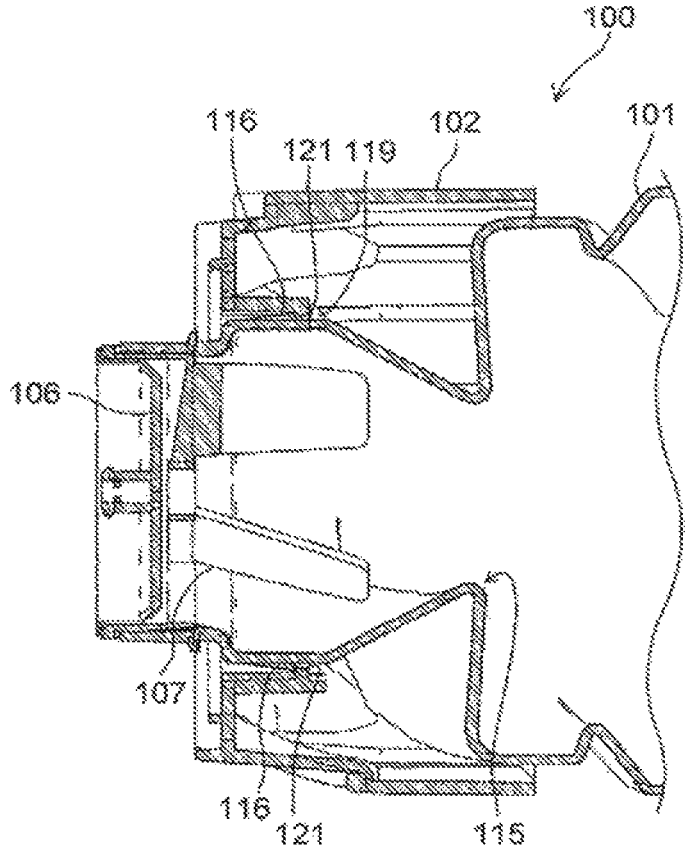
FIG. 34 illustrates an enlarged lateral cross-section of the vicinity of the downstream end of the toner container of the first embodiment in the insertion direction.

FIG. 34 illustrates an enlarged lateral cross-section of the vicinity of the downstream end of the toner container 100 of the first embodiment in the insertion direction.

As described above with reference to FIG. 14, the stopper protrusions 116 are provided on the opening base portion 120 of the container body 101. Therefore, when the cap 102 is attached to the container body 101, the stopper rib 121 of the cap 102 is hooked on the stopper protrusions 116 to prevent falling of the cap 102.

Further, as described above with reference to FIG. 14, the axial restrictor protrusions 119 are provided on the opening base portion 120 of the container body 101. Therefore, when the cap 102 is attached to the container body 101, the axial contact surface 122 of the stopper rib 121 of the cap 102 comes in contact with the axial restrictor protrusions 119. This prevents the cap 102 from being fitted further toward the container body 101. Similarly, the axial contact surface 122 of the cap 102 comes in contact with the circumferential restrictor protrusions 117 of the container body 101 illustrated in FIG. 14 to restrict the movement of the cap 102.

As illustrated in FIG. 34, by causing the stopper rib 121 of the cap 102 to be fitted between the stopper protrusions 116 and the axial restrictor protrusions 119, it is possible to restrict forward and backward movement of the cap 102 in the axial direction.

The circumferential restrictor protrusions 117 are provided so as to extend outward relative to the axial restrictor protrusions 119 in the axial direction of the container body 101. The circumferential restrictor contact protrusions 123 of the cap 102 are hooked on the circumferential restrictor protrusions 117, so that the container body 101 rotates along with the rotation of the cap 102. The cap 102 can rotate relative to the container body 101 in a predetermined angular range until the circumferential restrictor contact protrusions 123 of the cap 102 are hooked.

Therefore, it is possible to perform pushing operation such that the driving protrusions 212, which serve as main-body interlocking portions of the image forming apparatus to be described later, and the driven portions 110 interlock with each other so that drive can be transmitted.

Next, the container holder 200 of the toner replenishing device 70 of the main body of the image forming apparatus in which the toner container 100 of the first embodiment is inserted will be described.

Figure 35:
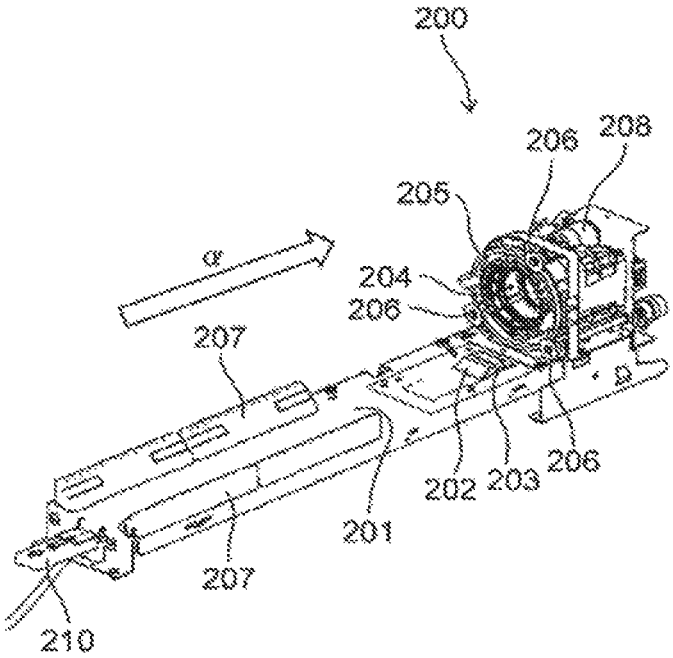
FIG. 35 is a perspective view of a container holder of the first embodiment when viewed from the upstream side in the insertion direction.
Figure 36:
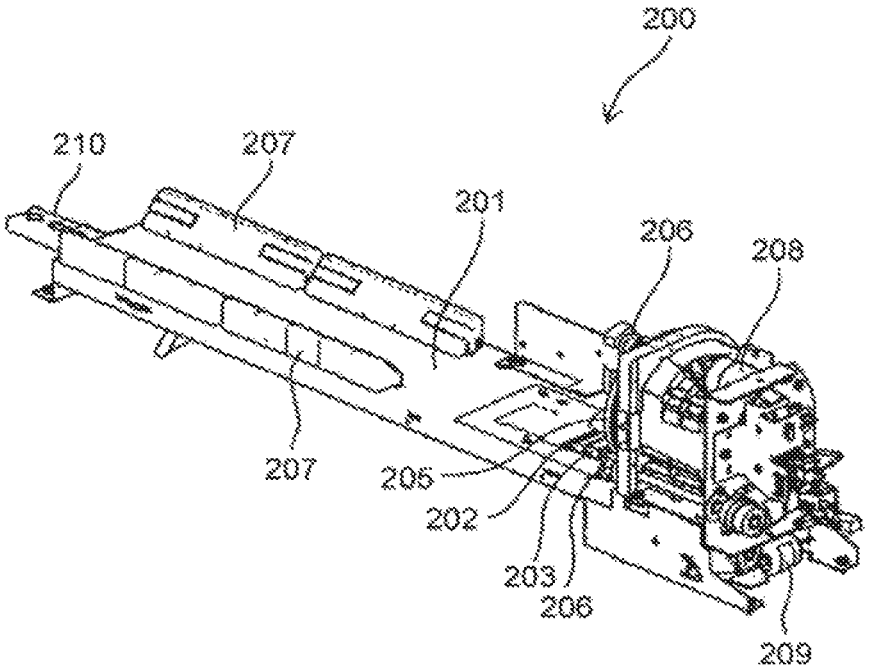
FIG. 36 is a perspective view of the container holder of the first embodiment when viewed from the downstream side in the insertion direction.

FIG. 35 is a perspective view of the container holder 200 of the first embodiment when viewed from the upstream side in the insertion direction. FIG. 36 is a perspective view of the container holder 200 of the first embodiment when viewed from the downstream side in the insertion direction.

A rear side where the toner container 100 is inserted toward the rear of the main body of the image forming apparatus (a direction toward an output driving unit 205 or the direction of an arrow α in FIG. 35) is the downstream side in the insertion direction, and the opposite side is the upstream side in the insertion direction.

In the container holder 200, the toner container 100 is placed on a container setting section 201 and inserted in the insertion direction by being guided by a container supporter 207. When the opening portion 108 of the toner container 100 is inserted and set in a container inserter 204, the inner cap 106 is opened. The output driving unit 205 that outputs drive from the main body side of the image forming apparatus is provided on the periphery of the container inserter 204 in a rotatable manner. The output driving unit 205 is rotated by a container driving motor 208.

The output driving unit 205 and the driven portions 110 of the toner container 100 interlock with each other, so that rotation drive of the output driving unit 205 is transmitted to the toner container 100 and the toner container 100 is rotated.

The container setting section 201 is provided with a container stopper 202 and a container detector 203, which are biased from the lower side to the upper side so as to protrude relative to the upper surface of the container setting section 201 before the toner container 100 is attached and so as to retract downward due to the weight of the toner container 100 when the toner container 100 is placed thereon.

When the toner container 100 enters from the upstream side of the container setting section 201 in the insertion direction, the container stopper 202 and the container detector 203 are pressed and retracted downward by the cap 102 of the toner container 100. Subsequently, when the toner container 100 further moves inward and reach the rear, a rear end of the cap 102 (upstream end in the insertion direction) passes above the container stopper 202. Therefore, the container stopper 202 is not pressed by any component, and the container stopper 202 protrudes upward again by a biasing force. In this state, a wall surface of the container stopper 202 on the downstream side in the insertion direction comes in contact with and hooked on the rear end of the cap 102 to prevent falling of the toner container 100.

When the toner container 100 reaches the rear, the cap 102 is located in the upper side of the container detector 203, and the container detector 203 is retracted downward due to the weight of the cap 102. In the state in which the container detector 203 is retracted downward, it is possible to detect whether the toner container 100 is set in the container holder 200.

If a container releasing lever 210 is pressed to the downstream side in the insertion direction, the container stopper 202 moves downward and the toner container 100 can be pulled out.

The output driving unit 205 will be described below.

Figure 37:
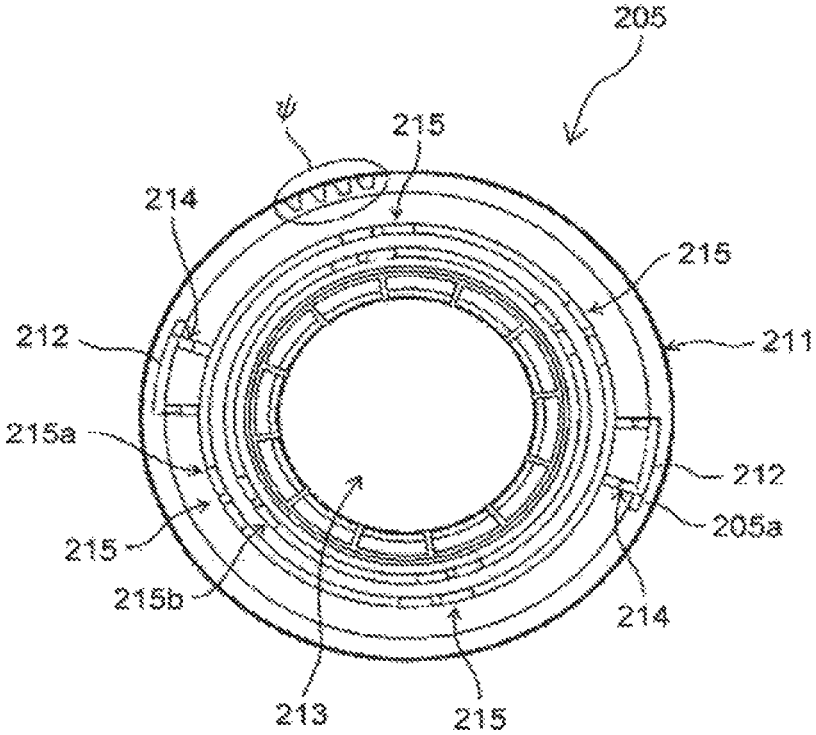
FIG. 37 is a front view of an output driving unit of the first embodiment when viewed from the upstream side in the insertion direction.
Figure 38:
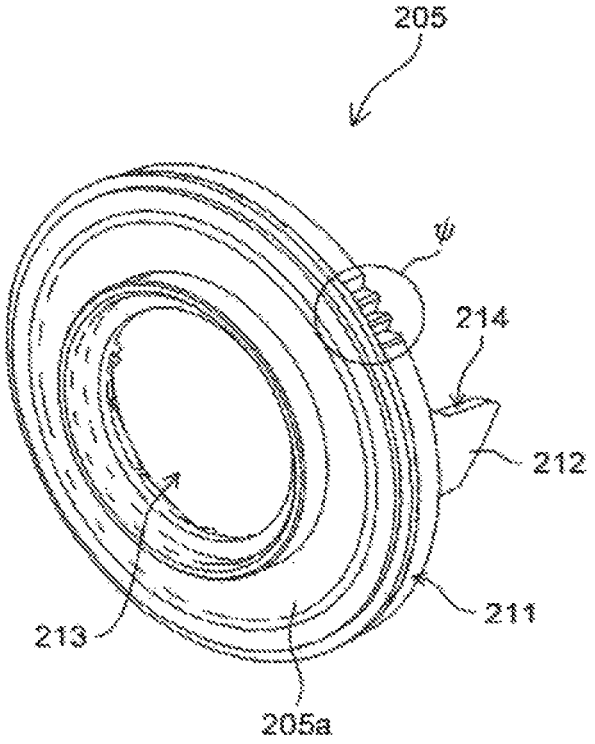
FIG. 38 is a perspective view of the output driving unit of the first embodiment when viewed from the downstream side in the insertion direction.
Figure 39:
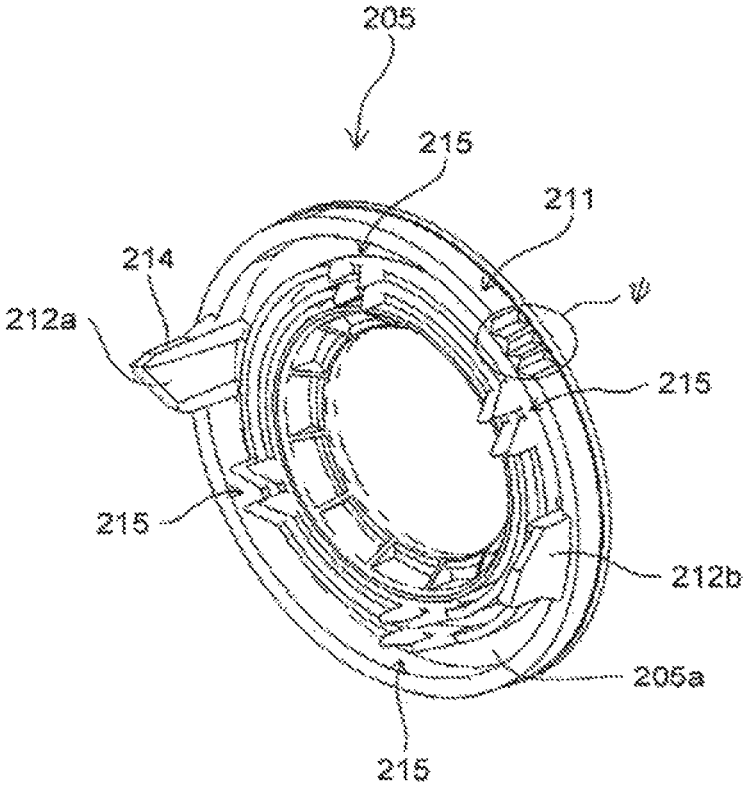
FIG. 39 is a perspective view of the output driving unit of the first embodiment when viewed from the upstream side in the insertion direction.
Figure 40:
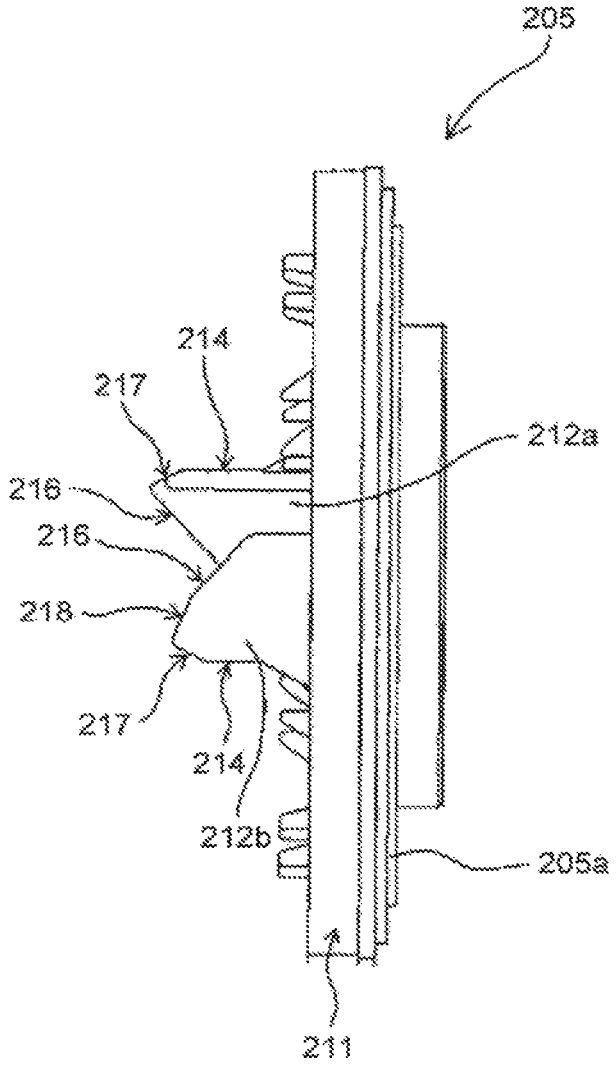
FIG. 40 is a side view of the output driving unit of the first embodiment.
Figure 41:
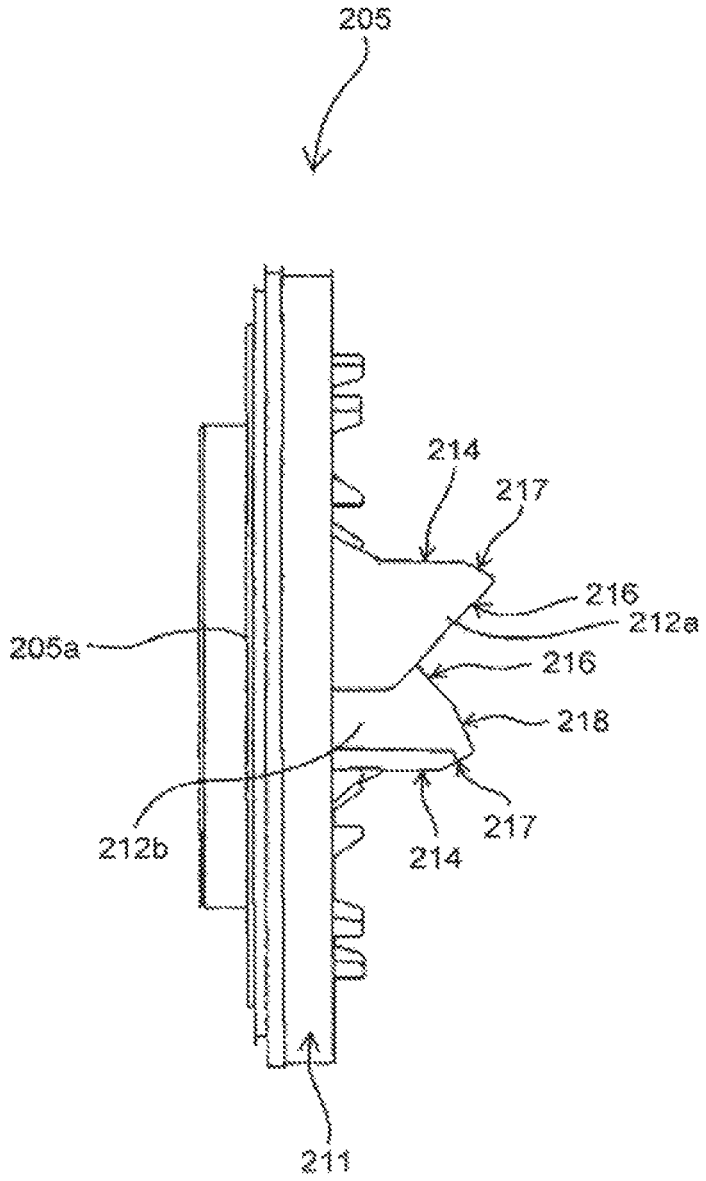
FIG. 41 is a side view of the output driving unit of the first embodiment when viewed from the side opposite to the side in FIG. 40.

FIG. 37 is a front view of the output driving unit 205 of the first embodiment when viewed from the upstream side in the insertion direction. FIG. 38 is a perspective view of the output driving unit 205 of the first embodiment when viewed from the downstream side in the insertion direction. FIG. 39 is a perspective view of the output driving unit 205 of the first embodiment when viewed from the upstream side in the insertion direction. FIG. 40 is a side view of the output driving unit 205 of the first embodiment. FIG. 41 is a side view of the output driving unit 205 of the first embodiment when viewed from the side opposite to the side in FIG. 40.

The output driving unit 205 is a disk-shaped member, and includes a gear teeth 211 as illustrated in a region ψ in FIGS. 37 to 39 on the entire periphery. The gear teeth 211 mesh with drive transmission gears 206 of the container driving motor 208, and is driven to rotate by receiving a driving force along with the rotation of the container driving motor 208. A circular opening is provided in the center of a disk-shaped main body 205*a* of the output driving unit 205, and serves as a container insertion opening 213. The opening portion 108 of the toner container 100 is inserted in the container insertion opening 213.

The output driving unit 205 is provided with the driving protrusions 212 extending to the upstream side in the insertion direction relative to the main body 205*a* of the output driving unit. The driving protrusions 212 serve as a first driving protrusion 212*a* and a second driving protrusion 212*b*.

On the main body 205*a* of the output driving unit, identifier protrusion groups 215, each of which serves as a main-body protrusion group or an identifier protrusion group as a combination of a plurality of identifier protrusions, are provided as output identifier portions on the inner side in the radial direction relative to the first driving protrusion 212*a* and the second driving protrusion 212*b*. The identifier protrusion group 215 includes an outer identifier protrusion group 215*a* serving as an outer protrusion group and an inner identifier protrusion group 215*b* serving as an inner protrusion group.

The identifier protrusion group 215 includes a plurality of protrusions protruding to the upstream side in the insertion direction. Each of the protrusions is inclined such that the protrusion amount increases from the upstream side to the downstream side in the rotation direction of the output driving unit 205 to reach a top. A flat surface is provided on the downstream side of the top in the rotation direction. Specifically, the flat surface is a surface vertically extending from a surface of the main body 205*a* of the output driving unit on the upstream side in the insertion direction. The identifier protrusion group 215 includes the outer identifier protrusion group 215*a* and the inner identifier protrusion group 215*b* each being configured as a combination of two protrusions, and a plurality of the combinations are provided in the circumferential direction (in the first embodiment, four combinations). As illustrated in FIG. 37 for example, the first driving protrusion 212*a* and the second driving protrusion 212*b* are disposed at intervals of 180 degrees so as to face each other.

The first driving protrusion 212*a* will be described below.

Figure 42:
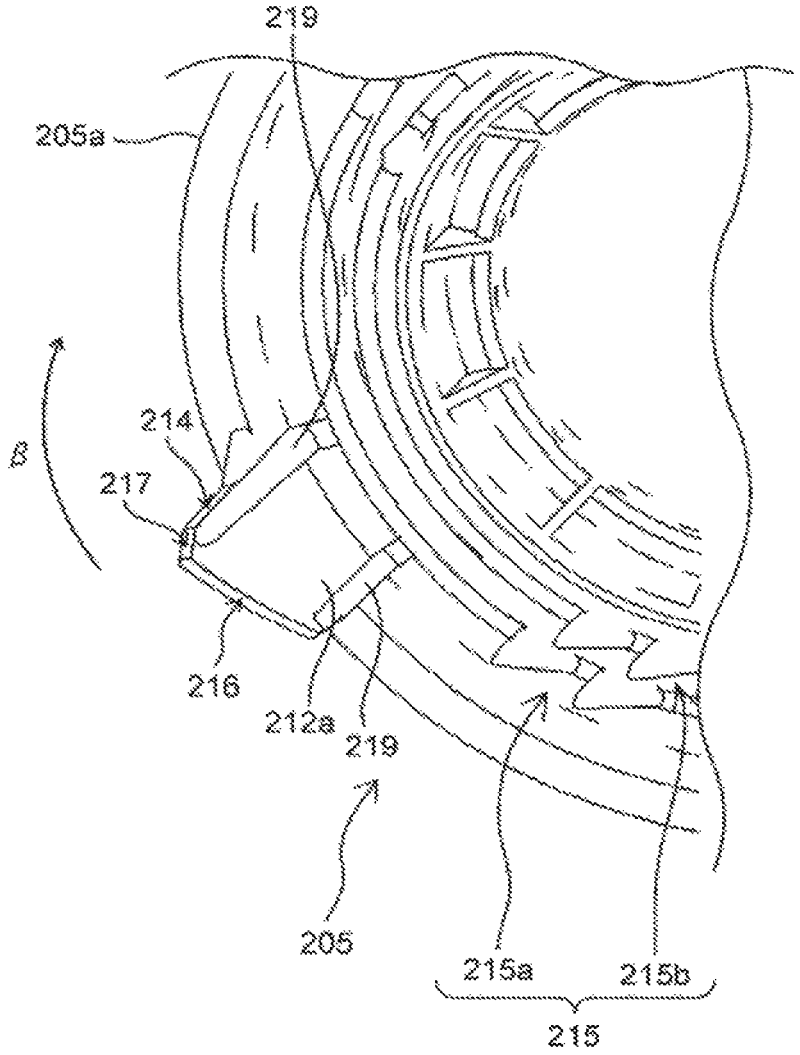
FIG. 42 is an enlarged perspective view of a first driving protrusion of the first embodiment.

FIG. 42 is an enlarged perspective view of the first driving protrusion 212*a* of the first embodiment.

The first driving protrusion 212*a* protrudes toward the upstream side in the insertion direction relative to the main body 205*a* of the output driving unit, and includes a first guiding surface 216 as a first main-body inclined surface that is inclined such that the protrusion amount decreases to the upstream side in the rotation direction. The drive transmission surface 214 as a wall surface extending along the insertion direction is provided on a side surface on the downstream side in the rotation direction. The drive transmission surface 214 presses the drive transmitted surface 125 of the driven portion 110 and functions as a drive transmitting unit.

A slope is provided on the opposite side of the first guiding surface 216 across the front end of the first driving protrusion 212*a* on the upstream side in the insertion direction, and serves as a second guiding surface 217 that is a second main-body inclined surface. The first guiding surface 216 and the second guiding surface 217 have functions as guides to guide the driven portion 110 such that the drive transmitted surface 125 is located so as to come in contact with the drive transmission surface 214 upon contact with the driven portion 110 of the cap 102.

The second guiding surface 217 is inclined such that the protrusion amount decreases to the downstream side in the rotation direction. A downstream end of the second guiding surface 217 in the insertion direction is continued to an upstream end of the drive transmission surface 214 in the insertion direction.

The second driving protrusion 212*b* will be described below.

Figure 43:
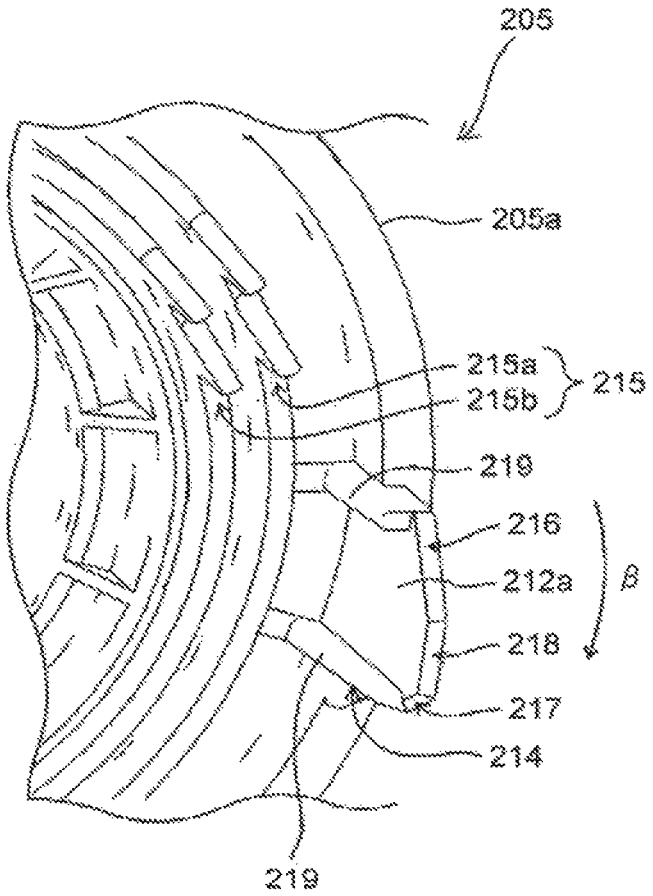
FIG. 43 is an enlarged perspective view of a second driving protrusion of the first embodiment.

FIG. 43 is an enlarged perspective view of the second driving protrusion 212*b* of the first embodiment.

Similarly to the first driving protrusion 212*a*, the second driving protrusion 212*b* protrudes toward the upstream side in the insertion direction relative to the main body 205*a* of the output driving unit, and includes the first guiding surface 216 that is inclined such that the protrusion amount decreases to the upstream side in the rotation direction. The drive transmission surface 214 as a wall surface extending along the insertion direction is provided on the side surface on the downstream side in the rotation direction. The drive transmission surface 214 presses the drive transmitted surface 125 of the driven portion 110 and functions as the drive transmitting unit.

The second driving protrusion 212*b* is formed in a shape such that the front end between the first guiding surface 216 and the second guiding surface 217 of the first driving protrusion 212*a* is cut, and the cut surface serves as a third guiding surface 218 that is a third main-body inclined surface. The first guiding surface 216, the second guiding surface 217, and the third guiding surface 218 have functions as guides to guide the driven portion 110 such that the drive transmitted surface 125 is located so as to come in contact with the drive transmission surface 214 upon contact with the driven portion 110 of the cap 102.

In the output driving unit 205, the second driving protrusion 212*b* is formed in the shape such that the front end of the first driving protrusion 212*a* is cut. Therefore, the protrusion amount of the first driving protrusion 212*a* is greater than that of the second driving protrusion 212*b*.

The first guiding surface 216 and the third guiding surface 218 of the second driving protrusion 212*b* may be described such that the third guiding surface 218 is continued to an upstream end of the first guiding surface 216 in the insertion direction. The inclined angle of the third guiding surface 218 is greater than the inclined angle of the first guiding surface 216 with respect to a straight line parallel to the insertion direction.

An upstream end of the third guiding surface 218 in the insertion direction serves as a top of the second driving protrusion 212*b*, and the second guiding surface 217 of the second driving protrusion 212*b* is provided across the top. Similarly to the first driving protrusion 212*a*, the second guiding surface 217 is continued to the upstream end of the drive transmission surface 214 in the insertion direction.

As illustrated in FIGS. 42 and 43, each of the driving protrusions 212 is provided with reinforcing ribs 219 standing inward in the radial direction on the upstream side and the downstream side in the rotation direction. The reinforcing ribs 219 reinforce the driving protrusions 212. The reinforcing ribs 219 reduce a gap between the first driving protrusion 212*a* and the second driving protrusion 212*b* in the radial direction. This prevents the toner container 100 from oscillating between the two driving protrusions 212 and prevents an interlocking failure.

Operation at the time of insertion of the toner container 100 of the first embodiment will be described below.

When the toner container 100 is inserted in the main body of the image forming apparatus while the position of the drive transmitted surface 125 of the driven portion 110 of the toner container 100 of the first embodiment and the position of the drive transmission surface 214 of the output driving unit 205 do not match each other, the following operation is performed. Specifically, in this case, the front end of the first driving protrusion 212*a* of the output driving unit 205 first comes in contact with either the first guiding inclined surface 126 or the second guiding inclined surface 127 of the driven portion 110 of the toner container 100. At this time, a rotational force is applied to the cap 102 by the slope of the guide (the first guiding surface 216 or the second guiding surface 217) of the first driving protrusion 212*a* and the slope of the guiding inclined surface (the first guiding inclined surface 126 or the second guiding inclined surface 127).

As described above, the cap 102 can rotate relative to the container body 101 in the predetermined angular range. Therefore, when the container body 101 is pushed to the downstream side in the insertion direction, the cap 102 in inserted in the container body 101 while being rotated.

When the container body 101 is inserted to a position at which the second driving protrusion 212*b* comes in contact with the driven portion 110, the second driving protrusion 212*b* starts to come in contact with the driven portion 110 that is located opposite to the driven portion 110 in contact with the first driving protrusion 212*a* across the center line. At this time, if the first driving protrusion 212*a* is in contact with the first guiding inclined surface 126 that is a surface of the driven portion 110, the second driving protrusion 212*b* is also in contact with the first guiding inclined surface 126. If the first driving protrusion 212*a* is in contact with the second guiding inclined surface 127, the second driving protrusion 212*b* is also in contact with the second guiding inclined surface 127. The toner container 100 is inserted while the cap 102 is rotated by one of the first guiding inclined surface 126 and the second guiding inclined surface 127 and by the two driving protrusions 212.

More specifically, as a mode of contact between the driven portion 110 and the driving protrusion 212, a first mode will be described, in which the position of the drive transmitted surface 125 and the position of the drive transmission surface 214 in the circumferential direction match each other. In this case, the toner container 100 is inserted as it is, and then fully inserted if the identifiers match each other. If the positions of the identifiers do not match each other, the identifier protrusion group 215 is not inserted in the identifier opening group 111, but comes in contact with a surface in which no opening is provided on the cap 102 on the downstream side in the insertion direction. Therefore, the toner container 100 is not fully inserted.

A second mode will be described, in which the second guiding inclined surface 127 of the toner container 100 first comes in contact with the second guiding surface 217 of the driving protrusion 212 (in particular, the first driving protrusion 212*a*). In this case, the second guiding inclined surface 127 is pressed by the second guiding surface 217, so that the cap 102 of the toner container 100 is inserted while being rotated toward the downstream side in the rotation direction (the direction of the arrow β) of the toner container 100 (or the driving protrusion 212). In other words, the insertion is performed while the guiding inclined surface comes in sliding contact with the driving protrusion. If the identifiers match each other, the identifier opening group 111 is guided to a position at which the identifier protrusion group 215 can be inserted, along with the rotation. Consequently the identifier protrusion group 215 interlock with the identifier opening group 111, and the toner container 100 is fully inserted. In contrast, if the identifiers do not match each other, the cap 102 rotates toward the downstream side in the rotation direction (the direction of the arrow R) of the toner container 100, but the identifier protrusion group 215 is not inserted in the identifier opening group 111 during the insertion. Therefore, the identifier protrusion group 215 comes in contact with a surface in which no opening is provided on the cap 102 on the downstream side in the insertion direction.

A third mode will be described, in which the first guiding inclined surface 126 of the toner container 100 first comes in contact with the first guiding surface 216 of the driving protrusion 212. In this case, the first guiding inclined surface 126 is pressed by the first guiding surface 216, so that the cap 102 of the toner container 100 is inserted while being rotated toward the upstream side in the rotation direction of the toner container 100 (or the driving protrusion 212) (in a direction opposite to the direction of the arrow R). If the identifiers match each other, the identifier opening group 111 is guided to a position at which the identifier protrusion group 215 can be inserted, along with the rotation. Consequently, the identifier protrusion group 215 interlocks with the identifier opening group 111, and the toner container 100 is fully inserted. In contrast, if the identifiers do not match each other, the cap 102 rotates toward the upstream side in the rotation direction of the toner container 100 (in the direction opposite to the direction of the arrow R), but the identifier protrusion group 215 is not inserted in the identifier opening group 111 during insertion. Therefore, the identifier protrusion group 215 comes in contact with a surface in which no opening is provided on the cap 102 on the downstream side in the insertion direction.

As an example in which the identifiers do not match each other as described above, a case will be described in which the positional relationship of the openings of the identifier opening group 111 and the positional relationship of the protrusions of the identifier protrusion group 215 differ from each other. In this case, at least a part of the identifier protrusion group 215 comes in contact with the front end surface of the cap 102, independent of whether the positional relationship of the identifier opening group 111 with respect to the drive transmitted surface 125 and the positional relationship of the identifier protrusion group 215 with respect to the drive transmission surface 214 match each other.

As another example, if the positional relationship of the openings of the identifier opening group 111 and the positional relationship of the protrusions of the identifier protrusion group 215 match each other (the positional relationship in which interlocking is possible), the following operation may be performed. Specifically, at a certain timing of insertion, the identifier protrusion group 215 on the main-body side starts to enter the identifier opening group 111 of the toner container 100 side. However, the vertical surface (the surface parallel to the insertion direction) of each of the protrusions of the identifier protrusion group 215 on the main-body side comes in contact with a contact portion that is a peripheral wall of each of the openings of the identifier opening group 111 on the upstream side in the rotation direction, and prevents further rotation of the cap 102. At this time, the contact portion of each of the openings of the identifier opening group 111 also functions as a rotation restrictor of the cap 102. The cap 102 cannot be fully inserted unless the cap 102 is rotated by causing the driving protrusion to press any of the inclined surfaces. However, because rotation of the cap 102 is restricted, the toner container 100 cannot be fully inserted.

In the latter example as described above, the identifier protrusion group 215 enters the identifier opening group 111 when a difference between the positional relationship of the identifier opening group 111 with respect to the drive transmitted surface 125 and the positional relationship of the identifier protrusion group 215 of the drive transmission surface 214 is smaller than the width of the opening of the identifier opening group 111.

If the drive transmission surfaces 214 of the first driving protrusion 212*a* and the second driving protrusion 212*b* come in contact with the drive transmitted surfaces 125 of the driven portions 110 of the cap 102, the cap 102 is prevented from rotating any further. Thereafter, if the container body 101 is further pushed to the downstream side in the insertion direction, the cap 102 is inserted in a straight manner without being rotated.

Specifically, the position of the cap 102 in the circumferential direction is determined by the first driving protrusion 212*a* and the second driving protrusion 212*b*. In the state in which the position is determined, if the toner container 100 is further inserted, the identifier protrusion group 215 is inserted in the identifier opening group 111 provided on the surface of the cap 102 on the downstream side in the insertion direction (on the front surface side of the toner container 100).

If the positional relationship of the protrusions of the identifier protrusion group 215 with respect to the drive transmission surfaces 214 of the two driving protrusions 212 and the positional relationship of the openings of the identifier opening group 111 with respect to the drive transmitted surface 125 of the cap 102 match each other, the following operation may be performed. Specifically, the protrusions of the identifier protrusion group 215 are inserted in the respective openings of the identifier opening group 111. Therefore, the toner container 100 is inserted into a normal set position (at which the inner cap 106 is detachable).

In contrast, if the positional relationship of the protrusions of the identifier protrusion group 215 with respect to the drive transmission surfaces 214 and the positional relationship of the openings of the identifier opening group 111 with respect to the drive transmitted surfaces 125 do not match each other, the following operation may be performed. Specifically, the protrusions of the identifier protrusion group 215 are not inserted in the openings of the identifier opening group 111. The front ends of the protrusions of the identifier protrusion group 215 on the upstream side in the insertion direction come in contact with portions where the identifier opening group 111 is not provided on the front end surface of the cap 102 that is a surface on the downstream side in the insertion direction. Therefore, the toner container 100 is not inserted any further.

In this state, an upstream end of the toner container 100 in the insertion direction protrudes from the front side of the main body of the image forming apparatus (the upstream side in the insertion direction), so that an operator can recognize that the toner container 100 is not inserted in a proper combination. Further, in this state, the inner cap 106 of the toner container 100 is not opened, so that it is possible to prevent different types of toner (for example, different colors of toner) from being mixed inside the main body of the image forming apparatus.

Second Embodiment

A second mode of the toner container 100 to which the present invention is applied (hereinafter, referred to as a "second embodiment") will be described below. Differences from the first embodiment will be mainly described, and the same explanation will not be repeated appropriately.

Figure 44:
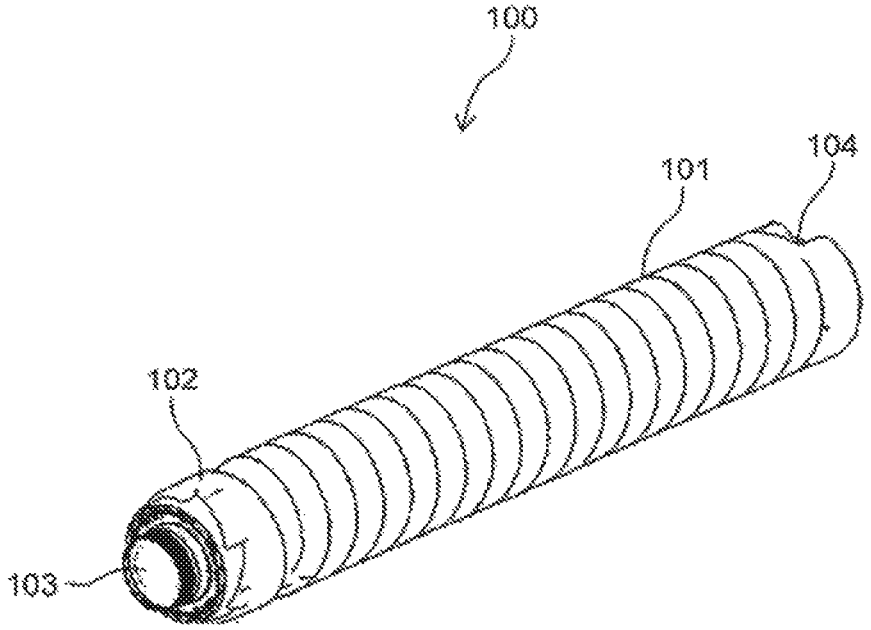
FIG. 44 is an explanatory perspective view of a toner container of a second embodiment when viewed from the downstream side in the insertion direction.
Figure 45:
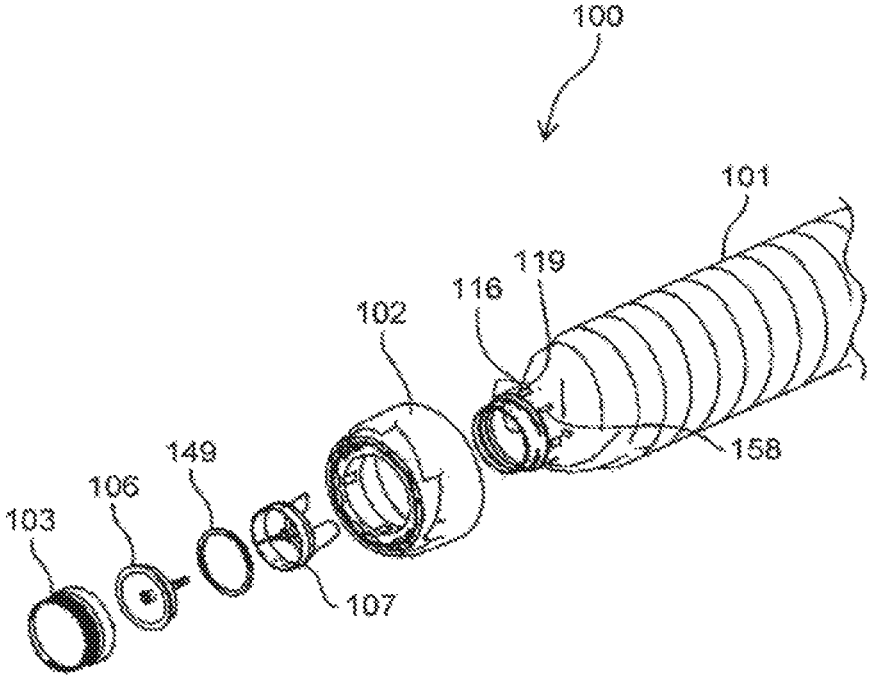
FIG. 45 is an exploded perspective view of the toner container of the second embodiment.

FIG. 44 is an explanatory perspective view of the toner container 100 of the second embodiment when viewed from the downstream side in the insertion direction. FIG. 45 is an exploded perspective view of the toner container 100 of the second embodiment.

As illustrated in FIG. 45, the toner container 100 of the second embodiment includes a ring seal 149 on the inner cap 106.

Figure 46:
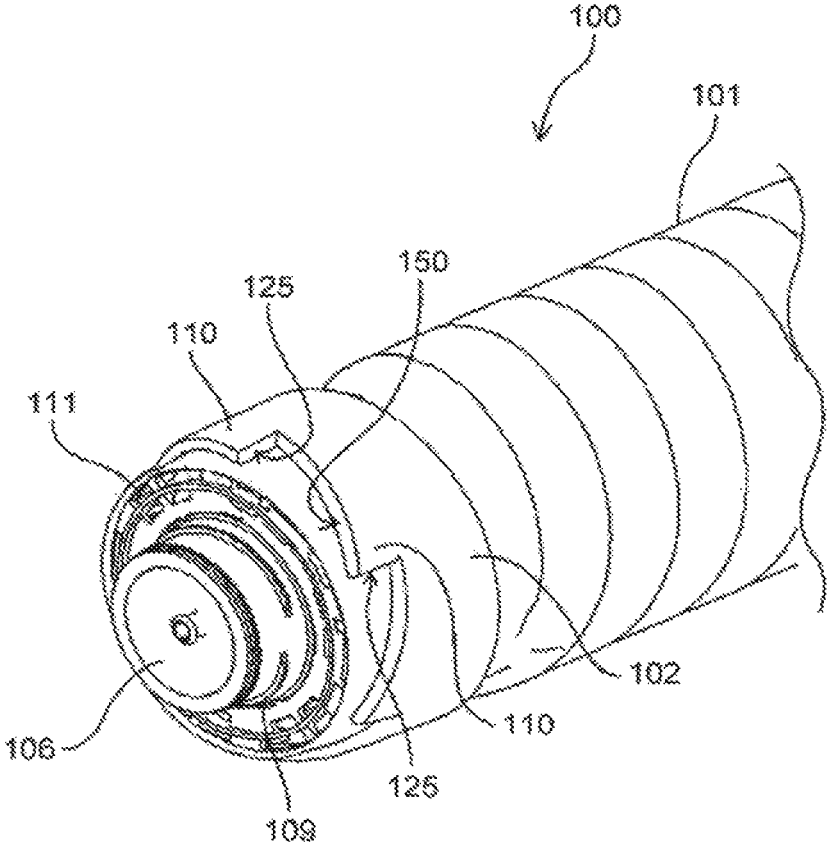
FIG. 46 is an enlarged perspective view of the vicinity of a downstream end of the toner container of the second embodiment in the insertion direction, when an outer cap is detached in the state in FIG. 44.
Figure 47:
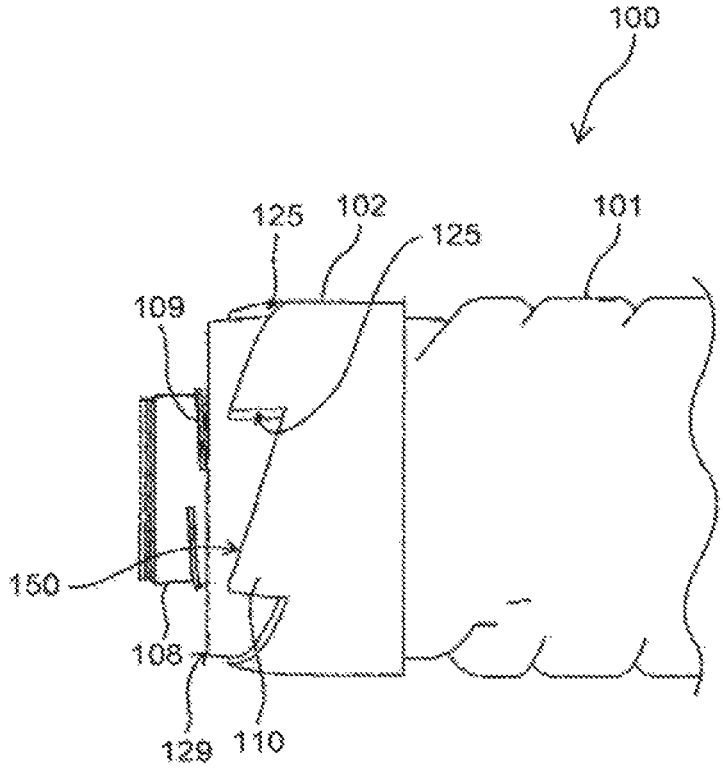
FIG. 47 is an enlarged side view of the vicinity of the downstream end of the toner container of the second embodiment in the insertion direction when the outer cap is detached.

FIG. 46 is an enlarged perspective view of the vicinity of the downstream end of the toner container 100 of the second embodiment in the insertion direction when the outer cap 103 is detached in the state in FIG. 44. FIG. 47 is an enlarged side view of the vicinity of the downstream end of the toner container 100 of the second embodiment in the insertion direction when the outer cap 103 is detached.

Figure 48:
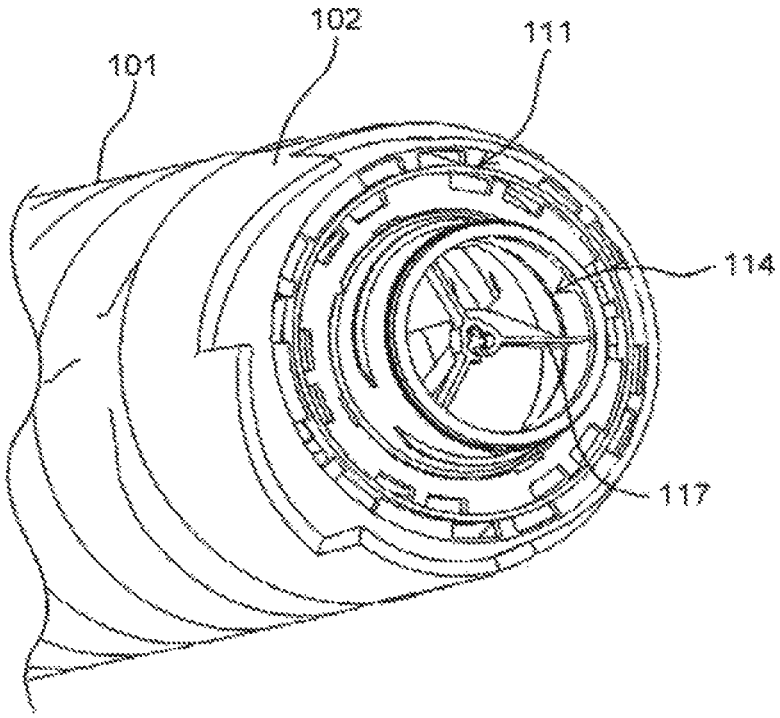
FIG. 48 is an enlarged perspective view of the vicinity of the downstream end of the toner container of the second embodiment in the insertion direction when viewed from an angle at which a discharging member can be checked while an inner cap is detached.
Figure 49:
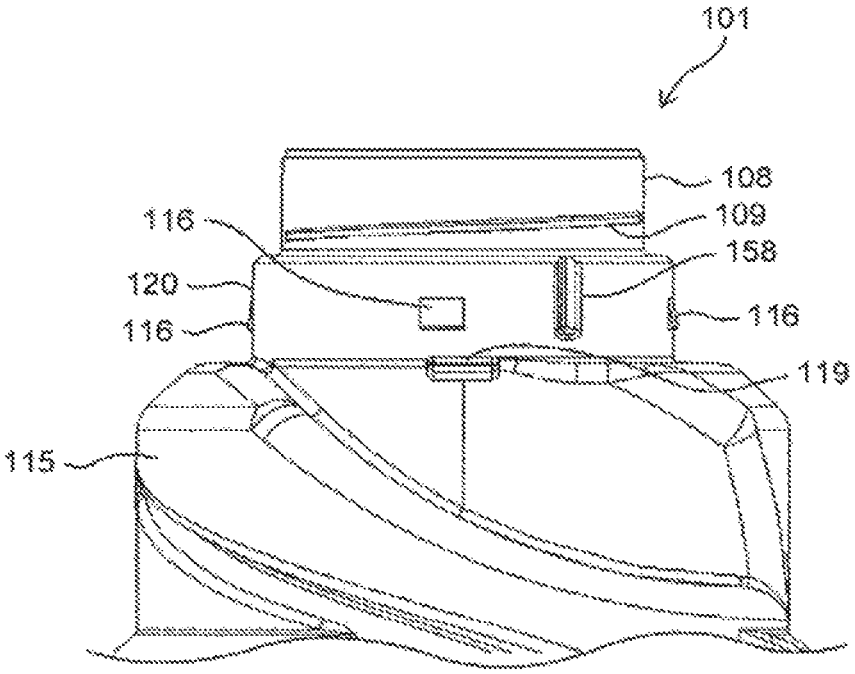
FIG. 49 is an enlarged side view of the vicinity of the downstream end of only the toner container of the second embodiment in the insertion direction.

FIG. 48 is an enlarged perspective view of the vicinity of the downstream end of the toner container 100 of the second embodiment in the insertion direction when viewed from an angle at which the discharging member 107 can be checked while the inner cap 106 is detached. FIG. 49 is an enlarged side view of the vicinity of the downstream end of only the container body 101 of the second embodiment in the insertion direction, in which the downstream side in the insertion direction is oriented upward.

Figure 50:
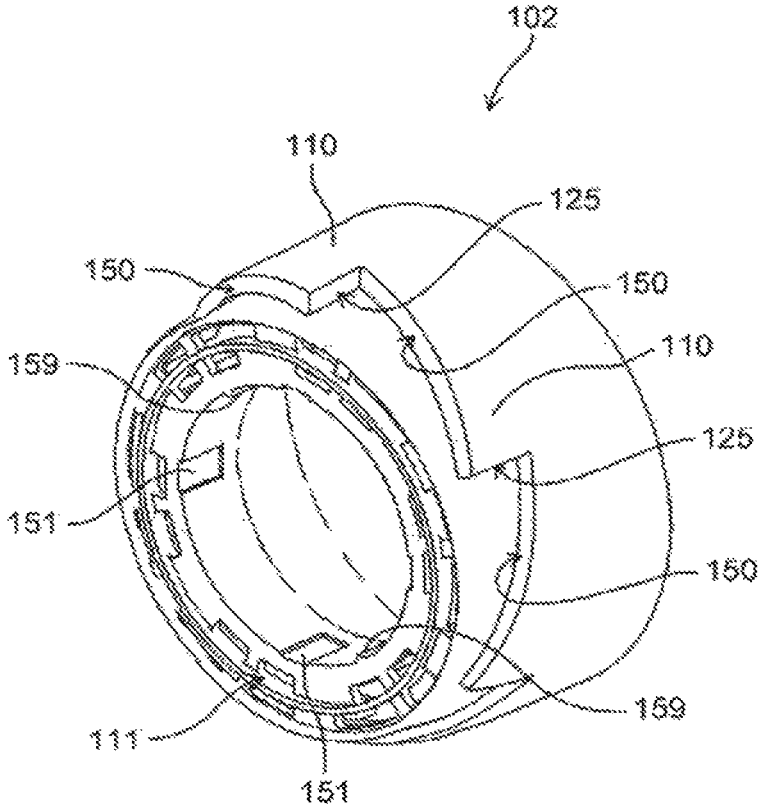
FIG. 50 is a perspective view of a cap of the second embodiment when viewed from other end side (downstream side in the insertion direction).
Figure 51:
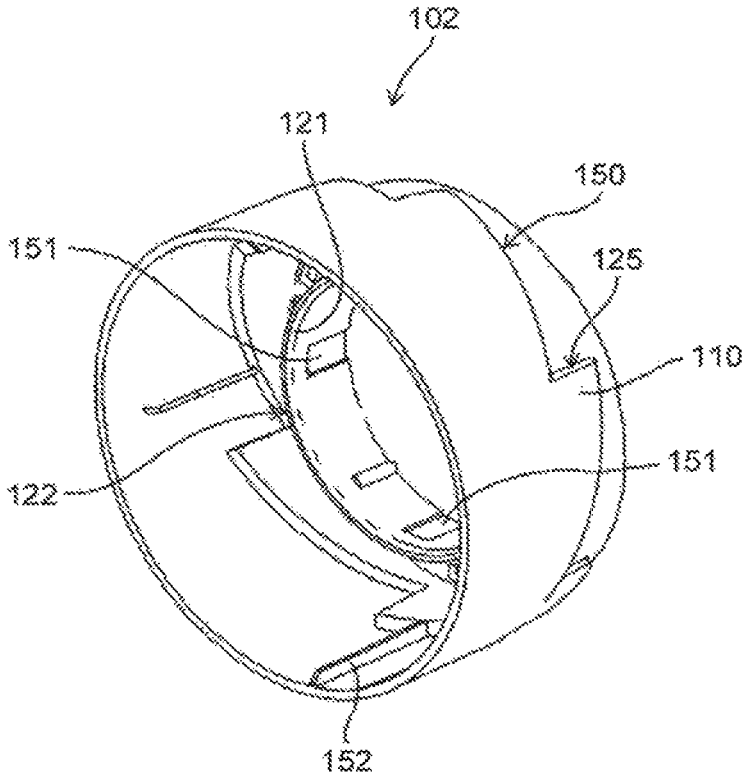
FIG. 51 is a perspective view of the cap of the second embodiment when viewed from one end side (upstream side in the insertion direction).
Figure 52:
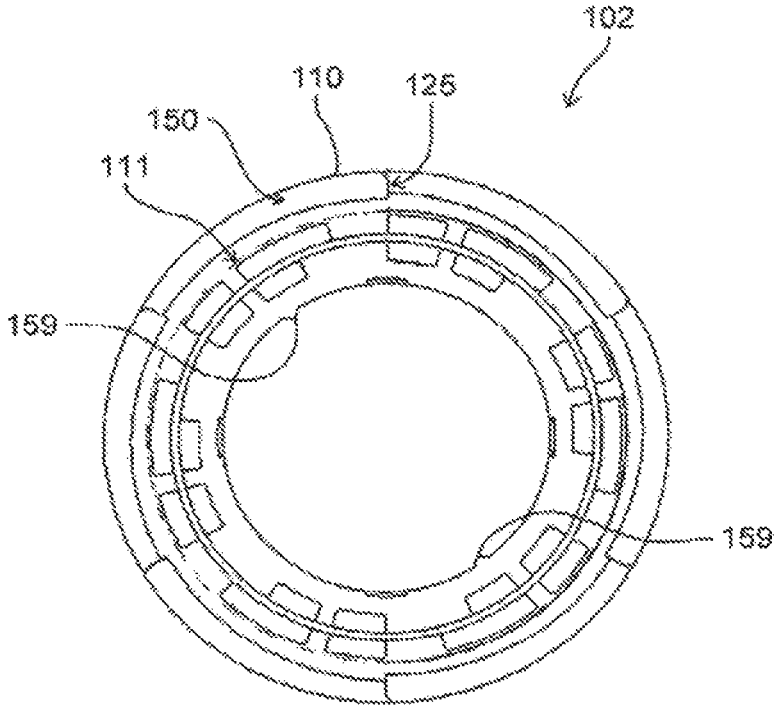
FIG. 52 is a front view of the cap of the second embodiment when viewed from the other end side (downstream side in the insertion direction).

FIG. 50 is a perspective view of the cap 102 of the second embodiment when viewed from the other end side (downstream side in the insertion direction). FIG. 51 is a perspective view of the cap 102 of the second embodiment when viewed from the one end side (upstream side in the insertion direction). FIG. 52 is a front view of the cap 102 of the second embodiment when viewed from the other end side (downstream side in the insertion direction).

The cap 102 of the second embodiment includes an inner peripheral rib 152 on the inner periphery of the outer cylindrical shape to reinforce the outer cylindrical shape.

Figure 53:
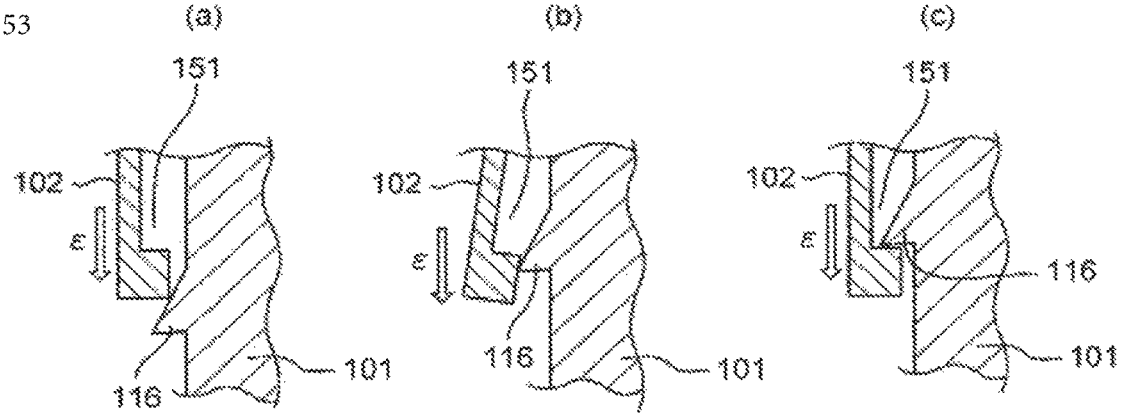
FIG. 53 illustrates schematic cross-sectional views of a cap interlocking portion and a stopper protrusion interlocking with each other.

The cap 102 of the second embodiment includes cap interlocking portions 151 that are recesses on the inner wall surface of the inner cylindrical shape. FIG. 53 illustrates cross-sectional views of the cap interlocking portion 151 of the cap 102 and the stopper protrusion 116 of the container body 101 interlocking with each other. An arrow c in FIG. 53 indicates an attachment direction in which the cap 102 is attached to the container body 101. In FIG. 53, (a) illustrates a state before interlocking; (b) illustrates a state during interlocking; and (c) illustrates a state after interlocking.

When the cap 102 is attached to the container body 101, the stopper protrusion 116 of the container body 101 enters the cap interlocking portion 151, and movement of the cap 102 relative to the container body 101 in the circumferential direction is restricted. Due to the restriction of the movement in the circumferential direction, the cap 102 does not rotate relative to the container body 101, but rotates with the container body 101 in an integrated manner at all times.

In the toner container 100 of the second embodiment, the cap 102 includes V-shaped protrusions 159, and the container body 101 includes V-shaped recesses 158. When the V-shaped protrusions 159 and the V-shaped recesses 158 interlock with each other, the position of the cap 102 in the rotation direction relative to the container body 101 is fixed, so that the cap 102 and the container body 101 are caused to rotate in an integrated manner.

As illustrated in (c) in FIG. 53, when the stopper protrusion 116 enters the cap interlocking portion 151, an edge of the cap interlocking portion 151 is hooked on the stopper protrusion 116 to prevent falling of the cap 102. Further, the axial contact surface 122 of the cap 102 comes in contact with the axial restrictor protrusions 119 of the container body 101 to prevent the cap 102 from further entering the container body 101 side. Due to the interlocking of the stopper protrusions 116 and the contact with the axial restrictor protrusions 119, the position of the cap 102 relative to the container body 101 in the insertion direction (thrust direction with respect to the rotation direction) is fixed. If the positions in the rotation direction and the thrust direction with respect to the rotation direction are fixed, the positional relationship between the container body 101 and the cap 102 is fixed.

The driven portion 110 of the cap 102 of the second embodiment includes the drive transmitted surface 125 extending in the insertion direction, and a guiding inclined surface 150 as an inclined surface or a guide extending in an inclined manner with respect to the insertion direction from an upstream end of the drive transmitted surface 125 to the downstream side in the insertion direction. A downstream end of the guiding inclined surface 150 in the insertion direction is connected to a downstream end of the adjacent drive transmitted surface 125 in the insertion direction.

The driven portion 110 of the cap 102 of the second embodiment has a different shape from that of the driven portion 110 of the first embodiment, but the drive transmitted surface 125 has the same function to receive transmitted drive. The guiding inclined surface 150 has a function to apply a rotational force to the cap 102, similarly to the first guiding inclined surface 126 and the second guiding inclined surface 127 of the first embodiment. The driven portion 110 also has a function to determine the position of the identifier opening group 111 relative to the output driving unit 205 in the circumferential direction.

Figure 54:
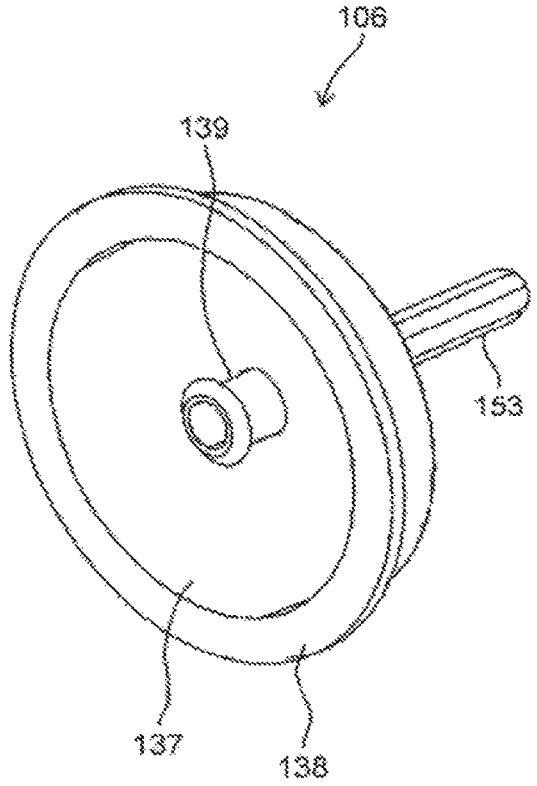
FIG. 54 is a perspective view of an inner cap of the second embodiment when viewed from the downstream side in the insertion direction.
Figure 55:
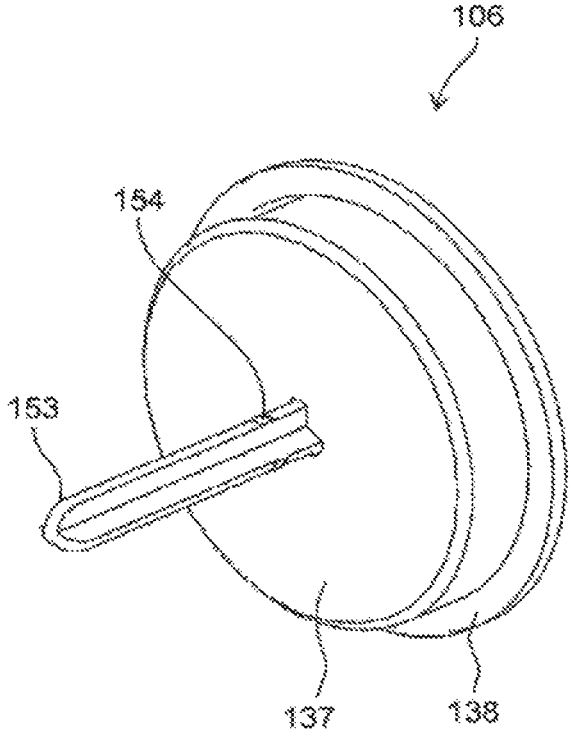
FIG. 55 is a perspective view of the inner cap of the second embodiment when viewed from the upstream side in the insertion direction.
Figure 56:
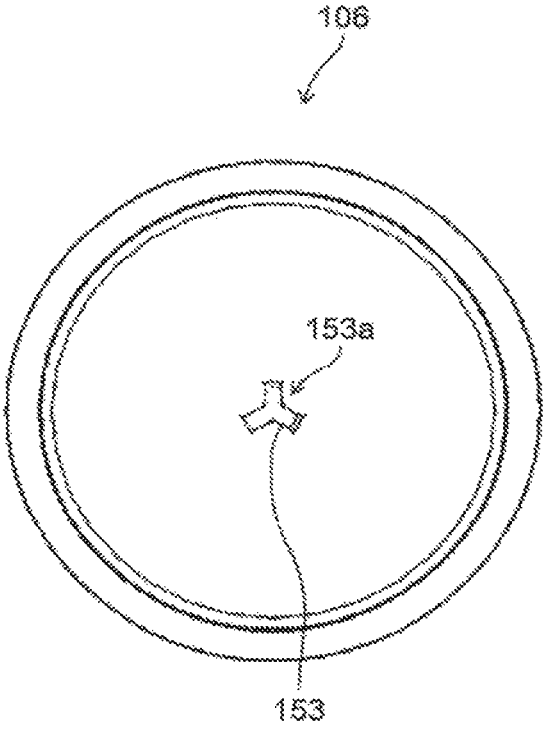
FIG. 56 is a back view of the inner cap of the second embodiment when viewed from the upstream side in the insertion direction.
Figure 57:
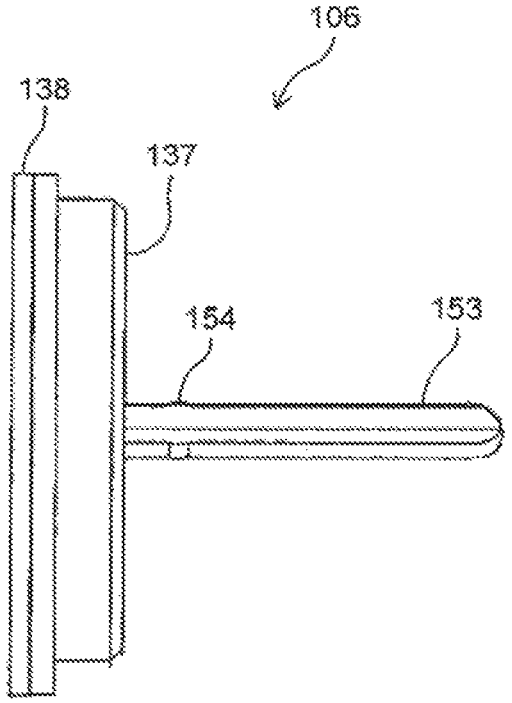
FIG. 57 is a side view of the inner cap of the second embodiment.

FIG. 54 is a perspective view of the inner cap 106 of the second embodiment when viewed from the downstream side in the insertion direction. FIG. 55 is a perspective view of the inner cap 106 of the second embodiment when viewed from the upstream side in the insertion direction. FIG. 56 is a back view of the inner cap 106 of the second embodiment when viewed from the upstream side in the insertion direction. FIG. 57 is a side view of the inner cap 106 of the second embodiment. Similarly to the first embodiment, the inner cap 106 is a cap member that covers the discharge port 114.

The inner cap 106 of the second embodiment includes an inner cap guiding portion 153 protruding from the center of the bottom plate 137 of the inner cap to the upstream side in the insertion direction (to the inside of the container body 101). The inner cap guiding portion 153 is a rod-shaped protrusion, and has a shape so as to radially extend to three sides in the radial direction. The inner cap guiding portion 153 is provided with an inner cap guiding protrusion 154 that protrudes outward in the radial direction. The inner cap guiding protrusion 154 is provided at least on the downstream side in the insertion direction relative to the center of the inner cap guiding portion 153 in the insertion direction.

Figure 58:
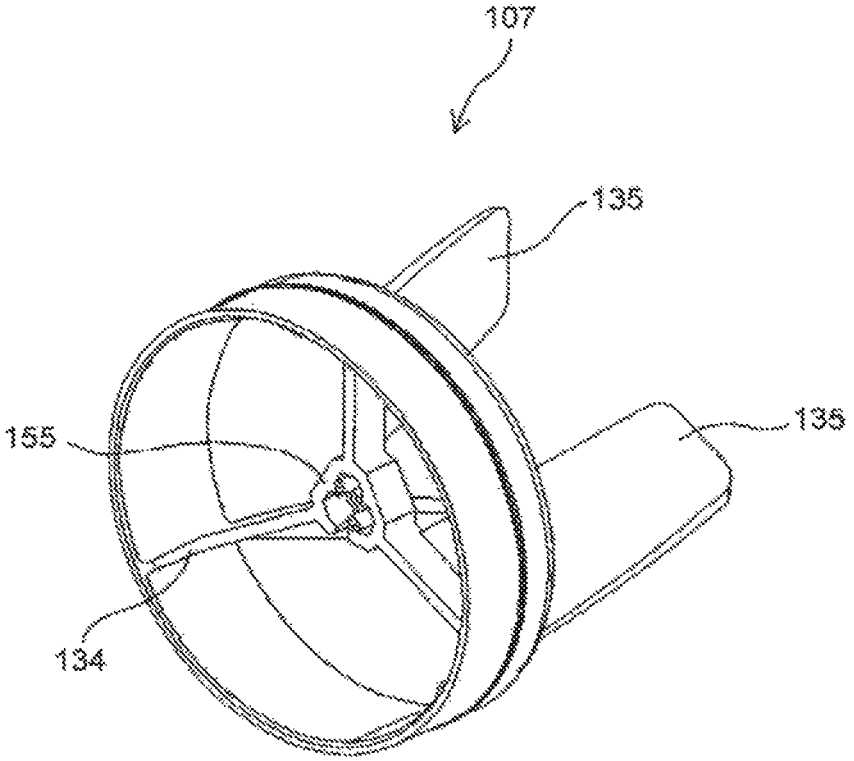
FIG. 58 is a perspective view of the discharging member of the second embodiment when viewed from the downstream side in the insertion direction.
Figure 59:
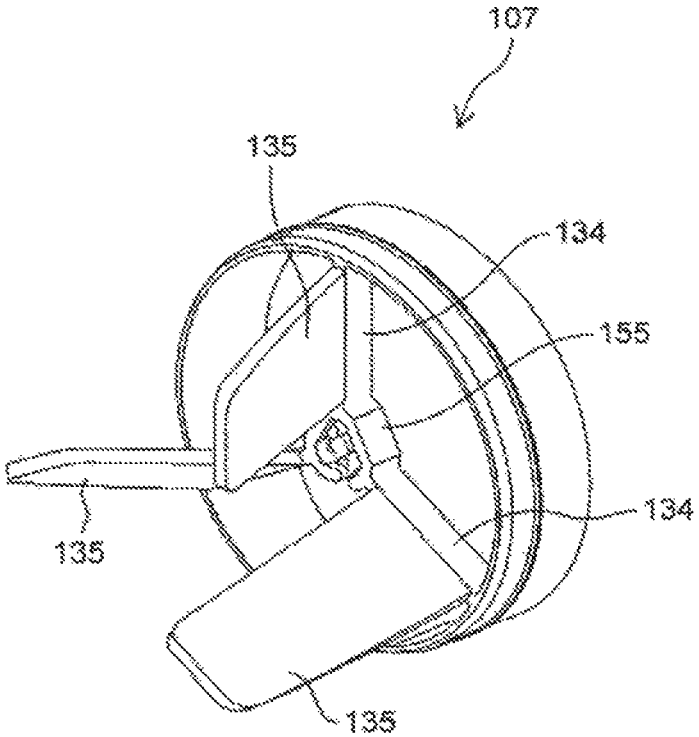
FIG. 59 is a perspective view of the discharging member of the second embodiment when viewed from the upstream side in the insertion direction.
Figure 60:
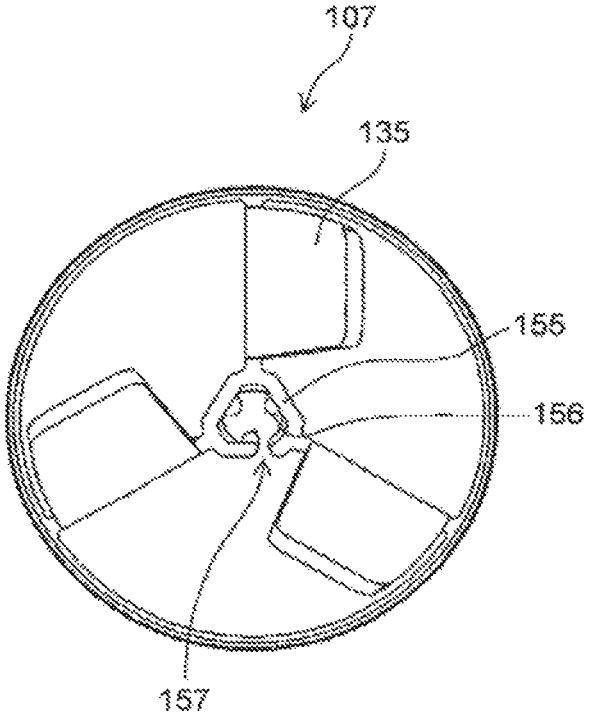
FIG. 60 is a back view of the discharging member of the second embodiment when viewed from the upstream side in the insertion direction.
Figure 61:
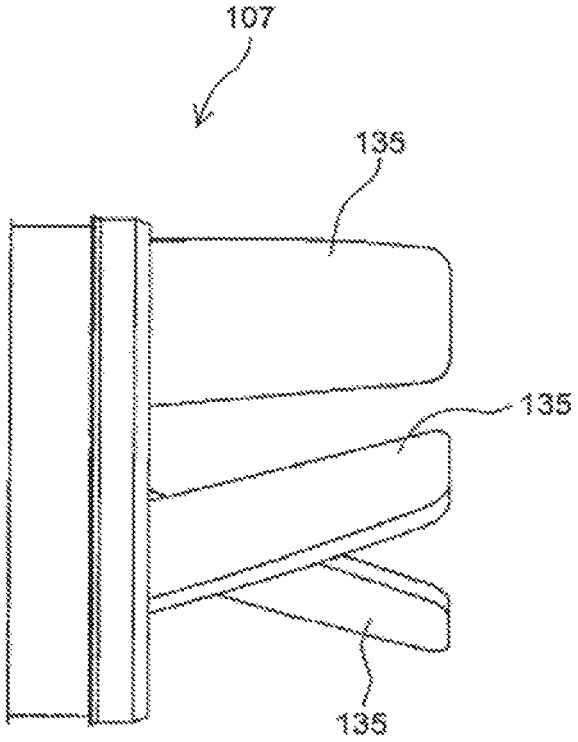
FIG. 61 is a side view of the discharging member of the second embodiment.

FIG. 58 is a perspective view of the discharging member 107 of the second embodiment when viewed from the downstream side in the insertion direction. FIG. 59 is a perspective view of the discharging member 107 of the second embodiment when viewed from the upstream side in the insertion direction. FIG. 60 is a back view of the discharging member 107 of the second embodiment when viewed from the upstream side in the insertion direction. FIG. 61 is a side view of the discharging member 107 of the second embodiment.

A guide holder 155 is provided in the center of the discharging member 107 of the second embodiment. Holder protrusions 156 are provided inside the guide holder 155. A part of the guide holder 155 in the circumferential direction is notched to provide a holder notch 157.

Figure 62:
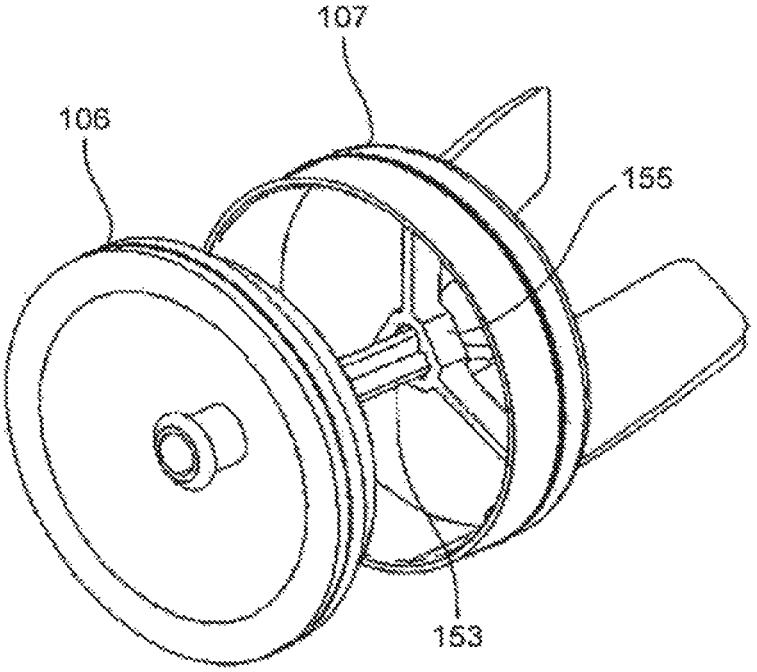
FIG. 62 is a perspective view illustrating a state in which the discharging member and the inner cap of the second embodiment are being interlocked with each other, when viewed from the downstream side in the insertion direction.
Figure 63:
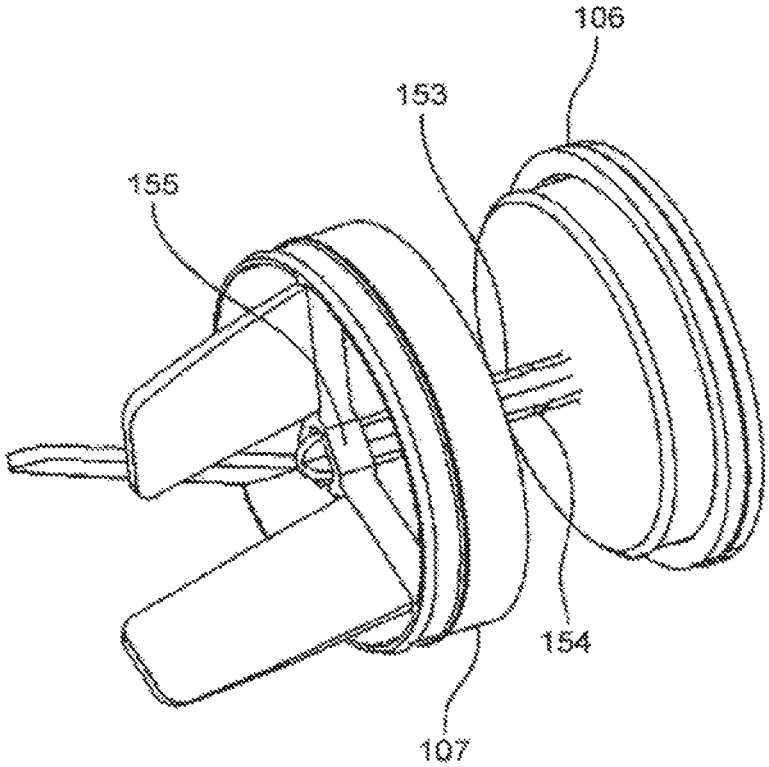
FIG. 63 is a perspective view illustrating a state in which the discharging member and the inner cap of the second embodiment are being interlocked with each other, when viewed from the upstream side in the insertion direction.
Figure 64:
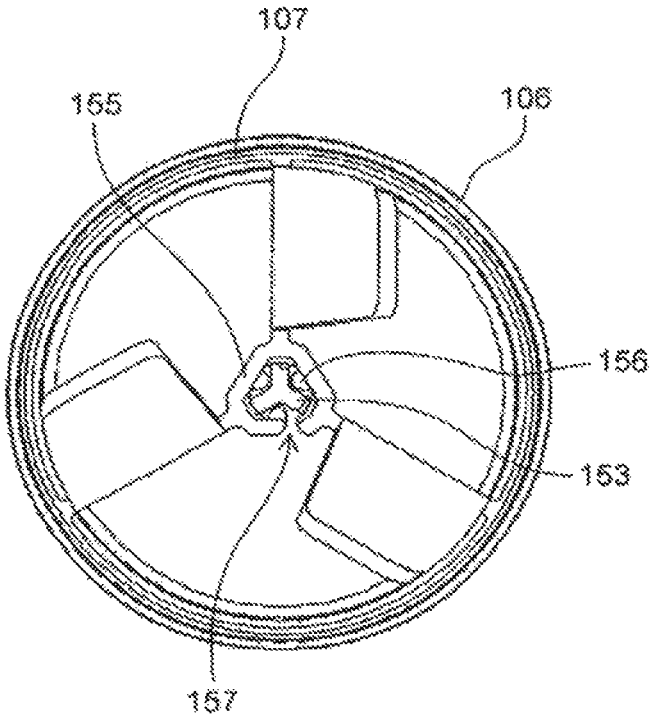
FIG. 64 is a back view illustrating a state in which the discharging member and the inner cap of the second embodiment are interlocked with each other, when viewed from the upstream side in the insertion direction.

FIG. 62 is a perspective view illustrating a state in which the discharging member 107 and the inner cap 106 of the second embodiment are being interlocked with each other, when viewed from the downstream side in the insertion direction. FIG. 63 is a perspective view illustrating a state in which the discharging member 107 and the inner cap 106 of the second embodiment are being interlocked with each other, when viewed from the upstream side in the insertion direction. FIG. 64 is a back view illustrating a state in which the discharging member 107 and the inner cap 106 of the second embodiment are interlocked with each other, when viewed from the upstream side in the insertion direction.

As illustrated in FIGS. 62 and 63, the inner cap guiding portion 153 is inserted in the guide holder 155 of the discharging member 107. At this time, recesses 153*a* of the inner cap guiding portion 153 interlock with the holder protrusions 156.

In the second embodiment, when the toner container 100 is inserted in the main body of the image forming apparatus, when the tab 139 of the inner cap 106 is pulled, and when the inner cap 106 is pulled out of the toner container 100, the inner cap guiding portion 153 is kept interlocking with the guide holder 155. In this state, when the toner container 100 rotates, the rotation of the toner container 100 is transmitted to the inner cap guiding portion 153 via the guide holder 155, and the inner cap 106 rotates simultaneously.

When the inner cap guiding protrusion 154 provided on the inner cap guiding portion 153 passes through the guide holder 155 during attachment of the inner cap 106 to the toner container 100, a click feeling is generated.

In the toner container 100 of the second embodiment, when the inner cap 106 covers the discharge port 114, the ring seal 149 is pressed and a sealing function to prevent toner leakage is realized. The amount of press of the ring seal 149 is determined by the position at which the inner cap guiding protrusion 154 passes through the guide holder 155 upon insertion of the inner cap guiding portion 153 in the guide holder 155. The ring seal 149 is made of an elastic material and is pressed and deformed when the inner cap 106 covers the discharge port 114, so that a force to open the inner cap 106 acts due to the elasticity. At this time, the inner cap 106 is not opened unless the inner cap guiding protrusion 154 comes in contact with the guide holder 155 and a force to cause the inner cap guiding protrusion 154 to pass through the guide holder 155 acts. Therefore, it is possible to maintain the sealed state in which the ring seal 149 is pressed.

Figure 65:
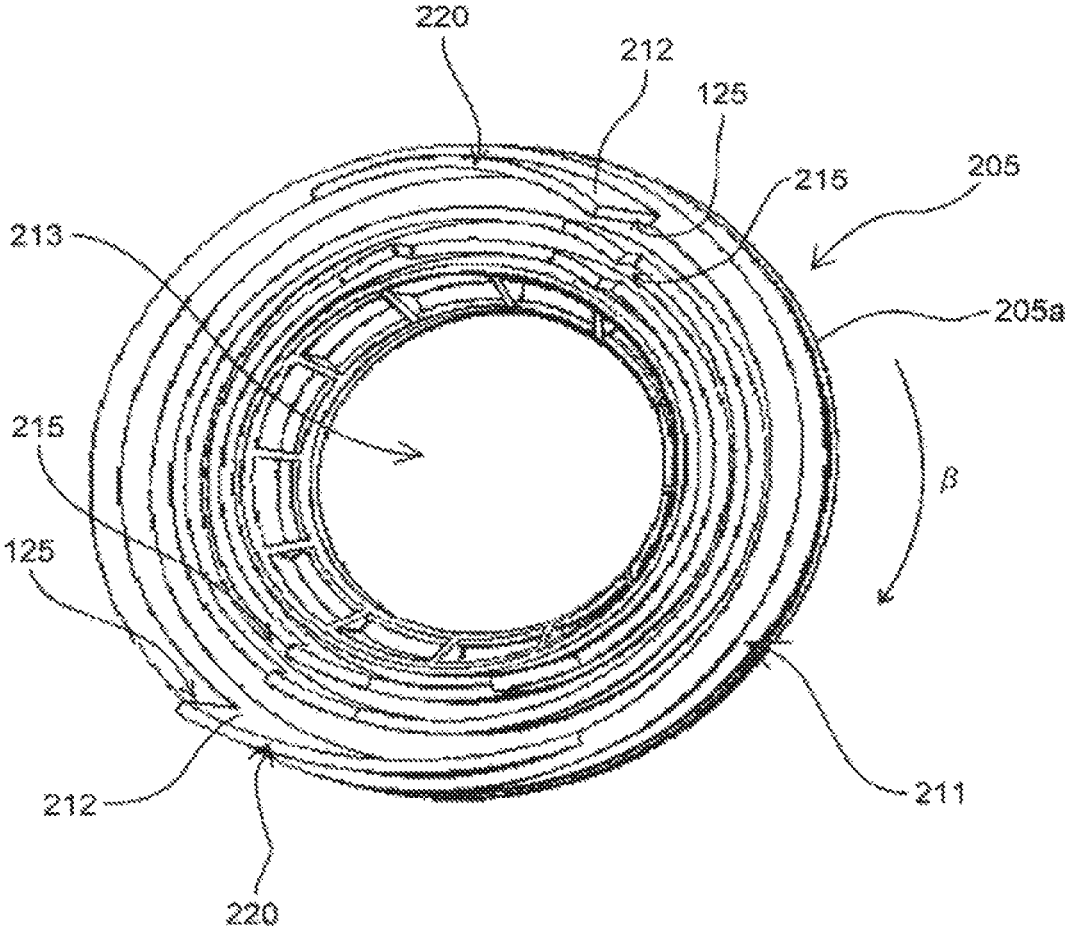
FIG. 65 is a perspective view of an output driving unit of the second embodiment when viewed from the upstream side in the insertion direction.
Figure 66:
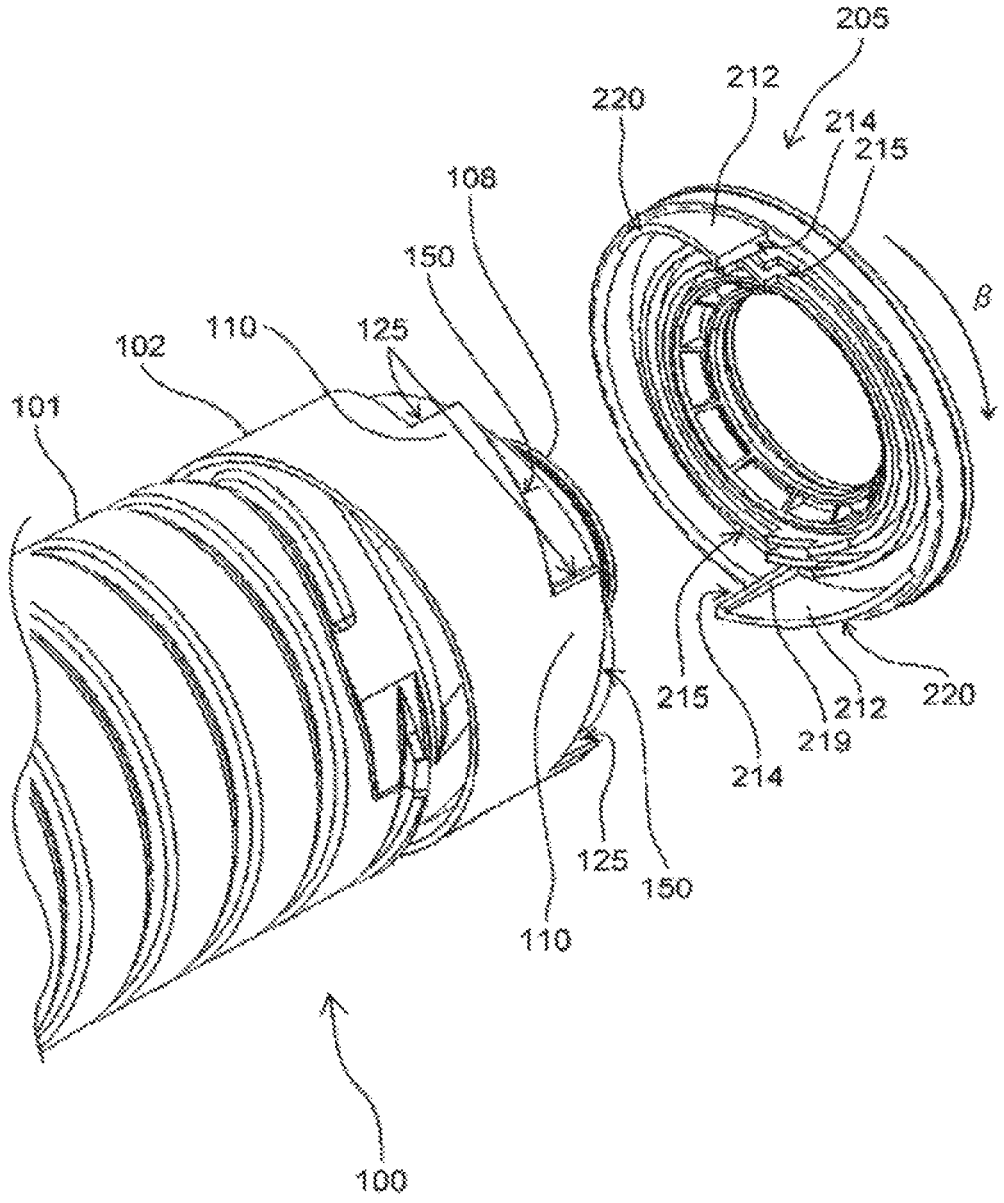
FIG. 66 is a perspective view of the vicinity of the downstream end of the toner container of the second embodiment in the insertion direction and the output driving unit, when viewed from the upstream side in the insertion direction.

FIG. 65 is a perspective view of the output driving unit 205 of the second embodiment when viewed from the upstream side in the insertion direction. FIG. 66 is a perspective view of the vicinity of the downstream end of the toner container 100 of the second embodiment in the insertion direction and the output driving unit 205 when viewed from the upstream side in the insertion direction. The output driving unit 205 of the second embodiment includes the two driving protrusions 212, which have the same shapes and extend to the upstream side in the insertion direction relative to the main body 205*a* of the output driving unit. The container holder 200 is the same as that of the first embodiment except for the shape of the output driving unit 205.

The driving protrusion 212 of the second embodiment protrudes toward the upstream side in the insertion direction relative to the main body 205*a* of the output driving unit, and includes an output guiding surface 220 inclined such that the protrusion amount decreases toward the upstream side in the rotation direction. The drive transmission surface 214 as a wall surface extending along the insertion direction is provided on the side surface of the driving protrusion 212 on the downstream side in the rotation direction. The drive transmission surface 214 presses the drive transmitted surface 125 of the driven portion 110 and functions as the drive transmitting unit.

The output guiding surface 220 has a function as a guide to guide the driven portion 110 such that the drive transmitted surface 125 comes in contact with the drive transmission surface 214 upon contact with the driven portion 110 of the cap 102.

Operation at the time of insertion of the toner container 100 of the second embodiment will be described below.

When the toner container 100 is inserted in the main body of the image forming apparatus while the position of the drive transmitted surface 125 of the driven portion 110 of the toner container 100 of the second embodiment and the drive transmission surface 214 of the output driving unit 205 do not match each other, the following operation is performed. Specifically, in this case, the front end of the driving protrusion 212 of the output driving unit 205 comes in contact with the guiding inclined surface 150 of the driven portion 110 of the toner container 100. At this time, a rotational force is applied to the cap 102 by the slope of the guiding portion (the output guiding surface 220) of the driving protrusion 212 and the slope of the guiding inclined surface 150.

As described above, in the toner container 100 of the second embodiment, the positional relationship between the container body 101 and the cap 102 is fixed. Therefore, when a force to rotate the cap 102 is applied, the container body 101 rotates together with the cap 102. Specifically, the entire toner container 100 is inserted while being rotated.

If the drive transmission surface 214 of the driving protrusion 212 comes in contact with the drive transmitted surface 125 of the driven portion 110 of the cap 102, the toner container 100 is prevented from rotating any further. Thereafter, if the toner container 100 is further pushed to the downstream side in the insertion direction, the toner container 100 is inserted in a straight manner without being rotated.

Specifically, the position of the toner container 100 in the circumferential direction is determined by the driving protrusion 212. In the state in which the position is determined, if the toner container 100 is further inserted, the identifier protrusion group 215 is inserted in the identifier opening group 111 provided on the surface of the cap 102 on the downstream side in the insertion direction (on the front surface side of the toner container 100).

If the positional relationship of the protrusions of the identifier protrusion group 215 with respect to the drive transmission surfaces 214 of the two driving protrusions 212 and the positional relationship of the openings of the identifier opening group 111 with respect to the drive transmitted surface 125 of the cap 102 match each other, the following operation may be performed. Specifically, the protrusions of the identifier protrusion group 215 are inserted in the respective openings of the identifier opening group 111. Therefore, the toner container 100 is inserted into the normal set position (at which the inner cap 106 is detachable).

In contrast, if the positional relationship of the protrusions of the identifier protrusion group 215 with respect to the drive transmission surfaces 214 and the positional relationship of the openings of the identifier opening group 111 with respect to the drive transmitted surfaces 125 do not match each other, the following operation may be performed. Specifically, the protrusions of the identifier protrusion group 215 are not inserted in the openings of the identifier opening group 111. The front ends of the protrusions of the identifier protrusion group 215 on the upstream side in the insertion direction come in contact with portions where the identifier opening group 111 is not provided on the front end surface of the cap 102 that is a surface on the downstream side in the insertion direction. Therefore, the toner container 100 is not inserted any further.

In this state, the upstream end of the toner container 100 in the insertion direction protrudes from the front side of the main body of the image forming apparatus (the upstream side in the insertion direction), so that an operator can recognize that the toner container 100 is not inserted in a proper combination. Further, in this state, the inner cap 106 of the toner container 100 is not opened, so that it is possible to prevent different types of toner (for example, different colors of toner) from being mixed inside the main body of the image forming apparatus.

The toner container 100 of the second embodiment includes the discharge port 114 as an opening provided on the container body 101 to discharge toner, and the inner cap 106 as a cap member that can open and close the discharge port 114. The inner cap 106 is provided with the inner cap guiding portion 153 as a protrusion protruding toward the inside of the container body 101 in the insertion direction that is an opening/closing direction of the inner cap 106. The container body 101 is provided with the discharging member 107 including the guide holder 155 as a supporting member that surrounds and supports the circumference of the inner cap guiding portion 153. The inner cap guiding portion 153 is provided with the inner cap guiding protrusion 154 as a protrusion protruding in a direction perpendicular to the insertion direction. The inner cap guiding protrusion 154 is disposed so as to come in contact with the guide holder 155. When the inner cap 106 is opened or closed, the inner cap guiding protrusion 154 passes through a holding position, at which the guide holder 155 holds the inner cap guiding portion 153, while coming in contact with the guide holder 155.

As illustrated in FIG. 55, the rod-shaped inner cap guiding portion 153 extends to the inside of the container body 101 from the bottom surface of the bottom plate 137 of the inner cap 106 on the upstream side in the insertion direction. As illustrated in FIGS. 62 to 64, the inner cap guiding portion 153 is supported so as to be surrounded by the guide holder 155 provided in the discharging member 107 that is fitted inside the opening portion 108 of the container body 101. The toner container 100 of the second embodiment includes the inner cap guiding protrusion 154 on the outer circumference of the inner cap guiding portion 153. Therefore, the inner cap guiding protrusion 154 passes through the guide holder 155 when the inner cap 106 is opened or closed, and a click feeling is given when the inner cap guiding protrusion 154 passes over the guide holder 155.

As described above, the inner cap guiding protrusion 154 is provided at least on the downstream side in the insertion direction relative to the center of the inner cap guiding portion 153 in the insertion direction. As illustrated in FIG. 57 for example, in the second embodiment, the inner cap guiding protrusion 154 is provided in the vicinity of the base of the inner cap guiding portion 153. By providing the inner cap guiding protrusion 154 in the vicinity of the base of the inner cap guiding portion 153, the guide holder 155 is located on the side close to the discharge port 114, so that it is possible to bring the scooping portions 135 of the discharging member 107 to the side close to the discharge port 114. Consequently, it is possible to improve a toner discharge performance.

After the inner cap guiding portion 153 as a guide enters the guide holder 155, the inner cap guiding protrusion 154 needs to pass over the guide holder 155. Therefore, if the inner cap guiding protrusion 154 is provided on the side close to the front end rather than on the side close to the base of the inner cap guiding portion 153, and if a click feeling is to be given upon pulling and opening the inner cap 106, a pulling distance of the inner cap 106 increases. In this case, the length of the inner cap guiding portion 153 extending from the guide holder 155 increases, and the amount of displacement (oscillation) of the inner cap 106 about the guide holder 155 increases. When a certain external force is applied and the inner cap 106 is greatly displaced and inclined with respect to the toner container 100, and if the inner cap 106 is pushed toward the toner container 100 so as to be closed, the longitudinal direction of the inner cap guiding portion 153 and the pushing direction do not match each other. Therefore, when the toner container 100 is detached from the apparatus main-body, the inner cap 106 may not be closed normally even if the inner cap 106 is pushed into the toner container 100. In the second embodiment, by providing the inner cap guiding protrusion 154 in the vicinity of the base of the inner cap guiding portion 153, it is possible to prevent the inner cap 106 from being greatly inclined with respect to the toner container 100, enabling to prevent a situation in which the inner cap 106 is not normally closed.

If a load applied to the interlocked portion between the guide holder 155 of the discharging member 107 and the inner cap guiding portion 153 of the inner cap 106 increases, toner accumulated in the interlocked portion may be compressed and aggregated. In the toner container 100 of the second embodiment, as illustrated in FIG. 60, the holder notch 157 is provided on a supporting rod portion of the guide holder 155. Therefore, it is possible to increase the diameter of the interlocked portion between the guide holder 155 and the inner cap guiding portion 153, so that toner is less likely to be accumulated and a load applied to the toner is reduced. Consequently, it is possible to realize a configuration in which aggregation is less likely to occur.

If the guide holder 155 does not have the notch, it is difficult to deform the guide holder 155 upon passage of the inner cap guiding protrusion 154. If the guide holder 155 is formed in a shape such that a gap for passage of the inner cap guiding portion 153 is increased and the guide holder 155 is not deformed upon passage of the inner cap guiding protrusion 154, it is difficult to give a click feeling. In contrast, if the gap for passage of the inner cap guiding portion 153 is reduced in order to give a click feeling, the click feeling can be given. However, if it is difficult to deform the guide holder 155 upon passage of the inner cap guiding protrusion 154, a necessary force for passage of the inner cap guiding protrusion 154 increases.

In contrast, if the notch is provided in the guide holder 155, it becomes easier to deform the guide holder 155 upon passage of the inner cap guiding protrusion 154. Therefore, even if a force to move the inner cap 106 is relatively small, it is possible to cause the inner cap guiding protrusion 154 to pass through the guide holder 155 and give a click feeling.

The guide holder 155 of the discharging member 107 is provided with the holder protrusions 156 serving as rotation stoppers of the inner cap 106. If the inner cap 106 is allowed to rotate relative to the guide holder 155, the inner cap guiding portion 153 slides against the guide holder 155 and toner located in the sliding portion may be aggregated. As illustrated in FIG. 64, the holder protrusions 156 are fitted in gaps between three portions of the inner cap guiding portion 153 radially extending in the radial direction, so that the inner cap 106 is prevented from rotating relative to the guide holder 155. Therefore, it becomes possible to prevent the inner cap guiding portion 153 from sliding against the guide holder 155, enabling to prevent toner aggregation.

Figure 67:
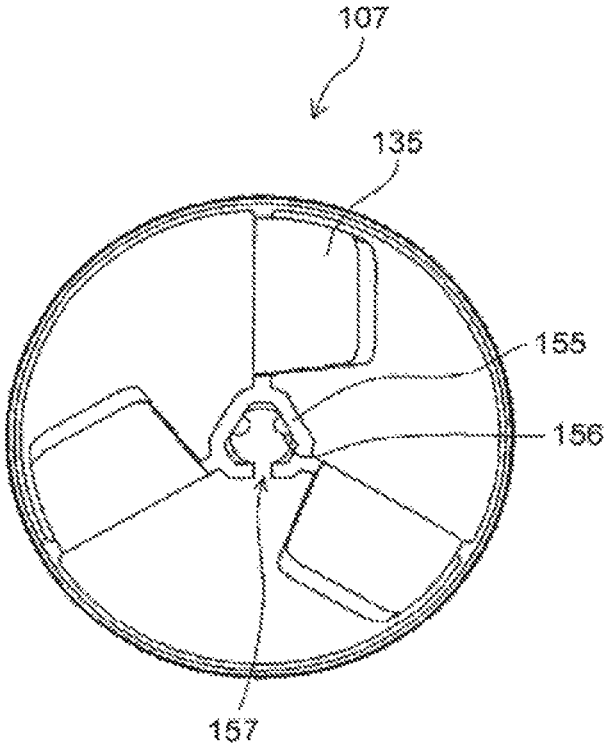
FIG. 67 is a back view of the discharging member with a holder notch in the center of a supporting rod of the guide holder of the second embodiment, when viewed from the upstream side in the insertion direction.

As the position of the holder notch 157, as illustrated in FIG. 67, it may be possible to provide the holder notch 157 in the center of the supporting rod of the guide holder 155. However, in the configuration in which the holder notch 157 is provided in the center of the supporting rod of the guide holder 155, one of the three radially extending portions of the inner cap guiding portion 153 of the inner cap 106 may enter the holder notch 157 when the inner cap 106 is attached. Further, because the holder notch 157 is located in the center of the supporting rod of the guide holder 155, the holder protrusions 156 serving as the rotation stoppers are provided at only two positions, so that it may be difficult to ensure an adequate allowance for idle rotation of the inner cap 106.

In contrast, as illustrated in FIG. 60, if the position of the holder notch 157 is shifted from the center of the supporting rod, it becomes possible to regulate the insertion direction of the inner cap 106 at a specified position and increase the number of the rotation stoppers. Consequently, it becomes possible to enhance the allowance for idle rotation.

The toner container 100 of the above-described first embodiment includes the container body 101 for storing toner, and the outer cap 103 as a cap member for covering the discharge port 114 that is the opening to discharge the toner from the container body 101. At a certain position on the outer cap 103 where a front end of the opening portion 108 serving as the discharge port 114 faces a cover portion of the outer cap 103 covering the discharge port 114, the inner protrusion 146 is provided as a protrusion protruding toward the front end of the opening portion 108 from the cover portion of the outer cap 103. The outer cap 103 is also provided with the air hole 147 that is a recess with a shorter height than the inner protrusion 146 of the outer cap.

If there is no gap between the outer cap 103 and the front end of the opening portion 108, it is impossible to introduce and discharge gas to and from the container body 101. If the gas is not introduced and discharged to and from the container body 101, a pressure difference occurs between the inside of the container body 101 and the atmosphere in a high-altitude place where the atmospheric pressure is low. The inner cap 106 does not fall before the outer cap 103 is opened because the inner cap 106 is pressed by the outer cap 103. However, if the outer cap 103 is removed, the inner cap 106 may fall out and the toner may be scattered due to an atmospheric pressure difference. Even in a place other than the high-altitude place, if a temperature change from a low temperature to a high temperature is large, gas inside the container body 101 expands, so that when the outer cap 103 is removed, the inner cap 106 may fall out and the toner may be scattered due to the internal pressure.

In the toner container 100 of the first embodiment, the air hole 147 is provided to ensure an air passage between the outer cap 103 and the front end of the opening portion 108. The inner cap vent 141 is provided on the inner cap 106. In this manner, by providing the air passage between the outer cap 103 and the inner cap 106, air is moderately introduced and discharged, and an atmospheric pressure difference between the inside and the outside of the container body 101 is alleviated. Therefore, it is possible to prevent the inner cap 106 from falling out and prevent the toner from being scattered due to the internal pressure of the container body 101.

The same configuration is applicable to the outer cap 103 and the inner cap 106 of the second embodiment.

The toner container 100 of the first embodiment includes the container body 101 for storing toner, and the cap 102 as a driven unit provided with the driven portion 110 serving as a driving unit that receives a driving force output from the main body of the image forming apparatus in order to rotate the container body 101. The cap 102 is rotatable relative to the container body 101 around the rotation axis of the container body 101. The circumferential restrictor protrusions 117 serving as rotation restrictors for restricting the cap 102 from rotating by a certain amount or greater are provided on the container body 101.

If the cap 102 is fixed on the container body 101, an operator needs to rotate the container body 101 for positioning to interlock the driven portion 110 of the cap 102 with the output driving unit 205 serving as a main-body driving unit of the image forming apparatus. In contrast, if the cap 102 is freely rotatable relative to the container body 101, it is difficult to transmit drive from the output driving unit 205 to the container body 101 via the cap 102. Therefore, in the toner container 100 of the first embodiment, the circumferential restrictor protrusions 117 are provided as restrictors that allow the cap 102 to rotate in a certain range but restrict rotation exceeding the certain range. Consequently, it is possible to ensure the drive transmission and simplify the operation of the operator.

The toner container 100 of the first embodiment is provided with the stopper protrusions 116, which serve as members that prevent movement in a direction parallel to the insertion direction to prevent falling and which are provided at four positions in the circumferential direction on the container body 101. The circumferential restrictor protrusions 117 for rotation restriction are provided at two positions in the circumferential direction so as to separate a fall preventing function and a rotation preventing function.

To prevent erroneous setting by using the function of the identifier opening group 111 of the cap 102, it is important to stabilize the posture of the cap 102 relative to the container body 101. Therefore, to restrict relative movement in the thrust direction (direction parallel to the insertion direction), at least three restricting portions, and more preferably, four or more restricting portions are needed.

However, if a restricting member (protruding shape or the like) in the thrust direction also has a function of rotation restriction, the rotatable angle of the cap 102 is reduced. Specifically, if the restricting members are provided at four positions in the circumferential direction, the rotatable angle of the cap 102 is set to "90°−{(the width of the restricting member of the cap 102)+(the width of the restricting member of the container body 101)}".

When the toner container 100 is shipped, even if the position of the cap 102 relative to the container body 101 in the rotation direction is located close to the position on an evacuation side where the rotatable range is maximized at the time of insertion of the toner container 100, the position in the rotation direction may be shifted before setting. For example, due to oscillation during transportation or contact of an operator with the cap 102 during setting of the toner container 100, the position of the cap 102 relative to the container body 101 in the rotation direction may be shifted.

When the restricting members with the functions of rotation restriction are provided at four positions, even if the position of the cap 102 in the rotation direction is located close to the position on the evacuation side at the time of shipment of the toner container 100, an allowance for the rotatable range at the time of setting is reduced if the position is shifted before the setting.

In contrast, in the toner container 100 of the first embodiment, the fall preventing function and the rotation preventing function are separated.

By providing the stopper protrusions 116 with the fall preventing functions at four positions in the circumferential direction, it is possible to ensure the stability of the posture of the cap 102 relative to the container body 101. The stopper protrusions 116 are configured to hook on the ring-shaped stopper rib 121 provided on the inner periphery of the cap 102, and do not function for restriction in the rotation direction.

By providing the circumferential restrictor protrusions 117 with the rotation preventing functions at two positions in the circumferential direction, the rotatable angle of the cap 102 is set to "180°−{(the width of a rotation restricting member of the cap 102)+(the width of a rotation restricting member of the container body 101)}". Therefore, the rotatable range of the cap 102 relative to the container body 101 increases, and an allowance for the rotatable range at the time of setting is increased.

In the toner container 100 of the first embodiment, the circumferential restrictor contact protrusions 123 serve as "the rotation restricting member of the cap 102", and the circumferential restrictor protrusions 117 serve as "the rotation restricting member of the container body 101".

The toner container 100 of the first embodiment is a toner container attached to the main body of the image forming apparatus including the output driving unit 205. The output driving unit 205 serves as the driving unit for transmitting drive to the toner container 100 and protrudes toward the toner container 100. The toner container 100 includes the container body 101 for storing toner, and the driven portion 110 as the driven unit that receives drive from the main body of the image forming apparatus.

The driven portion 110 includes the drive transmitted surface 125 as a drive transmitted part that protrudes in the radial direction of the toner container 100 and that receives a driving force upon contact with the output driving unit 205. The driven portion 110 further includes the first guiding inclined surface 126 as a first inclined surface that faces the drive transmitted surface 125 and is inclined toward the output driving unit 205 with respect to the protruding direction of the output driving unit 205. The driven portion 110 further includes the second guiding inclined surface 127 as a second inclined surface that is inclined toward the first guiding inclined surface 126 with respect to the protruding direction of the driven portion 110 on the front side of the driven portion 110 in the protruding direction (a downstream end in the insertion direction) relative to the drive transmitted surface 125.

As illustrated in FIG. 20 for example, the driven portion 110 of the cap 102 of the first embodiment includes the first guiding inclined surface 126 with a relatively long slope and the second guiding inclined surface 127 with a slope shorter than the first guiding inclined surface 126, across the downstream end in the insertion direction. The first guiding inclined surface 126 and the second guiding inclined surface 127 are inclined in opposite directions across the driven portion 110. Therefore, the rotation direction of the cap 102 varies depending on which of the guiding inclined surfaces comes in contact with the front end of the first driving protrusion 212*a* of the output driving unit 205 at the time of insertion. Specifically, when the first guiding inclined surface 126 comes in contact with the front end of the first driving protrusion 212, and if the toner container 100 is further pushed, the cap 102 rotates in a direction opposite to the rotation direction of driving operation (the direction of the arrow β in the figure). In contrast, when the second guiding inclined surface 127 comes in contact with the front end of the first driving protrusion 212*a*, and if the toner container 100 is further pushed, the cap 102 rotates in the same direction as the rotation direction of driving operation (the direction of the arrow β in the figure).

If the slope of the guiding inclined surface (the first guiding inclined surface 126 and the second guiding inclined surface 127) that guides the position of the front end of the driving protrusion 212 relative to the driven portion 110 becomes stepper with respect to a plane perpendicular to the center line, a rotational force acts more easily upon contact with the front end of the driving protrusion 212. In other words, with a smaller acute angle of the guiding inclined surface with respect to the insertion direction, the amount of rotation relative to the amount of insertion is reduced. Therefore, a force to insert the cap 102 in a rotating manner can be reduced, and an operator can perform operation easily.

In the configuration in which a contact portion between the main body of the image forming apparatus and the toner container 100 is located on the rear side, that is, on the downstream side in the insertion direction, it is preferable that the driven portion 110 as a joint part shape does not protrude from the outer shape of the container body 101 to ensure the function of supporting the posture of the toner container 100. In the toner container 100 of the first embodiment, to ensure a large toner storage capacity of the container body 101, the drive transmitted surface 125 of the driven portion 110 is formed in a shape cut into in the radial direction toward the center side relative to a front side surface (the outer periphery of the cap 102).

To smoothly rotate the cap 102 in the setting operation (to enable setting with a small operating force), it is preferable that the guiding inclined surface is inclined by the smallest possible acute angle with respect to the center line of the toner container 100.

However, as in the toner container 100 of the second embodiment, if the single driven portion 110 has only a single guiding inclined surface, the following issue may arise.

Specifically, if the number of equal divisions in the angular direction of the cap 102 (the number of the driven portions 110) is reduced to ensure an allowance for arrangement of the identifier opening groups 111 on the front end surface of the cap 102 in the insertion direction, the length of the guiding inclined surface in the insertion direction increases. Therefore, to arrange the drive transmitted surface 125 of the driven portion 110, it becomes necessary to increase the length of a portion where the outer diameter of the front end of the toner container 100 is reduced. Consequently, the toner storage capacity is reduced.

In contrast, if the number of equal divisions in the angular direction of the cap 102 (the number of the driven portions 110) is increased to ensure the toner storage capacity, the following issue may arise. Specifically, it becomes difficult to provide the identifier opening group 111 as a single identifier recess group formed of a plurality of openings, and it becomes difficult to ensure an allowance for arrangement of identifier portions having identifier functions on the toner container 100 side. If the allowance for arrangement of the identifier portions is not ensured, it is necessary to consider a design to reduce the number of identifier types in order to ensure the function of preventing erroneous setting.

As a configuration that meets three demands to obtain an acute angle as the inclined angle of the guiding inclined surface, to reduce the number of equal divisions in the angular direction, and to ensure the toner storage capacity of the container body 101, the toner container 100 of the first embodiment includes the first guiding inclined surface 126 and the second guiding inclined surface 127 that are inclined in different directions.

The inclined angle of the first guiding inclined surface 126 with respect to the center line of the toner container 100 is greater than that of the second guiding inclined surface 127.

Before the toner container 100 is set, the position of the cap 102 relative to the container body 101 in the rotation direction may be at an evacuation position at which the cap 102 is fully rotated in a direction opposite to the rotation direction estimated at the time of setting, in order to ensure an allowance for rotation at the time of setting.

The rotation direction estimated at the time of setting is a direction of a rotational force that acts on the cap 102 upon pushing the toner container 100 in the insertion direction while the driving protrusion 212 is in contact with the first guiding inclined surface 126. Specifically, in FIG. 4, when the container body 101 is not moved, the rotation direction estimated at the time of setting is a direction opposite to the direction of the arrow R in FIG. 4. Therefore, in the toner container 100 of the first embodiment, the evacuation position of the cap 102 is a position at which the cap 102 is fully rotated in the direction of the arrow R in FIG. 4 when the container body 101 is not moved.

When the toner container 100 is inserted in the main body of the image forming apparatus while the cap 102 is located at the evacuation position, and if the driving protrusion 212 comes in contact with the first guiding inclined surface 126, the cap 102 rotates in the direction opposite to the direction of the arrow R in FIG. 4. In contrast, when the driving protrusion 212 comes in contact with the second guiding inclined surface 127 while the cap 102 is located at the evacuation position, a rotational force to cause rotation in the direction of the arrow R in FIG. 4 acts on the cap 102. However, the cap 102 is already fully rotated in the direction of the arrow β relative to the container body 101, and the rotation relative to the container body 101 in this direction is restricted. Therefore, the cap 102 cannot independently rotate relative to the container body 101. Consequently, when the cap 102 is rotated to adjust the position of the drive transmission surface 214 of the main body of the image forming apparatus and the position of the drive transmitted surface 125 of the toner container 100, the container body 101 is rotated together.

The inclined angle of the second guiding inclined surface 127 with respect to the center line is set to a small angle. Therefore, the cap 102 and the container body 101 can be rotated integrally and set at predetermined positions by being guided by the second guiding inclined surface 127 with an operating force to push the toner container 100.

The toner container 100 of the first embodiment includes the first guiding inclined surface 126 with the greatest guiding inclined surface, and the second guiding inclined surface 127 provided on the front end of the driven portion 110 in the insertion direction. Therefore, it is possible to easily guide the drive transmission surface 214 of the output driving unit 205 to the drive transmitted surface 125 of the driven portion 110.

On the main body of the image forming apparatus provided with the output driving unit 205 serving as the drive transmitting unit for transmitting drive to the toner container 100 of the first embodiment, the output driving unit 205 includes the two driving protrusions 212 as two or more protrusions protruding toward the upstream side in the insertion direction. The protrusion amount of the first driving protrusion 212*a* that is one of the two protrusions is greater than the protrusion amount of the second driving protrusion 212*b* that is the other one of the two protrusions. Specifically, the driving protrusions 212 of the output driving unit 205 are configured to have different protrusion amounts.

When the driven portion 110 as a bottle joint and the driving protrusion 212 as a driving protruding part of the main body of the image forming apparatus start to come in contact with each other in the insertion operation of the toner container 100, the contact position may be in the vicinity of the downstream end of the driven portion 110 in the insertion direction by coincidence. At this time, in particular, when the two guiding inclined surfaces inclined in different directions across the downstream end of the driven portion 110 in the insertion direction are provided as in the toner container 100 of the first embodiment, and if the two or more driving protrusions 212 simultaneously start to come in contact with the guiding inclined surfaces, rotational forces in different directions may act. This is because, if the center on the toner container 100 side and the center on the output driving unit 205 side do not completely coincide each other, the two driving protrusions 212 may come in contact with the different types of the guiding inclined surfaces. Specifically, one of the two driving protrusions 212 may come in contact with the first guiding inclined surface 126 and the other may come in contact with the second guiding inclined surface 127.

The first guiding inclined surface 126 and the second guiding inclined surface 127 generate rotational forces in opposite directions when the toner container 100 is further inserted after the inclined surfaces come in contact with the driving protrusions 212. Therefore, if the insertion is further performed while the two driving protrusions 212 are in contact with the first guiding inclined surface 126 and the second guiding inclined surface 127, respectively, the rotational forces act in opposite directions, which causes a hooked state resulting in a setting failure.

As a configuration to prevent a setting failure as described above, the main body of the image forming apparatus, in which the toner container 100 of the first embodiment is to be set, is configured to cause the first driving protrusion 212*a* that is one of the two driving protrusions 212 to first make contact to determine the rotation direction of the cap 102.

After the cap 102 rotates by a predetermined angle by being guided by the first driving protrusion 212*a* as one of the protrusions, the first driving protrusion 212*a* as the other one of the protrusions also comes in contact with the cap 102. At this time, the two driving protrusions 212 come in contact with the same type of the guiding inclined surfaces of the two driven portions 110, and the two driven portions 110 come in contact with the same type of the guiding surfaces (the first guiding surfaces 216 or the second guiding surfaces 217) of the two driving protrusions 212.

The main body of the image forming apparatus for setting the toner container of the first embodiment is configured to come in contact with the driven portions 110 by the first guiding surfaces 216 or the second guiding surfaces 217, which are the inclined surfaces of the two driving protrusions 212, to guide and rotate the cap 102 including the driven portions 110. Therefore, the first guiding surfaces 216 and the second guiding surfaces 217, which are the inclined surfaces in the two directions of the two driving protrusions 212, are disposed so as to be symmetric at 180 degrees with respect to the center point. The second driving protrusion 212*b*, which is a protrusion with a smaller protrusion amount, has a shape including the third guiding surface 218 as a third inclined surface that is a front cut shape with an angle different from the slopes in two directions (the first guiding surface 216 and the second guiding surface 217).

In the toner container 100 of the first embodiment, the first driving protrusion 212*a* as one of the two driving protrusions 212 first comes in contact with and guided by the driven portion 110. The first driving protrusion 212*a* as one of the two main-body protrusions protrudes relative to the other second driving protrusion 212*b*. Therefore, in the insertion operation of the toner container 100, the first driving protrusion 212*a* with a greater protrusion amount comes in contact with the driven portion 110 to guide the cap 102 and determine the rotation direction. Subsequently, the second driving protrusion 212*b* with a smaller protrusion amount comes in contact with the driven portion 110 such that the two driving protrusions 212 sandwich the cap 102. In this configuration, it is possible to prevent an unnecessary force from being applied between the driving protrusion 212 and the driven portion 110.

The toner container 100 of the first and the second embodiments includes the discharge port 114 as the opening provided on the container body 101, the inner cap 106 as the cap member that can open and close the discharge port 114, and the discharging member 107 provided inside the opening portion 108 of the discharge port 114. The inner cap 106 of the second embodiment is provided with the inner cap guiding portion 153 as the protrusion protruding toward the inside of the container body 101. The discharging member 107 functions as the supporting member that surrounds and supports the circumference of the inner cap guiding portion 153.

The discharging member 107 of the second embodiment includes the guide holder 155 as a supporter that surrounds and supports the circumference of the inner cap guiding portion 153, and the reinforcing plates 134 extending from the guide holder 155 in the radial direction of the discharge port 114. The scooping portions 135 are provided as plate-shaped members extending from the reinforcing plate 134 in a direction toward the inside of the container body 101 (the upstream side in the insertion direction).

The discharging member 107 of the first embodiment includes the reinforcing ring 133 disposed in the center, and the reinforcing plates 134 extending from the reinforcing ring 133 in the radial direction of the discharge port 114. The scooping portions 135 are provided as plate-shaped members extending from the reinforcing plates 134 in the direction toward the inside of the container body 101 (the upstream side in the insertion direction).

The scooping portions 135 provided in the discharging member 107 of the first and the second embodiments scoop up toner from the lower side to the upper side along with the rotation of the toner container 100.

To scoop up and convey toner to the discharge port 114 of the toner container 100, it is necessary to provide a scooping member on the discharge port 114.

To provide the scooping member, in the toner container 100 of the second embodiment, the scooping portions 135 serving as the scooping members protrude from the reinforcing plates 134 that extend to the guide holder 155 serving as the supporter for supporting the inner cap guiding portion 153 of the inner cap 106. In this configuration, it is possible to reinforce the guide holder 155, rigidly support the inner cap guiding portion 153, and improve the toner conveying performance.

In the toner container 100 of the first embodiment, the reinforcing ring 133 and the reinforcing plates 134 are provided in the vicinity of the discharge port 114. The scooping portions 135 serving as the scooping members protrude from the reinforcing plates 134. In this configuration, it is possible to scoop up toner by the scooping portions 135 to the vicinity of the discharge port 114, enabling to improve the toner conveying performance.

The scooping portions 135 have a function to scoop up toner located nearby along with the rotation of the toner container 100. In addition to this function, the scooping portions 135 have a function to receive toner that falls from the container-side scooping portions 115, which may be referred to as "shoulder parts" of the container body 101, along with the rotation of the toner container 100, and to convey the toner to the discharge port 114. By increasing the number of the scooping portions 135 relative to the number of the "shoulder parts" of the container body 101, it becomes possible to improve the effect to receive toner that falls from the "shoulder parts", regardless of mounting angles of the plate-shaped scooping portions 135.

Figure 68:
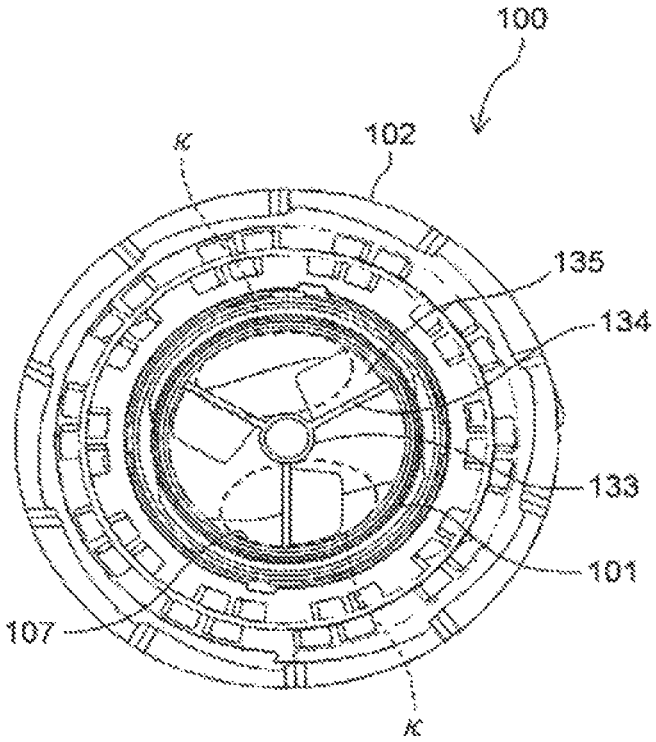
FIG. 68 is a front view of the toner container of the first embodiment from which the inner cap is detached, when viewed from the downstream side in the insertion direction.

FIG. 68 is a front view of the toner container 100 of the first embodiment from which the inner cap 106 is detached, when viewed from the downstream side in the insertion direction. Portions corresponding to regions κ indicated by dashed lines in FIG. 64 are the portions called the "shoulder parts" of the toner container 100. The "shoulder parts" have a function to lift up toner to the height of the discharge port 114 along with the rotation of the toner container 100. The plate-shaped scooping portions 135 have a function to receive toner that falls from the "shoulder parts" and guide the toner r toward the discharge port 114.

First Modification

Figure 69:
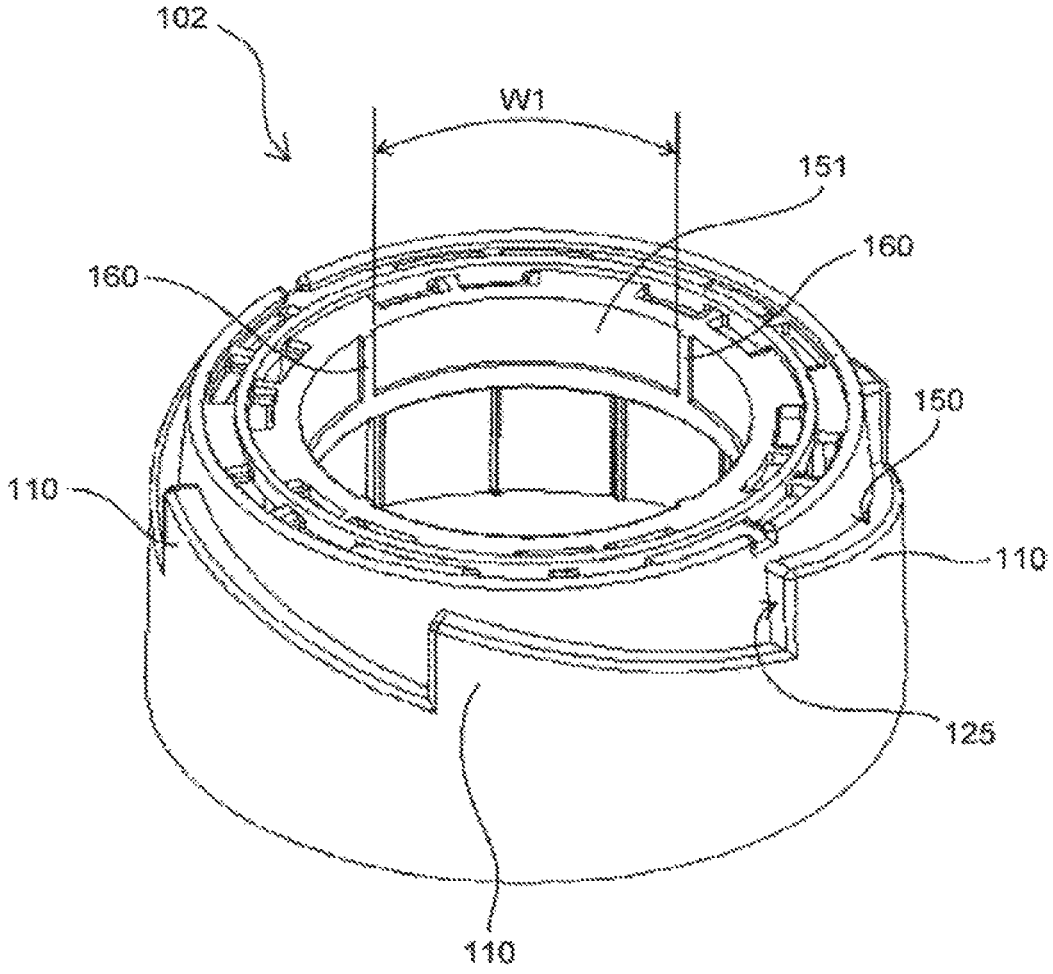
FIG. 69 is a perspective view of a cap of a toner container of a first modification when viewed from the downstream side in the insertion direction.

A first modified example of the toner container 100 to which the present invention is applied (hereinafter, referred to as a "first modification") will be described below. FIG. 69 is a perspective view of the cap 102 of the toner container 100 of the first modification when viewed from the downstream side in the insertion direction.

The configuration is the same as the configuration of the above-described second embodiment except for the shapes of the cap interlocking portions 151 and presence or absence of the V-shaped protrusions 159 and the V-shaped recesses 158 of the container body 101.

The width of the cap interlocking portion 151 of the second embodiment in the circumferential direction is approximately the same as the width of the stopper protrusion 116 in the circumferential direction. When the stopper protrusion 116 interlocks with the cap interlocking portion 151, the position of the cap 102 relative to the container body 101 is fixed.

In contrast, a width ("W1" in FIG. 69) of the cap interlocking portion 151 of the first modification in the circumferential direction is wide enough relative to the width of the stopper protrusion 116 in the circumferential direction. Therefore, while the stopper protrusion 116 is interlocked with the cap interlocking portion 151, the stopper protrusion 116 can move relative to the cap interlocking portion 151 in the circumferential direction inside the cap interlocking portion 151. Therefore, even after the cap 102 is attached to the container body 101, it is possible to move the cap 102 relative to the container body 101 in the circumferential direction within a certain range.

The toner container 100 in the main body of the image forming apparatus is designed to prevent erroneous setting. There is a known technology to provide an identifier shape to prevent a different type or a different color of the toner container 100 from being inserted in a certain type of the container holder 200. It is necessary to control the position of a cartridge such that a main-body identifier shape portion and a toner-cartridge identifier shape portion can interlock with each other to enable an identifier function.

The toner container 100 of the second embodiment includes the container body 101 and the cap 102. The container body 101 includes the discharge port 114 for discharging toner and the grip portion 104 to be gripped by an operator. The cap 102 has an identifier function, includes a plurality of the driven portions 110 that are provided on the outer peripheral portion and form a position regulating ring to be interlocked with the main body of the image forming apparatus, and has a function as a cartridge position control part.

When the toner container 100 of the second embodiment is inserted in the main body of the image forming apparatus, a position regulating function is implemented by interlocking shapes of the driving protrusions 212 provided on the output driving unit 205 of the main body of the image forming apparatus and by the guiding inclined surfaces 150 of the driven portions 110 of the cap 102. With this function, the cap 102 rotates, and the identifier opening groups 111 of the toner container 100 move relative to the identifier protrusion groups 215 of the output driving unit 205 in the rotation direction. With this movement, even when the toner container 100 is inserted in an arbitrary orientation in the rotation direction, the identifier protrusion groups 215 of the output driving unit 205 and the identifier opening groups 111 of the toner container 100 are adjusted to have a predetermined positional relationship (the positional relationship in which the drive transmission surfaces 214 and the drive transmitted surfaces 125 come in contact with each other). Therefore, a shape in the circumferential direction can function as an identifier portion.

When the output driving unit 205, which forms an interlocking shape of the main body of the image forming apparatus, is driven to rotate, a rotational driving force is transmitted to the driven portions 110, which are interlocking portions of the toner container 100, so that the toner container 100 is rotated. With this rotational motion, toner in the container body 101 is conveyed by the spiral-shaped conveying groove 113 provided in the container body 101, and discharged from the discharge port 114.

However, in the toner container 100 of the second embodiment, the positional relationship between the container body 101 and the cap 102 is fixed. Therefore, when the toner container 100 is set in the main body of the image forming apparatus, the entire toner container 100 rotates. Therefore, when an operator sets the toner container 100, the operator needs to push the toner container 100 in the insertion direction while rotating the toner container 100, which may reduce the usability.

At the time of setting, a torque is applied to the driven portions 110 of the position regulating ring. Therefore, the cap 102 is fixed so as not to fall from the container body 101 or spin around, and the relative positions of the interlocking portions of the container body 101 and the cap 102 in the circumferential direction are fixed. Therefore, in an assembly process, higher accuracy may be needed to determine the position of the cap 102 relative to the container body 101, and the assembly cost may be increased.

In the cap 102 of the first modification illustrated in FIG. 69, the width of the groove-shaped cap interlocking portion 151 in the circumferential direction is increased along the circumference, so that the stopper protrusion 116 of the container body 101 is allowed to move inside the cap interlocking portion 151. Therefore, the cap 102 rotates relative to the container body 101. When the toner container 100 is set in the main body of the image forming apparatus, the cap 102 with an identifier position regulator independently moves relative to the container body 101, so that an operator need not rotate the toner container 100.

Further, in a movable range of the stopper protrusion 116 indicated by "W1" in FIG. 69, the stopper protrusion 116 of the container body 101 can be interlocked with the cap interlocking portion 151. Therefore, the assembly accuracy of the components in the circumferential direction is not needed, and the assembly can be simplified.

The toner container 100 of the first modification includes the container body 101 as a toner storage for storing toner, and the cap 102 as the cartridge position control part provided with the driven portions 110 that have an identifier function and that are formed in concave-convex shapes with slopes on the outer peripheral portion. The toner container 100 of the first modification has a function to adjust the identifier protrusion groups 215 and the identifier opening groups 111 to have a predetermined positional relationship by causing the driven portions 110 to act and rotate with respect to the output driving unit 205 serving as the main-body interlocking portion at the time of setting in the main body of the image forming apparatus. The toner container 100 of the first modification also has a function to cause the driven portions 110, which serve as the interlocking portions of the toner container 100 with respect to the output driving unit 205, to transmit a rotational driving force output from the main body of the image forming apparatus, to thereby rotate the toner container 100. The toner container 100 of the first modification also has a function to cause the cap 102 and the container body 101 to interlock with each other by concave portions and convex portions, such as the cap interlocking portions 151 and the stopper protrusions 116, such that the cap 102 rotates in a sliding manner relative to the container body 101.

In the toner container 100 of the first modification, the stopper protrusions 116 as convex portions provided on the container body 101 and the cap interlocking portions 151 as wide grooves provided along the inner periphery of the cap 102 interlock with each other. The stopper protrusions 116 of the container body 101 slide in the rotation direction inside the cap interlocking portions 151. Therefore, when an operator sets the toner container 100 in the main body of the image forming apparatus, the cap 102 can rotate independently even if a torque is applied to the toner container 100 by the output driving unit 205 serving as a main-body position control part of the image forming apparatus. Therefore, an operator can insert the toner container 100 in the main body of the image forming apparatus without rotating the container body 101 that the operator is holding. Further, the width in which the stopper protrusions 116 interlock with the cap interlocking portions 151 is increased. Therefore, when the cap 102 is assembled to the container body 101, the assembly accuracy in the rotation direction is not needed, and the assembly cost can be reduced.

In the configuration of the first modification, as compared to the configuration of the second embodiment, an operator can easily set the toner container 100 in the main body of the image forming apparatus without rotating the toner container 100, and the necessary accuracy for assembly of the components can be reduced.

Figure 70:
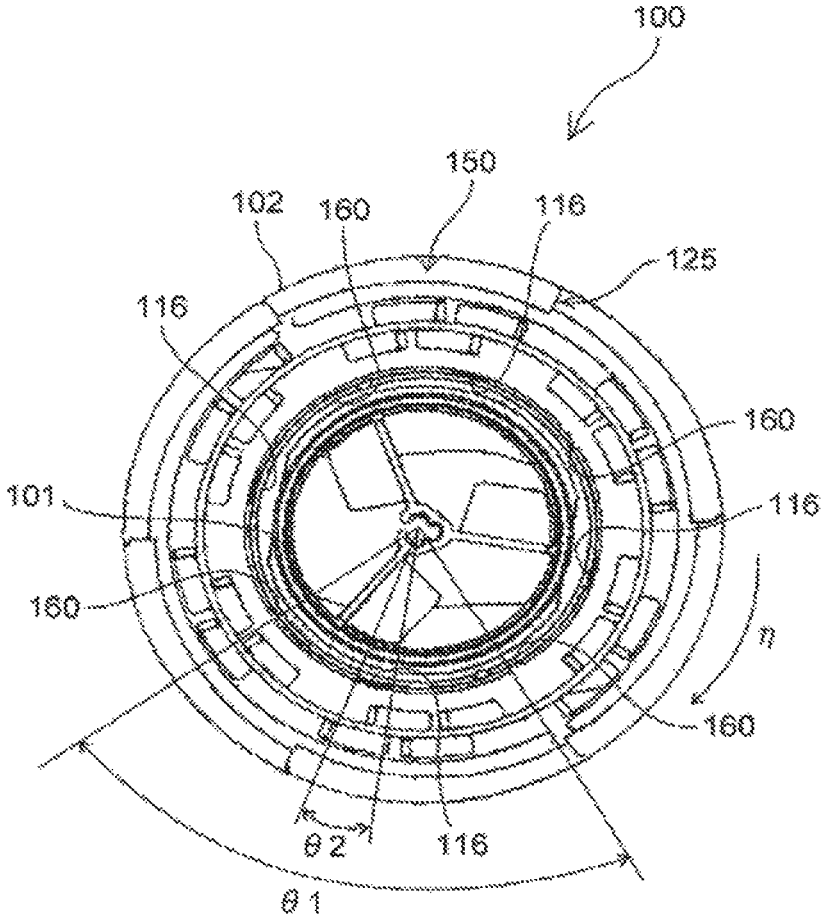
FIG. 70 is a front view of the toner container of the first modification when viewed from the downstream side in the insertion direction.

FIG. 70 is a front view of the toner container 100 of the first modification when viewed from the downstream side in the insertion direction. An arrow r in FIG. 70 indicates a rotation direction of the cap 102 to be rotated by a torque generated when the toner container 100 is further pushed in the insertion direction while the driving protrusion 212 of the output driving unit 205 is in contact with the guiding inclined surface 150.

In FIG. 70, an angular range of the cap interlocking portion 151 with respect to a rotation stopping edge 160 is denoted by "θ1", and an angular range of the stopper protrusion 116 is denoted by "θ2". As illustrated in FIG. 70, θ1 is large enough relative to θ2. In this manner, in the toner container 100 of the first modification, a concave shape of the interlocking portion (the cap interlocking portion 151) between the container body 101 and the cap 102 has a certain width in the circumferential direction. Therefore, when the cap 102 is assembled to the container body 101, the positional accuracy in the circumferential direction is not needed, and the assembly can be simplified.

Figure 71:
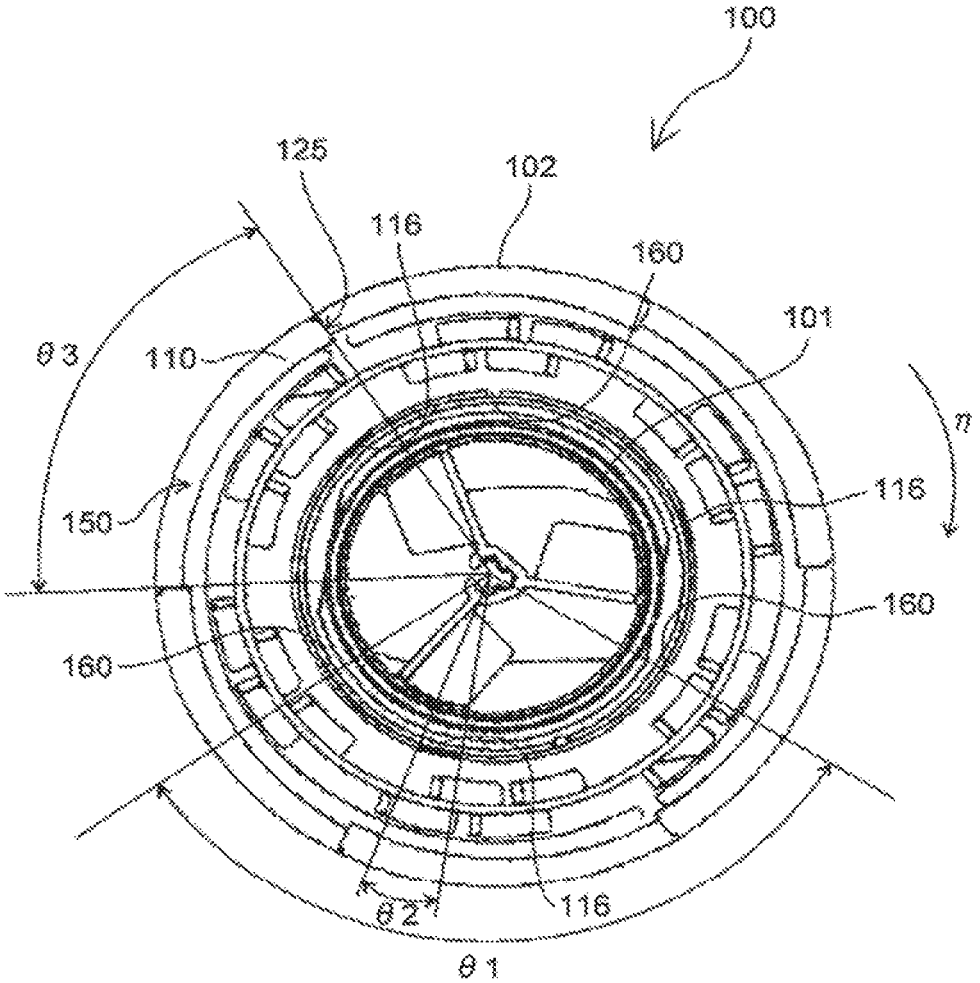
FIG. 71 is a front view of the toner container of the first modification with a cap interlocking portion having a wider width than that in FIG. 70, when viewed from the downstream side in the insertion direction.

FIG. 71 is a front view of the toner container 100 of the first modification with the cap interlocking portions 151 each having a wider width than that in FIG. 70, when viewed from the downstream side in the insertion direction. In the configuration illustrated in FIG. 70, the stopper protrusions 116 and the cap interlocking portions 151 are provided at four positions. In the configuration illustrated in FIG. 71, the stopper protrusions 116 and the cap interlocking portions 151 are provided at three positions.

In the toner container 100 of the first modification, a rotation width of the cap 102 relative to the container body 101 is set to be greater than an angular range ("θ3" in FIG. 71) of one of the driven portions 110 of the position regulating ring provided on the outer peripheral portion of the cap 102. Assuming that the maximum rotation angle of the cap 102 relative to the container body 101 is denoted by "θ0", "θ0=θ1−θ2".

Therefore, the angular range "θ3" of one of the driven portions 110 in FIG. 71 and the angle "θ0" are set such that "θ0>θ3".

When the toner container 100 is set, the maximum rotation angle corresponds to the angular range "θ3" of one of the driven portions 110, where the maximum rotation angle is an angle available before the setting is completed by pushing the toner container 100 in the insertion direction after the driving protrusion 212 comes in contact with the guiding inclined surface 150. In the toner container 100 of the first modification, the rotatable angle of the cap 102 when the cap 102 rotates relative to the container body 101 is set to be greater than the rotatable angle of the cap 102 when the cap 102 rotates upon insertion of the toner container 100 by an operator. Therefore, the operator can set the toner container 100 in the main body of the image forming apparatus without changing the orientation of the container body 101 having the grip portion 104 to be held by the operator.

Second Modification

Figure 72:
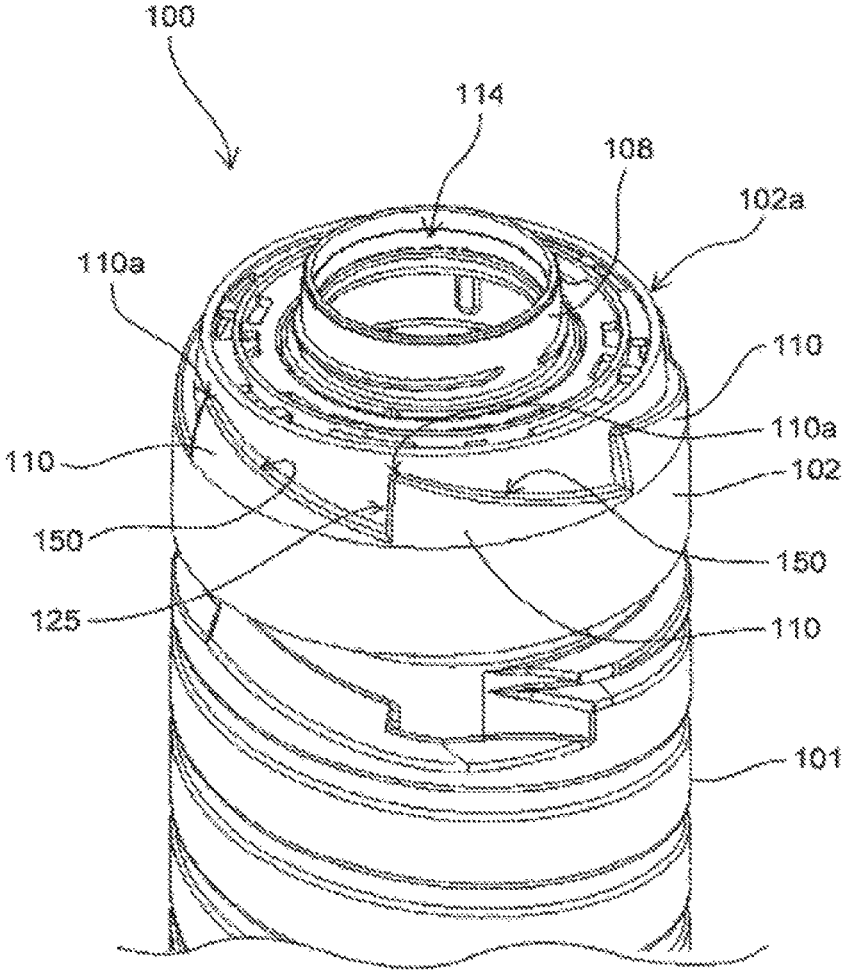
FIG. 72 is a perspective view of a toner container of a second modification when viewed from the downstream side in the insertion direction.
Figure 73:
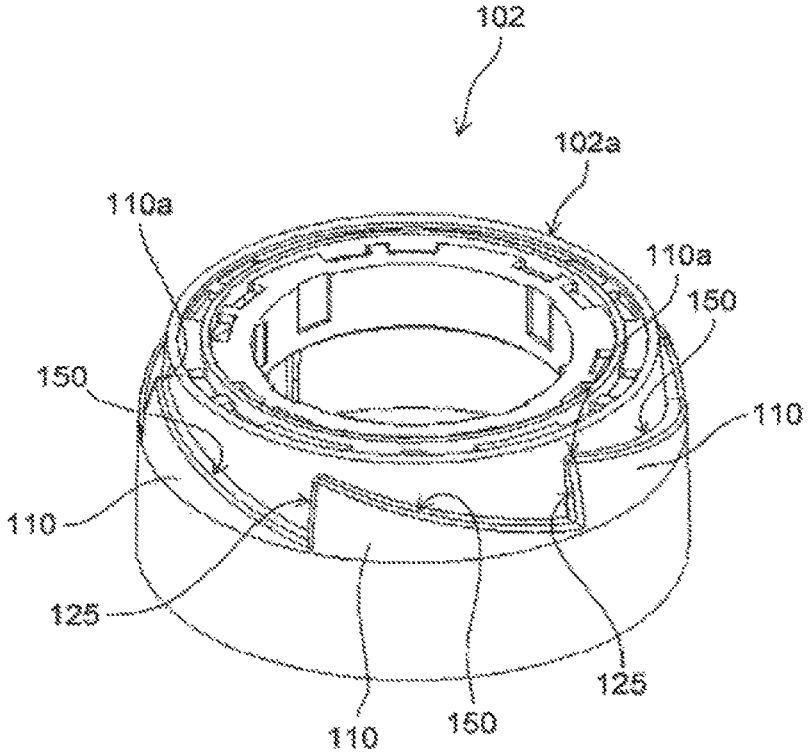
FIG. 73 is a perspective view of a cap of the toner container of the second modification when viewed from the downstream side in the insertion direction.

A second modified example of the toner container 100 to which the present invention is applied (hereinafter, referred to as a "second modification") will be described below. FIG. 72 is a perspective view of the toner container 100 of the second modification when viewed from the downstream side in the insertion direction. FIG. 73 is a perspective view of the cap 102 of the toner container 100 of the second modification when viewed from the downstream side in the insertion direction.

The configuration is the same as the configuration of the above-described second embodiment except for the shapes of the driven portions 110 of the cap 102.

As illustrated in FIGS. 72 and 73, the widths of the guiding inclined surface 150 and the drive transmitted surface 125 of the driven portion 110 are reduced toward the downstream side in the insertion direction. Therefore, a tip 110*a* as a downstream end of the driven portion 110 in the insertion direction is located on the center side in the radial direction as compared to the configuration of the second embodiment.

The toner container 100 includes the cap 102 provided with the driven portions 110 as interlocking shapes on the outer peripheral portion, and the container body 101. At the time of insertion in the main body of the image forming apparatus, the output driving unit 205 as an interlocking shape provided on the main body of the image forming apparatus and the driven portions 110 as the interlocking shapes provided on the toner container 100 interlock with each other. When the output driving unit 205 rotates, a rotational driving force is transmitted to the toner container 100, and the toner container 100 rotates at the same angular velocity as that of the output driving unit 205. The toner container 100 includes the discharge port 114 as an opening on one end thereof. When the toner container 100 rotates, the toner container 100 itself or a conveying member provided inside the toner container 100 rotates to convey toner to the discharge port 114, and the toner is discharged through the discharge port 114. In the toner container 100 of the second modification, the cap 102 with the driven portions 110 and the container body 101 for storing toner are configured as separate components. It may be possible to provide the functions of the cap 102 and the functions of the container body 101 in a single component.

In the toner container 100 of the above-described second embodiment, the diameter of a portion at which the cap 102 has the maximum diameter and the diameter of the ring formed of the driven portions 110 are the same. Therefore, in this shape, the tips 110*a* of the driven portions 110 as the interlocking shapes provided on the outer peripheral portion of the cap 102 may come in contact with the ground when the toner container 100 falls down. Therefore, the impact is directly applied to the tips 110*a* of the driven portions, and the tips 110*a* of the driven portions may be damaged. To prevent deterioration of toner due to humidity, the toner container 100 is accommodated in a moisture-proof bag at the time of storage. However, because the tips 110*a* of the driven portions have acute angles, a load may be concentrated at a certain point of the moisture-proof bag, and the moisture-proof bag may be broken at the time of falling.

The toner container 100 of the second modification includes the driven portions 110 on the outer peripheral portion of the cap 102. A gradient is provided such that the outer diameter of the ring formed of the driven portions 110 is reduced toward the downstream side in the insertion direction so as to prevent the tips 110*a* of the driven portions 110 from coming in contact with the ground when the toner container 100 falls down.

In the toner container 100 of the second modification as described above, by providing the gradient on the outer peripheries of the driven portions 110 of the cap 102, it is possible to prevent the tips 110*a*, which are downstream ends of the driven portions 110 in the insertion direction, from coming in contact with the ground at the time of falling. Further, by the contact of the portions of the tips 110*a* of the driven portions, it is possible to increase the area of contact with the ground at the time of falling. Therefore, it is possible to distribute the impact applied to the cap 102 and prevent the cap 102 from being broken. The force applied to a package material, such as a moisture-proof bag, is also distributed, so that it is possible to prevent the package material from being broken.

In the toner container 100 of the second modification, it is possible to prevent the cap 102 from being broken at the time of falling, and prevent a package material, such as a moisture-proof bag used for storage, from being broken.

Figure 74:
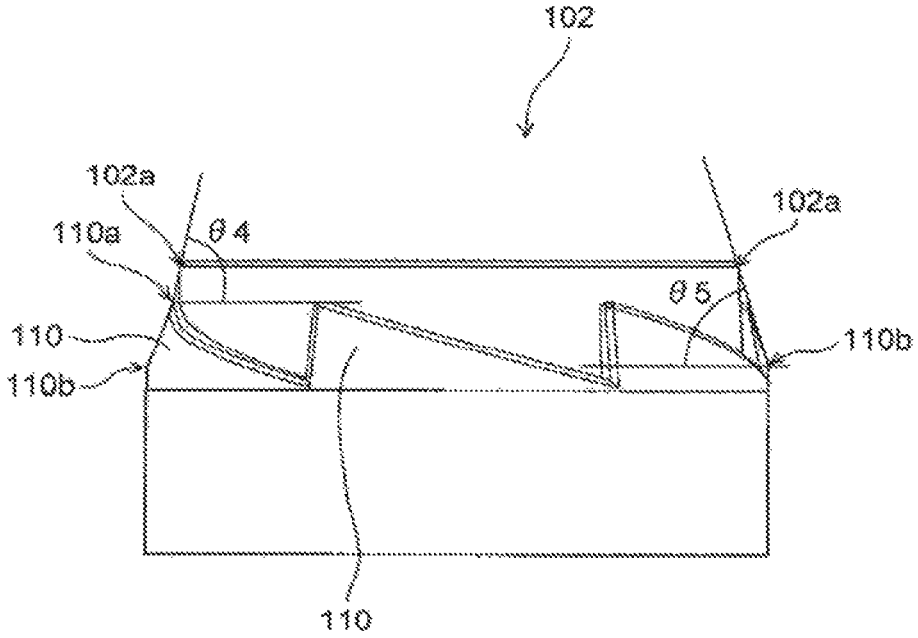
FIG. 74 is a side view of the cap of the second modification in a shape in which the outer diameter of a ring formed of the driven portions is reduced in a linear manner.
Figure 75:
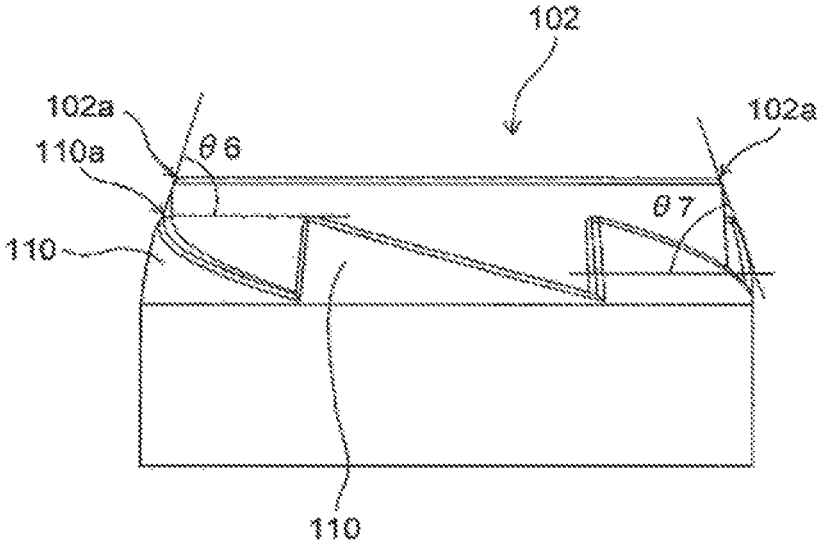
FIG. 75 is a side view of the cap of the second modification in a shape in which the diameter of the ring formed of the driven portions is reduced in a curved manner.

FIG. 74 is a side view of the cap 102 of the second modification with a shape in which the outer diameter of the ring formed of the driven portions 110 is reduced in a linear manner from the upstream side to downstream side in the insertion direction. FIG. 75 is a side view of the cap 102 of the second modification in a shape in which the outer diameter of the ring formed of the driven portions 110 is reduced in a curved manner from the upstream side to downstream side in the insertion direction.

An angle θ4 in FIG. 74 is an angle formed by a reference plane and a straight line that connects an outer front portion 102*a*, which is an outermost portion of the downstream end of the cap 102 in the insertion direction, and the tip 110*a* of the driven portion. The reference plane is a plane perpendicular to the center line of the cylindrical cap 102.

An angle θ5 in FIG. 74 is an angle formed by the reference plane and a straight line that connects the outer front portion 102*a* and a maximum diameter portion 110*b*, which is the downstream end of an outer peripheral portion of the driven portions 110 in the insertion direction at which the diameter is maximized.

An angle θ6 in FIG. 75 is an angle formed by the reference plane and a straight line that connects the outer front portion 102*a*, which is the outermost portion of the downstream end of the cap 102 in the insertion direction, and the tip 110*a* of the driven portion. An angle θ7 in FIG. 75 is an angle formed by the reference plane and a tangent line extending toward the outer front portion 102*a* from the curved outer periphery of the driven portion 110.

The cap 102 includes the driven portions 110 as the interlocking shapes on the outer peripheral portion, and the tips 110*a* on the downstream ends of the driven portions 110 in the insertion direction. Inclination is provided such that the outer diameter of the ring formed of the driven portions 110 is reduced toward the downstream side relative to the upstream side in the insertion direction. It is sufficient that the angle of the inclination is set such that when the cap 102 comes in contact with a plane, the tips 110*a* of the driven portions do not come in contact with the plane. Specifically, the angle θ4 and the angle θ5 in FIG. 74 are set such that "θ4≥θ5", and the angle θ6 and the angle θ7 in FIG. 75 are set such that "θ6≥θ7".

If the toner container 100 has the configuration of the second modification, the tips 110*a* of the driven portions do not come in contact with a moisture-proof bag when the toner container 100 is of a model that uses the moisture-proof package at the time of storage. Therefore, it is possible to prevent the moisture-proof bag from being broken. The outer peripheries of the driven portions 110 need not be inclined in a linear manner as illustrated in FIG. 74, but may be inclined in a curved manner as illustrated in FIG. 75.

In the first and the second embodiments, as illustrated in FIGS. 20 and 47, the downstream ends of the driven portions 110 in the insertion direction are located on the upstream side in the insertion direction relative to the cap front end 129, which is the downstream end of the cap 102 in the insertion direction and on which the identifier opening groups 111 are provided. Therefore, it is possible to prevent angular portions of the downstream ends of the driven portions 110 in the insertion direction from coming in contact with a container bag for storing the toner container 100. Consequently, it is possible to reduce the probability that the container bag is broken, and it is possible to prevent damage of the container bag.

In the image forming apparatus using the toner container 100 of the embodiment, the toner container 100 is rotated by rotation of the driving protrusions 212. The driving protrusions 212 of the main body of the image forming apparatus serve as the drive transmitting units. Further, the identifier opening groups 111 and the identifier protrusion groups 215 function as unique identifier shapes only when the driving protrusions 212 reach the positions at which they function as the drive transmitting units.

The driven portions 110 and the identifier opening groups 111 are parts of the cap 102, and their positional relationship is fixed. Therefore, by determining the positions of the driven portions 110 relative to the output driving unit 205, the positions of the identifier opening groups 111 relative to the identifier protrusion group 215 of the output driving unit 205 can be determined.

In the embodiment, the position at which the drive transmission surface 214 of the driving protrusion 212 comes in contact with the drive transmitted surface 125 of the driven portion 110 is the position at which the drive transmission surface 214 functions as the drive transmitting unit. At this time, the drive transmitted surface 125 of the driven portion 110 comes in contact with the drive transmission surface 214 of the driving protrusion 212, and the position of the driven portion 110 relative to the output driving unit 205 including the driving protrusion 212 in the rotation direction is determined. Therefore, the position of the identifier opening group 111 relative to the identifier protrusion group 215 can be determined, and the identifier protrusion group 215 and the identifier opening group 111 function as unique identifier shapes.

When the driving protrusion 212 is guided by the first guiding inclined surface 126 or the guiding inclined surface 150, the cap 102 rotates relative to the output driving unit 205 after the front ends of the protrusions of the identifier protrusion group 215 start to enter the openings of the identifier opening group 111. Therefore, the relative positions of the identifier protrusion group 215 and the identifier opening group 111 in the rotation direction varies between when the front ends of the identifier protrusion group 215 stars to enter the identifier opening group 111 and when the front ends of the identifier protrusion group 215 are completely put in the identifier opening group 111. Therefore, each of the protrusions of the identifier protrusion group 215 has a slope such that the protrusion amount is reduced toward the downstream side in a rotation direction in which the cap 102 is rotated by the inclined surfaces. Further, the length of a base portion of each of the protrusions of the identifier protrusion group 215 in the rotation direction and the length of each of the openings of the identifier opening group 111 in the rotation direction are approximately the same if the identifier shapes match each other, where the protrusions and the openings are configured to interlock with each other.

When the toner container 100 of the embodiment is inserted, a contact position of the driving protrusion 212 with the first guiding inclined surface 126, the second guiding inclined surface 127, or the guiding inclined surface 150 is shifted by the slopes while determining the relative positions in the rotation direction. If the driving protrusion 212 comes in contact with the first guiding inclined surface 126 or the guiding inclined surface 150, the protrusions of the identifier protrusion group 215 are put in the openings of the identifier opening group 111 while the relative positions are determined by the slopes. Therefore, the slope is provided on each of the protrusions of the identifier protrusion group 215 as described above.

In the embodiment, while the guiding inclined surface (126, 127, or 150) of the driven portion 110 determines the position of the identifier opening group 111 relative to the identifier protrusion group 215 in the rotation direction, the identifier opening group 111 approaches the identifier protrusion group 215. Therefore, even if the toner container 100 is in an arbitrary posture in the rotation direction, the position of the identifier opening group 111 in the rotation direction can be adjusted to a position at which it is possible to determine whether the identifier opening group 111 and the identifier protrusion group 215 can interlock with each other.

In the toner container 100 of the embodiment, a unique identifier shape is provided by changing the shape of the identifier opening group 111 in the circumferential direction with reference to the driven portion 110 depending on the type of toner to be stored or the like. The position of the identifier opening group 111 relative to the output driving unit 205 of the main body of the image forming apparatus is determined by the driven portion 110. Therefore, differences in shapes in the circumferential direction can be used as unique identifier shapes. In the toner container 100 described in PTL 1, the function of the unique identifier shape is obtained based on only differences in the distances from the rotation axis of the toner container in the radial direction. In contrast, in the toner container 100 of the embodiment, differences in the positions relative to a reference position for positioning in the rotation direction can be used as unique identifier shapes. Therefore, it is possible to provide a large number of unique identifier shapes. Consequently, it becomes possible to share configurations of a larger number of types of the toner container 100 than in the conventional technology, except for the shape of the identifier opening group 111.

In the toner container 100 of the embodiment, the cap 102 with the identifier opening groups 111 is separated from the container body 101 that stores toner. Therefore, by changing the shapes of the identifier opening groups 111 of the cap 102 depending on the types of toner to be stored, it is possible to share the container body 101 regardless of the types of toner to be stored. Consequently, it is possible to reduce cost, such as manufacturing cost.

In the toner container 100 of the embodiment, the identifier opening groups 111 and the driven portions 110 are provided on a single component, and the identifier opening groups 111 and the driven portions 110 are rotated integrally. Therefore, the driven portions 110 can be used as positioners of the identifier opening groups 111 in the rotation direction.

Incidentally, interlocking portions, such as the identifier opening groups 111 as the identifier shape portions of the toner container 100, and container interlocking portions, such as the driven portions 110, may not be separated from a toner storage, such as the container body 101. The interlocking portions and the container interlocking portions may be provided on a part of the toner storage.

Examples of the differences in the positions of the identifier opening group 111 and the identifier protrusion group 215 with reference to the driven portion 110 and the driving protrusion 212 in the rotation direction include the following: combinations of an inner peripheral shape and an outer peripheral shape with the openings of the identifier opening group 111 and the protrusions of the identifier protrusion group 215 disposed at different angular positions in the rotation direction, at different pitches, or at different positions in the radial direction; and positional deviation between the inner peripheral shape and the outer peripheral shape in the rotation direction. However, the variations are not limited to the above examples.

In PTL 1, a protrusion as an identifier shape is provided on the end surface of the toner container such that a distance from the rotation axis in the radial direction varies depending on types, and a plurality of recesses, each serving as an identifier interlocking portion of the main body of the image forming apparatus, are provided on the same circumference such that distances from the rotation axis in the radial direction vary depending on the types. In this configuration, even when the toner container is in any posture in the range of 360 degrees in the rotation direction relative to the identifier interlocking portions of the main body of the image forming apparatus, it is possible to determine whether the identifier shapes can interlock with each other. However, in the main body of the image forming apparatus, a plurality of the recesses with the same shapes are provided on the same circumference with respect to a single protrusion of the toner container. Therefore, even if the position of the protrusion in the rotation direction relative to a certain reference on the toner container side is changed, identification is not possible, and if interlocking on one side is possible, then interlocking on the other side is also possible. Namely, a positional difference in the rotation direction is not used for the identifier shapes.

The toner container 100 of the embodiment includes a plurality of the drive transmitted surfaces 125, in which drive is input from the main body of the image forming apparatus, in the circumferential direction. The first guiding inclined surface 126, the second guiding inclined surface 127, and the guiding inclined surface 150 are provided as container guiding portions that guide the driving protrusion 212 of the main body of the image forming apparatus to a gap between the adjacent drive transmitted surfaces 125. The container guiding portions are inclined surfaces that are inclined from the downstream side to the upstream side in the insertion direction of the toner container 100 with respect to the circumferential direction, and configured to come in contact with the driving protrusion 212 of the main body of the image forming apparatus and cause the driven portion 110 provided with the drive transmitted surface 125 to rotate and move in the circumferential direction. The inclined surfaces serving as the container guiding portions are continuously provided from the downstream end of the drive transmitted surfaces 125 in the insertion direction to the upstream end of the adjacent drive transmitted surface 125 in the insertion direction.

When the toner container 100 of the embodiment is inserted, the relative positions of the identifier shape of the toner container 100 and the identifier shape of the main body of the image forming apparatus in the rotation direction are regulated such that the drive transmission surface 214 of the driving protrusion 212 and the drive transmitted surface 125 of the driven portion 110 come in contact with each other. If the relative positions are deviated from the positions at which the drive transmission surface 214 and the drive transmitted surface 125 come in contact with each other, the driving protrusion 212 comes in contact with the guiding inclined surface of the driven portion 110 and the relative positional relationship is adjusted.

When the relative positional relationship in the rotation direction is adjusted, and if the toner container 100 is further inserted, it is determined whether the identifier shape (the identifier opening group 111) of the toner container 100 and the identifier shape (the identifier protrusion group 215) of the main body of the image forming apparatus can come close to and interlock with each other. Therefore, it is possible to change the shapes of the identifier shapes in the rotation direction, use the differences in the shapes in the rotation direction as identifier shapes, and provide a large number of types of identifier shapes.

In the toner container 100 of the first embodiment, as for the driven portions 110, the ten driven portions 110 with the same shapes are arrayed at intervals of 36 degrees on the outer periphery of the cap 102. As for the identifier opening groups 111, in the example illustrated in FIG. 15, four openings constitute a single recess group serving as the identifier opening group 111, and the ten identifier opening groups 111 each having the same combination of the openings are provided. Meanwhile, the output driving unit 205 includes the two driving protrusions 212 and the four identifier protrusion groups 215. In the example illustrated in FIG. 37, each of the identifier protrusion groups 215 includes four protrusions.

As described above, the number of the identifier opening groups 111 each having the same shape is the same as the number of the driven portions 110, and the identifier opening groups 111 can achieve the identifier function whenever any of the ten driven portions 110 interlocks with the driving protrusion 212.

When the identifier shape of the toner container 100 of the first embodiment match the identifier shape of the main body of the image forming apparatus, four of the ten identifier opening groups 111 interlock with the identifier protrusion groups 215. The interlocking for identification at only a single position at minimum functions as the identifier shape. However, if the identifier shape is provided at only a single position and the toner container 100 is inclined with respect to the output driving unit 205 for example, the protrusion of the identifier protrusion group 215 may enter the opening of the identifier opening group 111 when the identifier shapes do not match each other but their difference is small. In contrast, by the interlocking at four positions, even when the toner container 100 is inclined and the identifier protrusion group 215 with a different shape is oriented at a certain angle at which it enters the identifier opening group 111 at a single position, it is possible to prevent the identifier protrusion groups 215 from entering the identifier opening groups 111 at the other positions.

The identifier opening group 111 serving as the identifier interlocking portion of the toner container 100 includes a combination of openings corresponding to a combination of protrusions of the identifier protrusion group 215 serving as the identifier interlocking portion of the main body of the image forming apparatus. Specifically, the identifier opening group 111 includes a plurality of openings corresponding to the number and the positions of protrusions of the identifier protrusion group 215. The number of the identifier opening groups 111 is the same as the number of the driven portions 110.

The driving protrusions 212 serving as the drive transmitting units of the output driving unit 205 are provided at two positions at intervals of 180 degrees in the circumferential direction. The identifier protrusion groups 215 serving as the identifier interlocking portions of the output driving unit 205 are provided at four positions in the circumferential direction.

Figure 76:
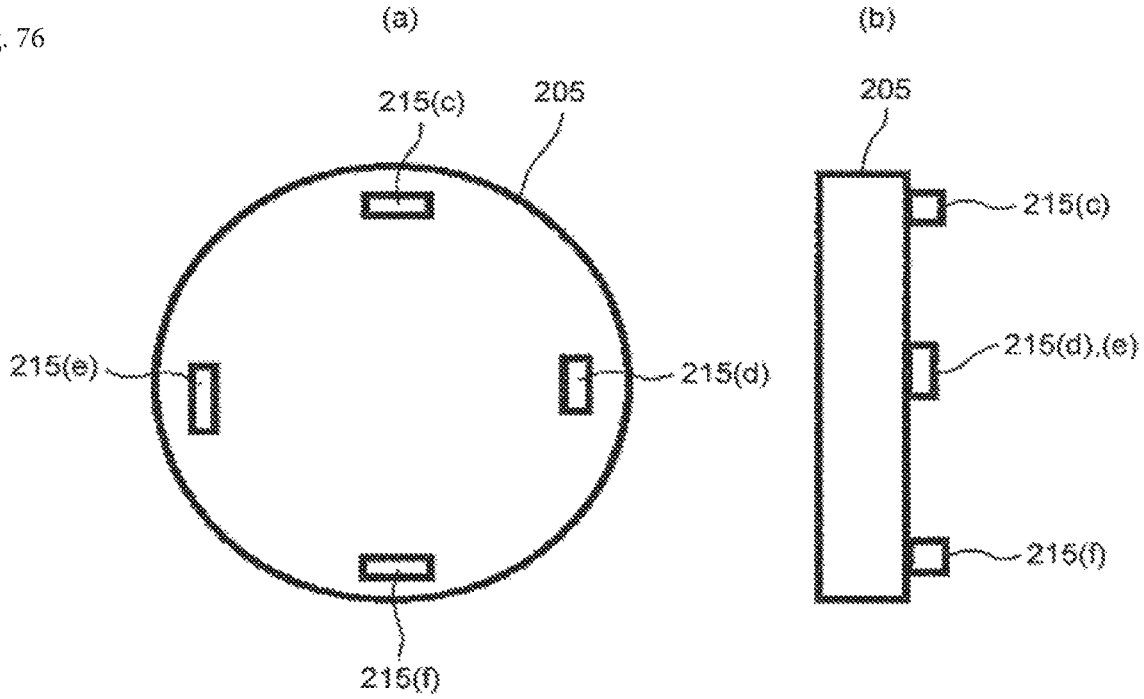
FIG. 76 schematically illustrates an output driving unit: (a) is a front view of the output driving unit; and (b) is a side view of the output driving unit.

FIG. 76 schematically illustrates the output driving unit 205 serving as the drive transmitting unit of the main body of the image forming apparatus. In FIG. 76, (a) is a front view of the output driving unit 205; and (b) is a side view of the output driving unit 205.

As illustrated in (a) in FIG. 76, the output driving unit 205 includes the identifier protrusion groups 215 disposed at four positions at intervals of about 90 degrees in the circumferential direction.

In the output driving unit 205 illustrated in FIG. 76, the two identifier protrusion groups 215 (215(*d*) and 215(*e*)) among the four identifier protrusion groups 215 (215(*c*), 215(*d*), 215(*e*), and 215(*f*)) are arrayed horizontally.

Figure 77:
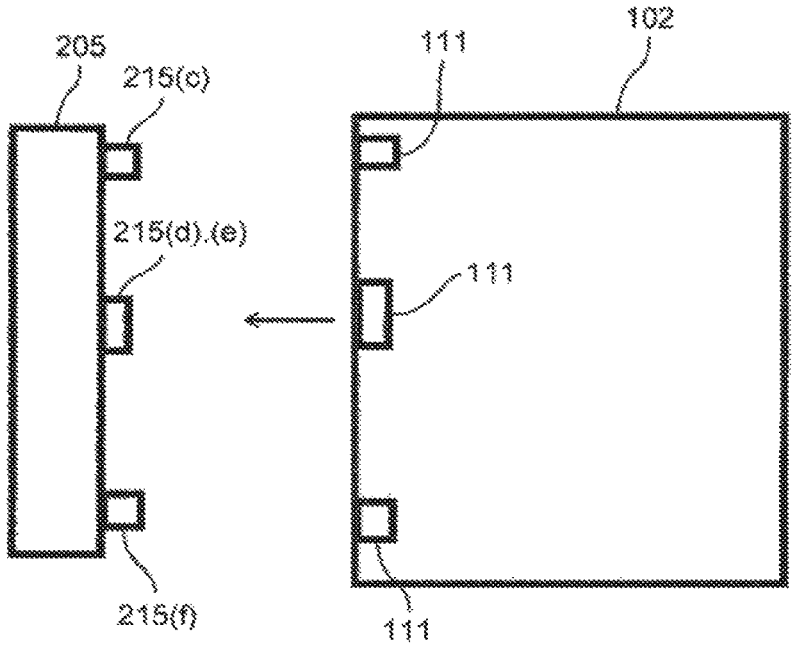
FIG. 77 is a side view schematically illustrating the cap and the output driving unit when the output driving unit is located at a normal position at which it is not inclined with respect to the insertion direction.

FIG. 77 is a side view schematically illustrating the cap 102 and the output driving unit 205 of the toner container 100 when the output driving unit 205 illustrated in FIG. 76 is located at a normal position at which it is not inclined with respect to the insertion direction of the toner container 100. As illustrated in FIG. 77, when the output driving unit 205 is located at the normal position, all of the four identifier protrusion groups 215 function as the identifier shapes.

Figure 78:
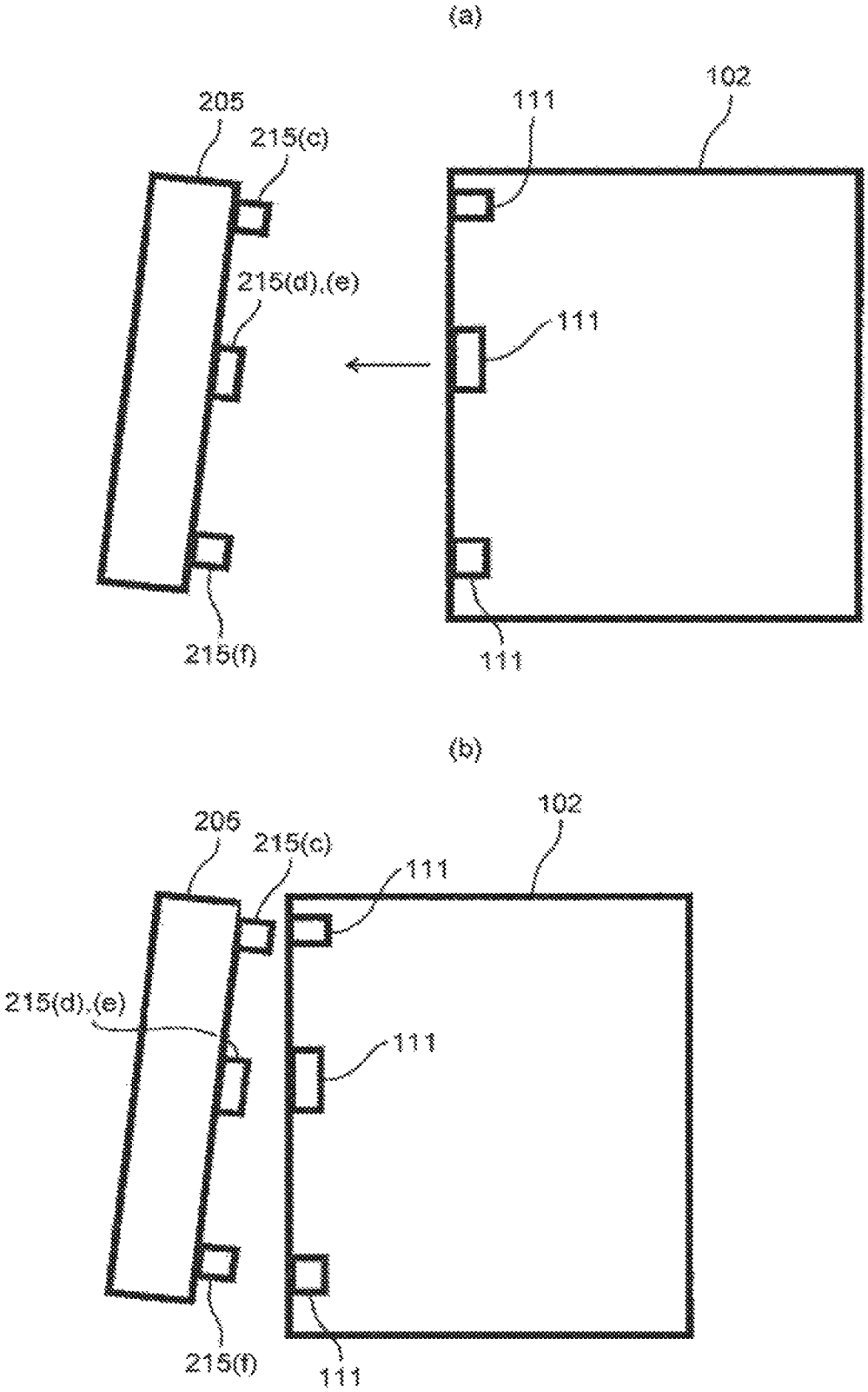
FIG. 78 illustrates the cap and the output driving unit when the output driving unit is inclined with respect to the insertion direction: (a) is a side view of the cap and the output driving unit located distant from each other; and (b) is a side view of the cap and the output driving unit located close to each other.

FIG. 78 illustrates side views of the cap 102 and the output driving unit 205 when the output driving unit 205 is inclined with respect to the insertion direction of the toner container 100 while the two (215(*d*) and 215(*e*)) of the four identifier protrusion groups 215 are arrayed horizontally. In FIG. 78, (a) illustrates a state in which the cap 102 and the output driving unit 205 are located distant from each other; and (b) illustrates a state in which the toner container 100 is inserted in the direction of arrow in (a) and the cap 102 and the output driving unit 205 are located close to each other. In the state illustrated in FIG. 78, the output driving unit 205 is inclined such that the upper portion thereof approaches the upstream side of the toner container 100 in the insertion direction.

As illustrated in FIG. 78, when the output driving unit 205 is inclined, the two horizontally-arrayed identifier protrusion groups 215 (215(*d*) and 215(*e*)) are located distant from the identifier opening group 111 even when the cap 102 and the output driving unit 205 are located close to each other as illustrated in (b) in FIG. 78. Therefore, the functions as the identifier shapes of the two horizontally-arrayed identifier protrusion groups 215 (215(*d*) and 215(*e*)) are reduced.

Of the other two identifier protrusion groups 215 (215(*c*) and 215(*f*)), the identifier protrusion group 215(*f*) on the lower side is located distant from the identifier opening group 111, similarly to the two horizontally-arrayed identifier protrusion groups 215. Therefore, the identifier protrusion group 215(*f*) on the lower side may not function as the identifier shape. However, the identifier protrusion group 215(*c*) on the upper side moves so as to approach the upstream side of the toner container 100 in the insertion direction, that is, to the identifier opening group 111, so that it can function as the identifier shape. As described above, by providing the identifier protrusion groups 215 at four positions, it is possible to ensure the minimum identifier function.

To deal with this, it is preferable to provide the identifier opening groups 111 on at least four positions on the cap 102 of the toner container 100.

In the example illustrated in FIG. 78, a case is described in which the output driving unit 205 (the main-body driving unit of the image forming apparatus) is inclined. The same applies when the toner container 100 is inclined.

The identifier opening group 111 serving as the identifier shape on the toner container 100 side is an identifier recess that forms the identifier shape in which the position of an opening in the circumferential direction are changed relative to the drive transmitted surface 125 serving as the drive transmitting unit on the toner container side.

In the toner container 100 of the embodiment, the diameter of the outer cap 103 is greater than the diameter of the container insertion opening 213, which is an opening of the main body of the image forming apparatus for inserting the opening portion 108 with the discharge port 114. Therefore, it is possible to reduce the probability that the toner container 100 is erroneously attached while the outer cap 103 is closed.

In the toner container 100 of the second embodiment, as the driven portions 110, the six driven portions 110 with the same shapes are arrayed at intervals of 60 degrees on the outer periphery of the cap 102. As the identifier opening groups 111, in the example illustrated in FIG. 52, a set of four openings, one of which is longer than the other three in the rotation direction, serves as the identifier opening group 111, and the six identifier opening groups 111 with the same shapes are provided. Meanwhile, the output driving unit 205 includes the two driving protrusions 212 and the two identifier protrusion groups 215. In the example illustrated in FIG. 65, each of the identifier protrusion groups 215 includes three protrusions. The identifier opening groups 111 of the cap 102 illustrated in FIG. 52 and the identifier protrusion groups 215 of the output driving unit 205 illustrated in FIG. 61 have different identifier shapes, so that they cannot interlock with each other.

In the configuration of the above-described embodiment, the driving protrusion 212 serving as the interlocking portion on the output driving unit 205 side interlocks with the driven portion 110 that is located on the outer side in the radial direction relative to a downstream end surface of the toner container 100 in the insertion direction. By the interlocking at a position distant from the rotation axis in the radial direction, it is possible to reduce a load applied to the driving protrusion 212 and the driven portion 110 for transmitting drive upon input of rotation drive. Therefore, it is possible to reduce a necessary strength of the drive transmitting unit including the driving protrusion 212 and the driven portion 110, and prevent damage of the drive transmitting unit.

As described above, in the toner container 100, the cap 102 including the driven portions 110, to which rotation drive is input from the main body of the image forming apparatus, is separated from the container body 101 that stores toner.

If the driven portions 110 are provided on the container body 101, it is necessary to modify the outer peripheral shape of the vicinity of the downstream end of the container body 101 in the insertion direction into a shape that serves as the driven portions 110. However, in the vicinity of the downstream end of the container body 101 in the insertion direction, it is necessary to provide the container-side scooping portions 115 to scoop up toner from the vicinity of the inner wall surface of a certain portion of the container to the height of the discharge port 114, where the certain portion has a large inner diameter. To provide the shape that serves as the driven portions 110 on the outer periphery of the container body 101 as well as to provide the shape that functions as the container-side scooping portions 115 on the inner side, it is necessary to give priority to input of rotation drive. Therefore, the degree of freedom of the shapes of the container-side scooping portions 115 is reduced.

In this case, it is difficult to provide the container-side scooping portions 115 with shapes in which toner can efficiently be scooped up. Consequently, the toner conveyed to the downstream side in the insertion direction along with the rotation of the container body 101 may be accumulated in the vicinity of the downstream end of the container body 101 in the insertion direction. If the toner is accumulated, the toner may be aggregated, and the aggregated toner may be supplied to the developing device 9.

In contrast, in the toner container 100 of the embodiment, the cap 102 with the driven portions 110 is separated from the container body 101. Therefore, it is possible to provide a shape needed to input rotation drive on the cap 102, and provide the container-side scooping portions 115 with shapes in which the scooping capability is prioritized, as a shape of the vicinity of the downstream end of the container body 101 in the insertion direction. For example, as illustrated in FIG. 34, it is possible to realize a shape greatly cut inward in the radial direction. Therefore, it is possible to receive input of rotation drive and efficiently scoop up toner by the container-side scooping portions 115, enabling to improve the toner discharge performance and prevent toner aggregation inside the container body 101.

In the above-described embodiments, two of the driven portions 110 and the two driving protrusions 212 interlock with each other and transmit drive. By providing two or more portions for transmitting drive, the driven portions 110 and the entire toner container 100 that rotates with the driven portions 110 are not inclined with respect to the main body of the image forming apparatus, so that rotation drive can smoothly be transmitted.

In the above-described embodiments, the identifier opening group 111 including a plurality of openings serves as an interlocking portion as an identifier shape portion on the toner container 100 side, and the identifier protrusion group 215 including a plurality of protrusions serves as a main-body identifier shape portion. Specifically, a recess to be interlocked for identification is provided on the toner container 100 side, a protrusion is provided on the main body side of the image forming apparatus, and the identifier function is implemented based on whether the protrusion and the recess interlock with each other. As a combination of the identifier shapes, it may be possible to provide the protrusion on the toner container 100 side and provide the recess on the image forming apparatus side. Further, it may be possible to provide the protrusions on both sides and implement the identifier function based on whether the protrusion shapes overlap each other in a desired state.

In the above-described embodiments, the identifier protrusion group 215 that is a combination of a plurality of identifier protrusions serves as the identifier shape on the main body side of the image forming apparatus. However, only a single protrusion may implement the identifier function based on a difference in the positional relationship with respect to the drive transmission surface 214. Further, the identifier opening group 111 that is a combination of a plurality of identifier openings serve as the identifier shape on the toner container 100 side. However, only a single opening may enable the identifier function to work based on a difference in the positional relationship with respect to the drive transmitted surface 125.

In the above-described embodiments, by providing the outer identifier opening group 111*a* and the inner identifier opening group 111*b* at different positions in the radial direction, it is possible to realize a greater number of combinations of the identifier shape than the configuration in which identifier openings are provided on the same circumference.

If the identifier protrusion is provided on the toner container 100 side, a package bag of the toner container 100 may be broken or the protrusion may be damaged when the toner container 100 hits against other objects, and the identifier function may be damaged. In contrast, by providing a recess as the identifier shape on the toner container 100 side, it is possible to prevent the above described defects.

It may be possible to provide the identifier function by the interlocking between the driving protrusion 212 and the driven portion 110. For example, the shapes of the driving protrusion 212 and the driven portion 110 differ between the first embodiment and the second embodiment, and the driving protrusion 212 of one of the embodiments cannot interlock with the driven portion 110 of the other one of the embodiments. Therefore, it is impossible to set the toner container 100 of the second embodiment in the main body of the image forming apparatus that uses the toner container 100 of the first embodiment. Consequently, it is possible to prevent erroneous setting.

Third Modification

Figure 79:
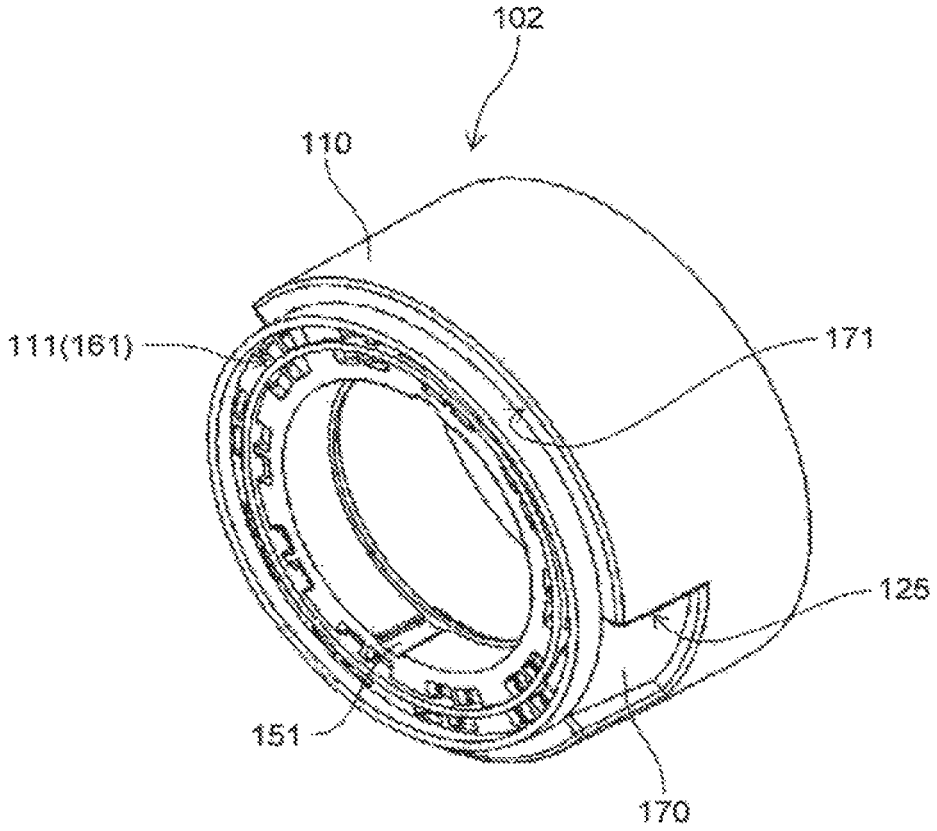
FIG. 79 is a perspective view of a cap of a third modification viewed from the other end side.
Figure 80:
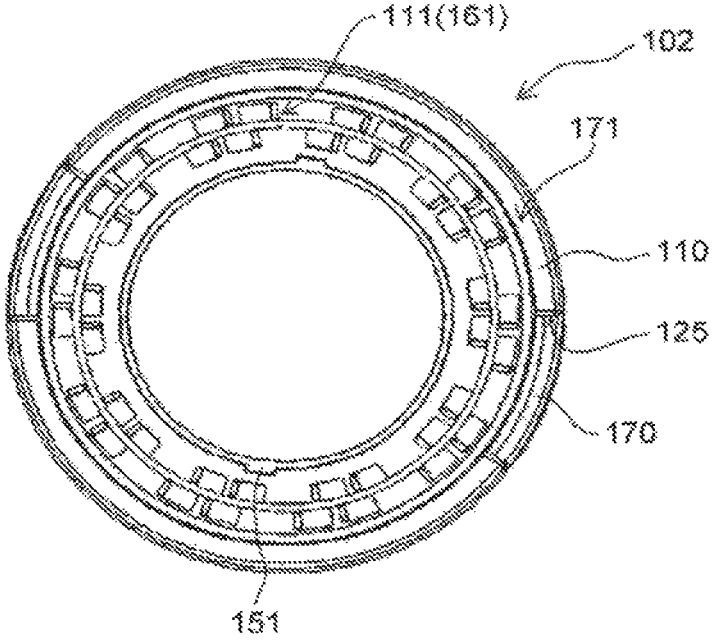
FIG. 80 is a front view of the cap of the third modification viewed from the other end side.
Figure 81:
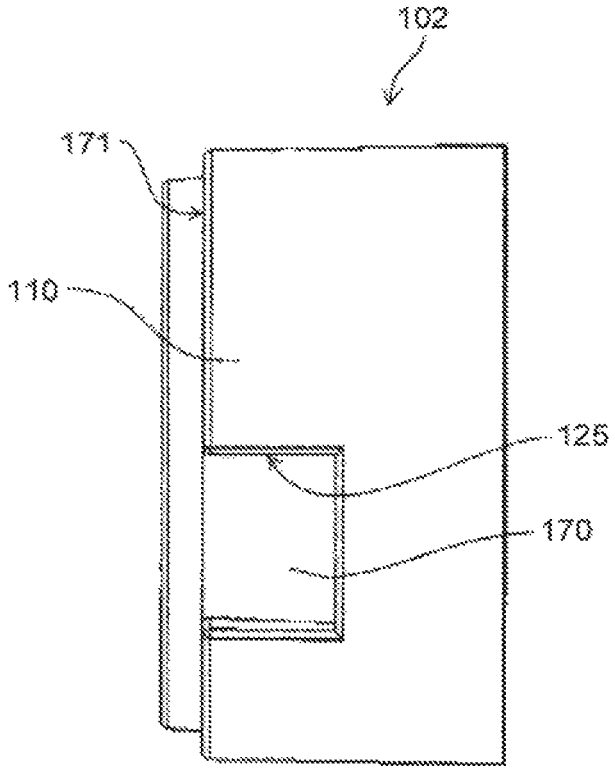
FIG. 81 is a side view of the cap of the third modification.

A third modified example of the toner container 100 to which the present invention is applied (hereinafter, referred to as a "third modification") will be described below. FIG. 79 is a perspective view of the cap 102 of the toner container 100 of the third modification when viewed from the other end side (downstream side in the insertion direction). FIG. 80 is a front view of the cap 102 of the third modification when viewed from the other end side (downstream side in the insertion direction). FIG. 81 is a side view of the cap 102 of the third modification.

As illustrated in FIGS. 79 to 81, the cap 102, which functions as a drive transmitted holder to which drive is transmitted in the toner container 100 of the third modification, is provided with positioning recesses 170 at two positions in the circumferential direction. The positioning recesses 170 are configured so as to interlock with the driving protrusions 212 serving as main-body positioning protrusions.

Figure 82:
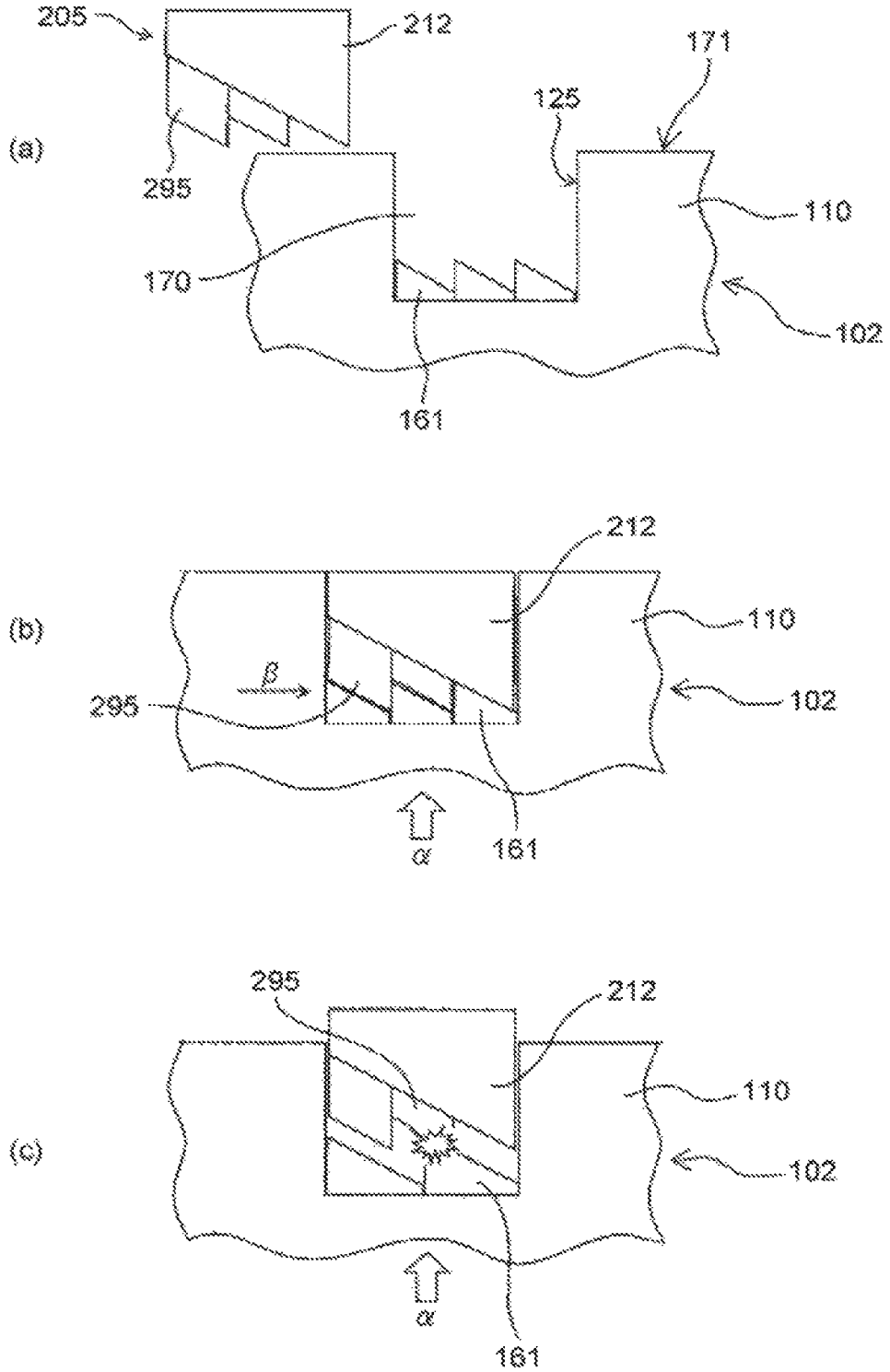
FIG. 82 illustrates interlocking operation of the cap and an output driving unit of the third modification: (a) illustrates the interlocking operation when the position of a positioning recess and the position of a driving protrusion in the circumferential direction do not match each other; (b) illustrates the interlocking operation when identifier shapes match each other; and (c) illustrates the interlocking operation when the identifier shapes do not match each other.

FIG. 82 illustrates interlocking operation of the cap 102 of the toner container 100 of the third modification and the output driving unit 205 of the apparatus main-body. In FIG. 82, (a) illustrates a case in which the position of the positioning recess 170 of the cap 102 and the position of the driving protrusion 212 of the output driving unit 205 in the circumferential direction do not match each other; (b) illustrates a case in which the positions of the positioning recess 170 and the driving protrusion 212 in the circumferential direction match each other, and the identifier shapes match each other; and (c) illustrates a case in which the positions of the positioning recess 170 and the driving protrusion 212 in the circumferential direction match each other, but the identifier shapes do not match each other.

In FIGS. 79 to 81, the identifier opening group 111 serves as the container identifier portion 161. However, in FIG. 82, for convenience of explanation with schematic side views, the container identifier portion 161 formed of a combination of concave portions and convex portions is employed as the container identifier portion 161.

If the positions of the positioning recess 170 and the driving protrusion 212 in the circumferential direction do not match each other when the toner container 100 is inserted, as illustrated in (a) in FIG. 82, a driven end surface 171 that is a downstream end of the driven portion 110 of the cap 102 in the insertion direction comes in contact with the front end of the driving protrusion 212. In this state, if an operator rotates the toner container 100 while pushing it in the insertion direction, the positions of the positioning recess 170 and the driving protrusion 212 in the circumferential direction are adjusted so as to match each other, and the driving protrusion 212 enters the positioning recess 170. At this time, if the identifier shapes match each other, as illustrated in (b) in FIG. 82, the toner container 100 can fully be inserted. In contrast, if the identifier shapes do not match each other, as illustrated in (c) in FIG. 82, the toner container 100 cannot fully be inserted. Therefore, the operator can recognize that the toner container 100 is not inserted in a proper combination, and can prevent erroneous setting of different types or different colors.

Fourth Modification

Figure 83:
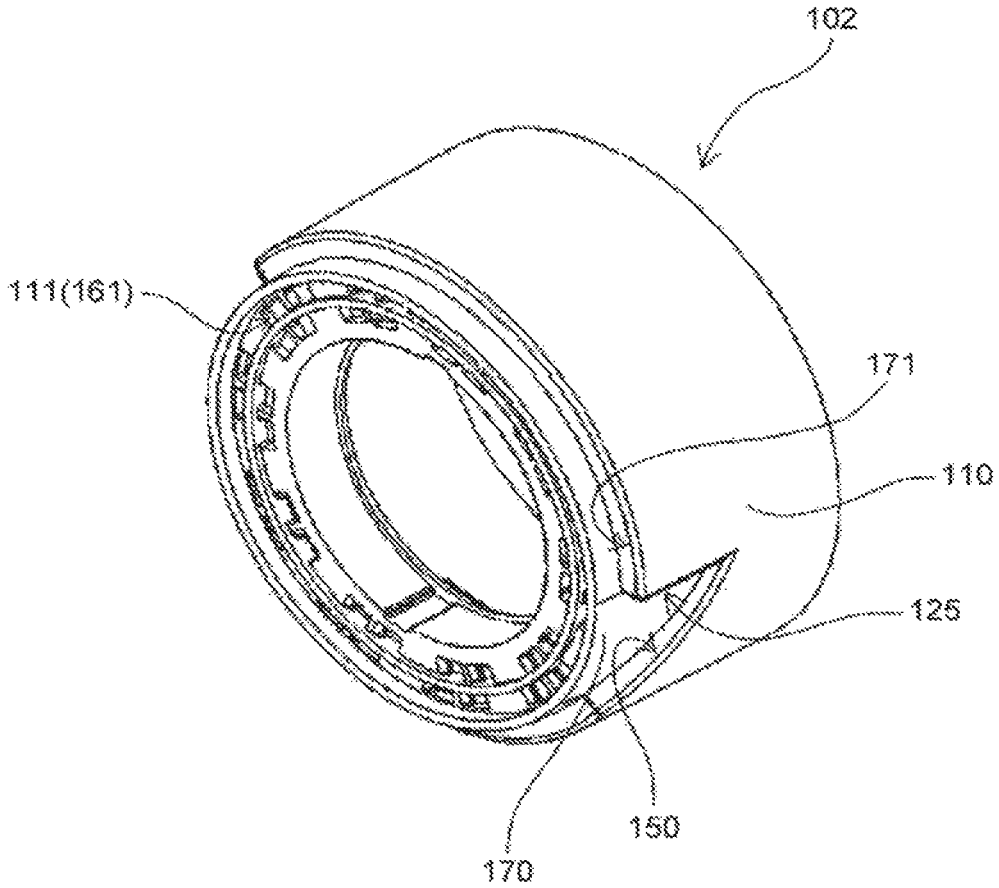
FIG. 83 is a perspective view of a cap of a fourth modification viewed from the other end side.
Figure 84:
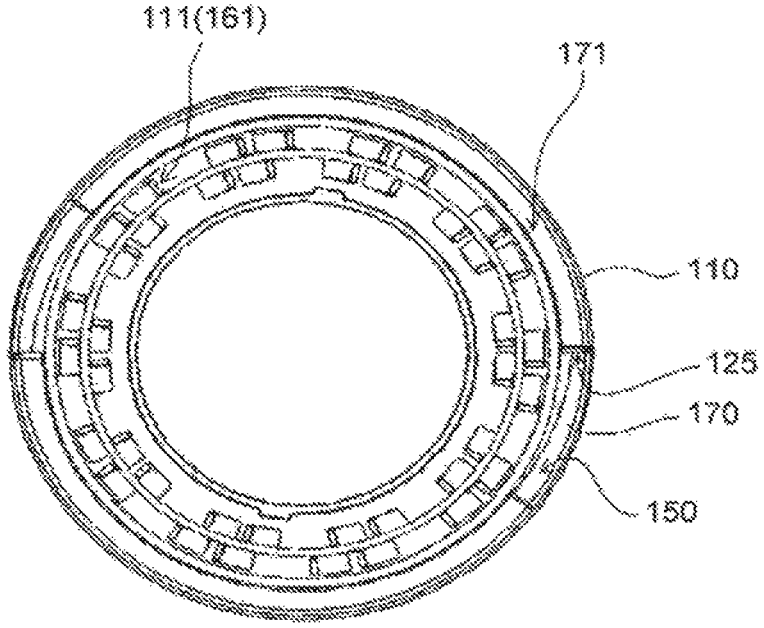
FIG. 84 is a front view of the cap of the fourth modification viewed from the other end side.
Figure 85:
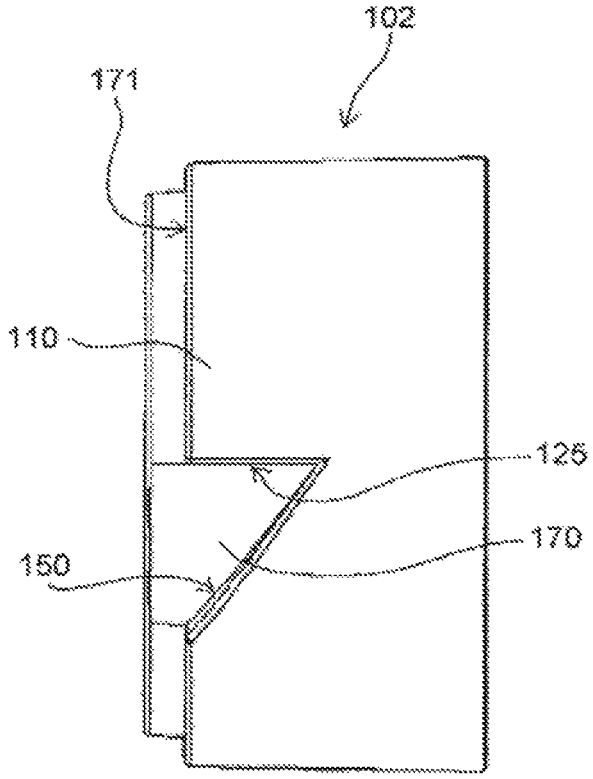
FIG. 85 is a side view of the cap of the fourth modification.

A fourth modified example of the toner container 100 to which the present invention is applied (hereinafter, referred to as a "fourth modification") will be described. FIG. 83 is a perspective view of the cap 102 of the toner container 100 of the fourth modification when viewed from the other end side (downstream side in the insertion direction). FIG. 84 is a front view of the cap 102 of the fourth modification when viewed from the other end side (downstream side in the insertion direction). FIG. 85 is a side view of the cap 102 of the fourth modification.

As illustrated in FIGS. 83 to 85, the cap 102, which functions as a drive transmitted holder to which drive is transmitted in the toner container 100 of the fourth modification, is provided with the positioning recesses 170 at two positions in the circumferential direction, similarly to the third modification. The positioning recesses 170 are configured so as to interlock with the driving protrusions 212 serving as the main-body positioning protrusions. The positioning recesses 170 of the cap 102 of the fourth modification differ from those of the third modification in that a part of the wall surface of each of the recesses (a wall surface other than the drive transmitted surface 125) functions as the guiding inclined surface 150 that serves as a position guide. By providing the guiding inclined surface 150, even when the positions of the positioning recess 170 and the driving protrusion 212 in the circumferential direction do not completely match each other, if the output guiding surface 220 of the driving protrusion 212 and the guiding inclined surface 150 come in contact with each other, the cap 102 is guided so that the positions in the circumferential direction match each other.

Figure 86:
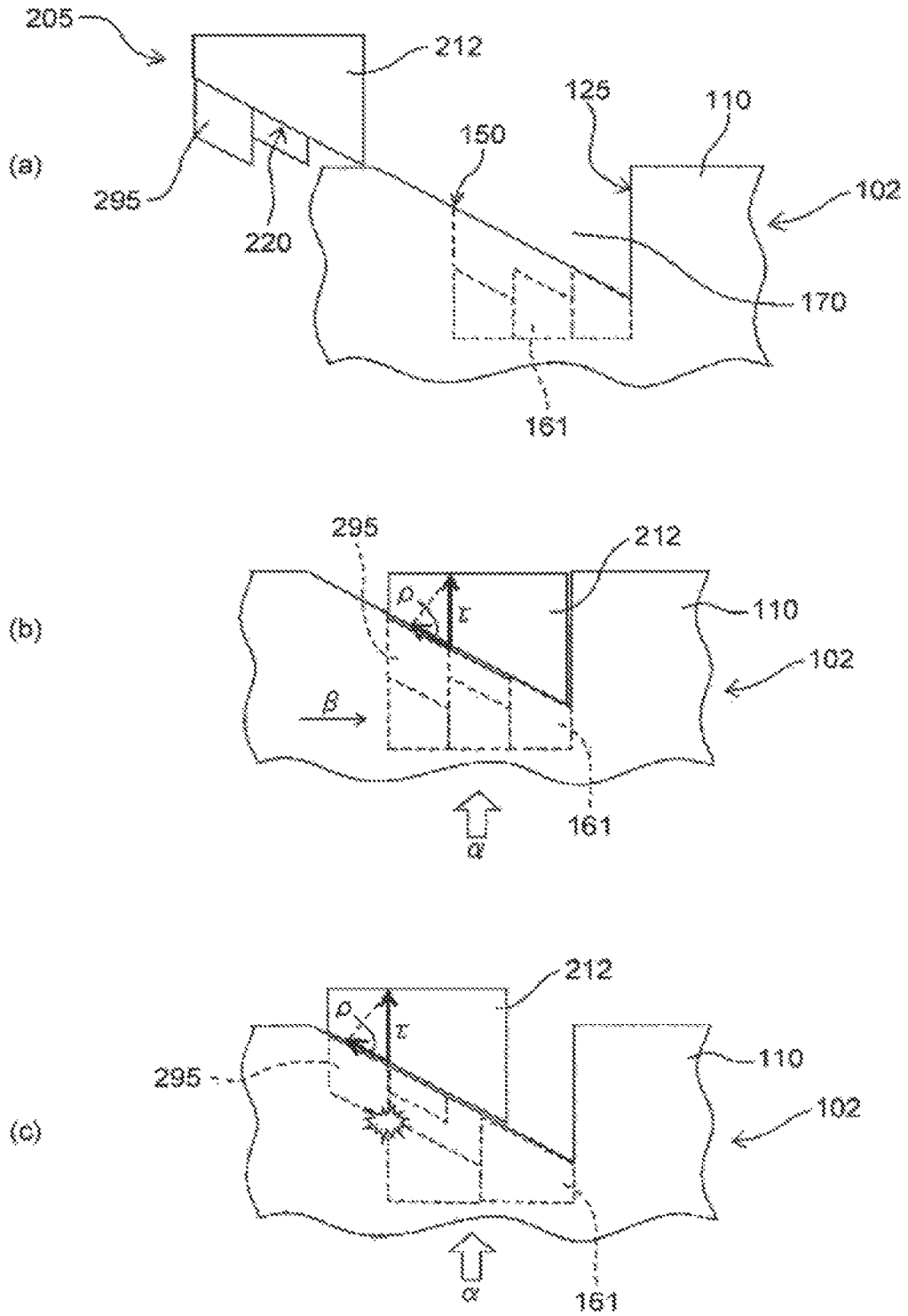
FIG. 86 illustrates interlocking operation of the cap and an output driving unit of the fourth modification: (a) illustrates the interlocking operation when the position of a positioning recess and the position of a driving protrusion in the circumferential direction do not match each other; (b) illustrates the interlocking operation when identifier shapes match each other; and (c) illustrates the interlocking operation when the identifier shapes do not match each other.

FIG. 86 illustrates interlocking operation of the cap 102 of the toner container 100 of the fourth modification and the output driving unit 205 of the apparatus main-body. in FIG. 86, (a) illustrates a case in which the position of the positioning recess 170 of the cap 102 and the position of the driving protrusion 212 of the output driving unit 205 in the circumferential direction do not match each other; (b) illustrates a case in which the positions of the positioning recess 170 and the driving protrusion 212 in the circumferential direction match each other, and the identifier shapes match each other; and (c) illustrates a case in which the guiding inclined surface 150 of the positioning recess 170 and the output guiding surface 220 of the driving protrusion 212 are disposed such that they come in contact with each other, but the identifier shapes do not match each other.

In FIGS. 83 to 85, the identifier opening group 111 serves as the container identifier portion 161. However, in FIG. 86, for convenience of explanation with schematic side views, the container identifier portion 161 formed of a combination of concave portions and convex portions is employed as the container identifier portion 161.

If the positions of the positioning recess 170 and the driving protrusion 212 in the circumferential direction do not match each other when the toner container 100 is inserted, as illustrated in (a) in FIG. 86, the driven end surface 171 that is the downstream end of the driven portion 110 of the cap 102 in the insertion direction comes in contact with the front end of the driving protrusion 212. In this state, if an operator rotates the toner container 100 while pushing it in the insertion direction, the positions of the positioning recess 170 and the driving protrusion 212 in the circumferential direction are adjusted such that the output guiding surface 220 of the driving protrusion 212 and the guiding inclined surface 150 of the positioning recess 170 come in contact with each other. In this state, if the operator pushes the toner container 100, the cap 102 rotates along the slope of the output guiding surface 220 and the driving protrusion 212 enters the positioning recess 170.

At this time, if the identifier shapes match each other, as illustrated in (b) in FIG. 86, the toner container 100 can fully be inserted. In contrast, if the identifier shapes do not match each other, as illustrated in (c) in FIG. 86, the toner container 100 cannot fully be inserted. Therefore, the operator can recognize that the toner container 100 is not inserted in a proper combination, and can prevent erroneous setting of different types or different colors.

The positioning recess 170 of the third and the fourth modifications is provided on a part of the cap 102 in the circumferential direction such that the other part serves as the driven end surface 171; however, it is not limited to a quadrangular shape as in the third modification or a shape with the position guide as in the fourth modification. For example, the positioning recess 170 may be formed in a U-shape.

Even in the configuration as described in the third and the fourth modifications, in which the driven end surface 171 is provided on the downstream end of the driven portion 110 in the insertion direction and a force in the circumferential direction does not act only by pushing in the insertion direction, it is possible to adjust the positions of the identifier shapes of the toner container 100 and the apparatus main-body. In the configurations of these modifications, even when an operator inserts the toner container 100 in an arbitrary orientation in the circumferential direction and the driven end surface 171 comes in contact with the upstream end of the driving protrusion 212 in the insertion direction, the operator can rotate the toner container 100. With this rotation, it is possible to adjust the position of the toner container 100 relative to the apparatus main-body in the circumferential direction so as to realize the positional relationship in which the driving protrusion 212 and the positioning recess 170 can interlock with each other. Therefore, a positional difference of the positioning recess 170 with respect to the drive transmitted surface 125 in the circumferential direction of the container identifier portion 161 can be used as an identification function.

In the third and the fourth modifications, the driving protrusion 212 as the main-body positioning protrusion and the positioning recess 170 as a drive transmitted portion of the toner container 100 interlock with each other only in a proper positional relationship, and the driven portion 110 receives a force from the driving protrusion 212 to enable drive. Further, the positional relationship between the driving protrusion 212 and the driven portion 110 in the circumferential direction is determined, so that the functions of the main-body identifier portion 295 and the container identifier portion 161 are enabled.

In the third and the fourth modifications, the positioning recesses 170, each including the drive transmitted surface 125 to which drive is input from the driving protrusion 212, are provided at two positions in the circumferential direction. It may be possible to provide the positioning recess 170 including the drive transmitted surface 125 serving as the drive transmitting unit at one position in the circumferential direction. In this case, it is sufficient to provide a recess sufficiently greater than the driving protrusion 212 at a position different from the positioning recess 170 in the circumferential direction so as to avoid the driving protrusion 212.

The aforementioned description is provided as one example, and the present invention has a specific effect for each of the following aspects.

(Aspect A)

A powder container, such as the toner container 100, is attachable to an image forming apparatus, such as the copier 500. The image forming apparatus includes a main-body interlocking portion, such as the rotatable driving protrusion 212, that is rotatable and protrudes toward an upstream side of an attachment direction (insertion direction) to which the powder container is attached, and includes an identifier protrusion, such as the identifier protrusion group 215, that protrudes toward the upstream side of the attachment direction to identify a type of the powder container. The powder container includes a container interlocking portion, such as the driven portion 110, configured to interlock with the main-body interlocking portion; and an interlocked portion, such as the identifier opening group 111, configured to interlock with the identifier protrusion. The interlocked portion is provided in a front end of the powder container in the attachment direction (an end surface of the powder container in the insertion direction). The container interlocking portion stands outward from an outer circumference of the powder container. The container interlocking portion and the interlocked portion are rotated integrally.

In this configuration, as described in the above embodiments, the container interlocking portion that interlocks with the main-body interlocking portion and is rotatable with the interlocked portion in an integrated manner can determine the position of the interlocked portion relative to the main body of the image forming apparatus in the rotation direction. This positioning places the interlocked portion at a different position relative to the container interlocking portion in the rotation direction depending on the type of the powder container to be identified, thereby providing an identifier function based on a difference in the position of the interlocked portion relative to the container interlocking portion in the rotation direction. Therefore, it is possible to use differences in the positions in directions other than the positions in the radial direction as differences in the identifier shape portions.

The main body of the image forming apparatus is provided with the identifier protrusion, such as the identifier protrusion group 215. The identifier protrusion interlocks with the interlocked portion when their shapes match each other. If the shapes of the interlocked portion and the identifier protrusion do not match each other, the interlocked portion and the identifier protrusion do not interlock with each other. Therefore, the front end surface of the powder container in the attachment direction, where the interlocked portion is provided, cannot reach the rear end in the attachment direction. Therefore, the amount of insertion of the powder container differs from the amount of insertion when the shapes of the identifier shape portions match each other. This enables an operator to recognize erroneous setting at the time of setting.

As described above, in Aspect A, it is possible to use differences in positions in a direction different from the radial direction as differences in the identifier shape portions.

(Aspect B)

In Aspect A, the container interlocking portion, such as the driven portion 110, includes a guide, such as the first guiding inclined surface 126, the second guiding inclined surface 127, or the guiding inclined surface 150, that guides the main-body interlocking portion, such as the driving protrusion 212, to have a positional relationship between the main-body interlocking portion and the container interlocking portion (the position such that the drive transmitted surface 125 comes in contact with the output guiding surface 220) so as to interlock with the container interlocking portion.

Therefore, as described in the above embodiments, even when the relative positions between the container interlocking portion and the main-body interlocking portion in the rotation direction are deviated from the proper interlocking positions, it is possible to adjust them to have a positional relationship in which interlocking is possible by the guide.

Accordingly, even if the insertion direction of the powder container in the main body of the image forming apparatus in the rotation direction is arbitrary, the relative positions between the container interlocking portion and the main-body interlocking portion in the rotation direction are adjusted to the proper interlocking positions. Therefore, it is possible to adjust the position of the interlocked portion, which is to be positioned with the container interlocking portion, relative to the main body of the image forming apparatus, thereby allowing insertion of the powder container at any position in the rotation direction.

(Aspect C)

In Aspect A or B, a plurality of container interlocking portions, such as the driven portions 110, are provided, and a plurality of interlocked portions, such as the identifier opening groups 111, with same shapes are provided, the number of interlocked portions being the same as the number of container interlocking portions.

Therefore, as described in the above embodiments, no matter which of the plurality of container interlocking portions interlocks with the main-body interlocking portion of the image forming apparatus, such as the driving protrusion 212, it is possible to provide the identifier function of the interlocked portion.

(Aspect D)

In any one of Aspects A to C, the interlocked portion, such as the identifier opening group, rotates while interlocking with the identifier protrusion, such as the identifier protrusion group 215.

Therefore, as described in the above embodiments, the power container can have the configuration of the rotation relative to the image forming apparatus and of the identifier shape.

(Aspect E)

In any one of Aspects A to D, a plurality of container interlocking portions, such as the driven portions, are provided and interlock with the main-body interlocking portion, such as the driving protrusion 212, at respective positions at intervals of 180 degrees in the rotation direction to receive rotation drive.

Therefore, as described in the above embodiments, the container interlocking portion rotates while not inclined with respect to the main body of the image forming apparatus, such as the copier 500, so that rotation drive can smoothly be transmitted.

(Aspect F)

In any one of Aspects A to E, a plurality of interlocked portions, including the outer identifier opening group 111*a* and the inner identifier opening group 111*b*, are provided at respective positions having different distances from a rotation axis of the container interlocking portion, such as the driven portion, and the interlocked portions, such as the identifier opening groups, in a radial direction.

Therefore, as described in the above embodiments, the interlocked portions are arranged at different positions in the radial direction, so that different variations of the interlocked portions corresponding to various types of identifier shapes can be provided.

(Aspect G)

In any one of Aspects D to F, a plurality of container interlocking portions, such as the driven portions 110, are provided, and one of the container interlocking portions is connected to another container interlocking portion by an inclined surface, such as the first guiding inclined surface 126, the second guiding inclined surface 127, or the guiding inclined surface 150. The another container interlocking portion is adjacent to the one of the container interlocking portions in a circumferential direction.

Therefore, as described in the above embodiments, it is possible to guide the main-body interlocking portion, such as the driving protrusion 212, to the position at which the main-body interlocking portion and the container interlocking portion are interlocked.

(Aspect H)

In any one of Aspects A to G, the container interlocking portion, such as the driven portion 110, has an outer periphery that is inclined so that a thickness of the outer periphery in the radial direction is reduced toward the downstream side in the attachment direction such as the insertion direction.

Therefore, as described in the above second modification, the tip of the container interlocking portion, such as the tip 110*a* of the driven portion 110, is prevented from coming in contact with a package material, such as a moisture-proof bag, so that it is possible to prevent the package material from being broken.

(Aspect I)

In any one of Aspects A to H, a downstream end of the container interlocking portion, such as the driven portion 110, in the attachment direction is located on the upstream side in the attachment direction relative to the front end, such as an end surface, in which the interlocked portion, such as the identifier opening group 111, is provided.

Therefore, as described in the above embodiments, it is possible to reduce the probability that a container bag for storing the powder container, such as the toner container 100, is broken, and it is possible to prevent damage of the container bag.

(Aspect J)

In any one of Aspects A to I, a discharge port, such as the discharge port 114, that discharges powder stored in the powder container is provided in the vicinity of a rotation axis of the container interlocking portion, such as the driven portion 110, and the interlocked portion, such as the identifier opening group 111, in a plane perpendicular to the rotation axis.

Therefore, as described in the above embodiments, it is possible to provide the configuration of discharging the powder from the powder container, such as the toner container 100, by the rotation of the powder container.

(Aspect K)

In any one of Aspects A to J, the interlocked portion, such as the identifier opening group 111, is provided so as to surround the discharge port, such as the discharge port 114.

Therefore, as described in the above embodiments, it is possible to provide the interlocked portion having a different shape in the rotation direction relative to the container interlocking portion, such as the driven portion 110, depending on the type of the powder container to be identified, such as the toner container 100.

(Aspect L)

In any one of Aspects A to K, toner is stored as the powder.

Therefore, as described in the above embodiments, it is possible to use differences in positions of the powder container, such as the toner container 100 storing the toner, in a direction different from the radial direction as differences in the identifier shape portions.

(Aspect M)

An image forming apparatus, such as the copier 500, includes an image forming unit, such as the printer 600, that forms an image on an image bearer, such as the photoconductor drum 1, by using powder, such as toner, for image formation; a powder conveying unit, such as the toner replenishing device 70, that conveys the powder to the image forming unit; and a powder container that is removably held by the powder conveying unit. The powder container, such as the toner container 100, according to any one of Aspects A to L is used as the powder container.

Therefore, as described in the above embodiments, it is possible to determine erroneous setting at the time of setting the powder container, and provide a number of the identifier shape portions. By providing a number of the identifier shape portions, it is possible to share components of the powder conveying unit and the powder container among a number of models, enabling to further reduce cost.

REFERENCE SIGNS LIST

1 Photoconductor Drum
1*y* Photoconductor Drum For Yellow
2 Charging Device
2*y* Charging Device For Yellow
3 Neutralizing Lamp
4 Photoconductor Cleaning Device
6*y* Primary-Transfer Roller For Yellow
5 Intermediate Transfer Belt
6 Primary-Transfer Roller
7 Secondary-Transfer Roller
8 Fixing Roller Pair
9 Developing Device
9*y* Developing Device For Yellow
11 Secondary-Transfer Opposing Roller
12 Driving Roller
13 Cleaning Opposing Roller
14 Tension Roller
15 Sheet Conveying Belt
16 Supporting Roller Pair
17 Optical Writing Device
18 Fixing Device
19 Belt Cleaning Device
20 Sub Hopper
21 Hopper Case
22 Conveying Screw
22*a* Upstream Conveying Screw
22*b* Downstream Conveying Screw
23 Toner Discharge Port
25 Toner End Sensor
30 Diaphragm Pump
31 Diaphragm
32 Case
35 Outlet Valve
36 Inlet Valve
38 Operation Chamber
40 Driving Unit
41 Motor
43 Holder
44 Eccentric Shaft
53 Tube
54 Toner Duct
60 Toner Storage
61 Container
62 Communicating Opening
63 Tube Connector
64 Feed Port
70 Toner Replenishing Device
91 Developer Case
92 Developing Roller
93 Stirring/Conveying Screw
93*a* First Stirring/Conveying Screw
93*b* Second Stirring/Conveying Screw
95 Doctor Blade
100 Toner Container
101 Container Body
102 Cap
103 Outer Cap
104 Grip Portion
105 Container-Body Protrusion
106 Inner Cap
107 Discharging Member
108 Opening Portion
109 Outer Cap Stopper
110 Driven Portion, Container Interlocking Portion
111 Identifier Opening Group, Container Opening Group, Interlocking Portion, Second Container Interlocking Portion
111*a* Outer Identifier Opening Group, Outer Opening Group
111*b* Inner Identifier Opening Group, Inner Opening Group
112 Bottom Portion
113 Conveying Groove
114 Discharge Port
115 Container-Side Scooping Portion
116 Stopper Protrusion
117 Circumferential Restrictor Protrusion
118 Circumference Defining Protrusion
119 Axial Restrictor Protrusion
120 Opening Base Portion
121 Stopper Rib
122 Axial Contact Surface
123 Circumferential Restrictor Contact Protrusion
124 Stuffing Protrusion
125 Drive Transmitted Surface
125*a* Drive Transmitted Part
126 First Guiding Inclined Surface, First Container Inclined Surface
127 Second Guiding Inclined Surface, Second Container Inclined Surface
128 Rear-Side Inclined Surface
129 Cap Front End
130 Ring
131 Inner Wall Of Ring
132 Outer Wall Of Ring
133 Reinforcing Ring
134 Reinforcing Plate
135 Scooping Portion
136 Ring Protrusion
137 Bottom Plate Of Inner Cap
138 Circumferential Wall Of Inner Cap
139 Tab
140 Inner Cap Seal
141 Inner Cap Vent
142 Inner Cap Stopper
143 Outer Periphery Of Outer Cap
144 Outer Cap Gripper
145 Outer Cap Screw
146 Inner Protrusion Of Outer Cap
147 Air Hole Of Inner Protrusion Of Outer Cap
148 Outer Cap Warpage
149 Ring Seal
150 Guiding Inclined Surface, Inclined Surface, Guide
151 Cap Interlocking Portion
152 Inner Peripheral Rib
153 Inner Cap Guiding Portion
153*a* Recess
154 Inner Cap Guiding Protrusion
155 Guide Holder
156 Holder Protrusion
157 Holder Notch

158 V-Shaped Recess
159 V-Shaped Protrusion
160 Rotation Stopping Edge
161 Container Identifier Portion, Container Protrusion, Second Container Interlocking Portion
161*a* Outer Container Identifier Portion, Outer Container Protrusion
161*b* Inner Container Identifier Portion, Inner Container Protrusion
170 Positioning Recess
171 Driven End Surface
190 Container Positioning Protrusion, First Container Interlocking Portion
191 Container Positioning Surface
192 Container Guiding Inclined Surface, Container Inclined Surface
200 Container Holder
201 Container Setting Section
202 Container Stopper
203 Container Detector
204 Container Inserter
205 Output Driving Unit
206 Drive Transmission Gear
207 Container Supporter
208 Container Driving Motor
209 Container Opening Motor
210 Container Releasing Lever
211 Gear Teeth
212 Driving Protrusion, Main-Body Interlocking Portion
212*a* First Driving Protrusion
212*b* Second Driving Protrusion
213 Container Insertion Opening
214 Drive Transmission Surface
215 Identifier Protrusion Group, Main-Body Protrusion Group, Identifier Protrusion Group
215*a* Outer Identifier Protrusion Group, Outer Protrusion Group
215*b* Inner Identifier Protrusion Group, Inner Protrusion Group
216 First Guiding Surface, First Main-Body Inclined Surface
217 Second Guiding Surface, Second Main-Body Inclined Surface
218 Third Guiding Surface, Third Main-Body Inclined Surface
219 Reinforcing Rib
220 Output Guiding Surface
290 Main-Body Interlocking Member
291 Main-Body Positioning Protrusion, First Main-Body Interlocking Portion
292 Main-Body Positioning Surface
293 Main-Body Guiding Surface
295 Main-Body Identifier Portion, Second Main-Body Interlocking Portion
295*a* Outer Main-Body Identifier Portion
295*b* Inner Main-Body Identifier Portion
300 Scanner
301 Contact Glass
302 First Scanning Body
303 Second Scanning Body
304 Imaging Forming Lens
305 Read Sensor
400 Automatic Document Feeder
401 Document Table
500 Copier
600 Printer
601 Sheet Feed Path In Printer
602 Registration Roller Pair
603 Manual Feed Path
604 Manual Feed Roller
605 Manual Feed Tray
606 Discharge Roller Pair
607 Discharge Tray
608 Separation Roller
700 Sheet Feed Table
701 Sheet Cassette
702 Feed Roller
703 Separation Roller
704 Sheet Feed Path
705 Conveying Roller Pair
Ly Light Beam For Yellow
P Sheet
Λ Central Angle

CITATION LIST

Patent Literature

[PTL 1]
Japanese Laid-open Patent Publication No. 7-168430

The invention claimed is:

1. A powder container insertable into an image forming apparatus, the powder container comprising:
- a conveying member configured to rotate to convey toner from one end side of the powder container to another end side of the powder container;
- a discharging port provided on the other end side to discharge the toner;
- a plurality of container-side scooping portions configured to lift up the toner contained in the powder container to the discharging port; and
- a discharging member inserted into the discharging port, wherein
- the discharging member includes
  - a cylindrical ring,
  - a reinforcing plate extending from an inner wall of the ring to the center in a radial direction, and
  - a plurality of discharging member-side scooping portions in which each discharging member-side scooping portion extends from the reinforcing plate toward the one end side of the powder container, is plate-shaped and is inclined toward a downstream side in a rotation direction of the conveying member, and
- a number of the plurality of discharging member-side scooping portions is larger than a number of the plurality of container-side scooping portions.

2. The powder container according to claim 1, wherein the plurality of discharging member-side scooping portions extend to the plurality of container-side scooping portions.

3. The powder container according to claim 1, wherein
- a reinforcing ring is provided in the center of the ring, and
- the reinforcing plate is connected to an outer circumference of the reinforcing ring.

4. The powder container according to claim 1, wherein three discharging member-side scooping portions are provided.

5. The powder container according to claim 1, further comprising:
- a cap member configured to cover the discharge port, the cap member including a guiding portion extending to the one end side of the power container, wherein
- a guide holder into which the guiding portion is inserted is provided in the discharging member.

6. The powder container according to claim 5, wherein the guide holder is provided in the center of the discharging member, and the reinforcing plate is connected to the guide holder.

7. The powder container according to claim 5, wherein a part of the guide holder in a circumferential direction is notched.

8. The powder container according to claim 1, wherein toner as the powder is contained therein.

9. An image forming apparatus, comprising:

the powder container according to claim 1.

* * * * *